US006361158B1

(12) United States Patent
Inoue et al.

(10) Patent No.: US 6,361,158 B1
(45) Date of Patent: Mar. 26, 2002

(54) INK CONTAINER FOR INK JET PRINTING, HOLDER FOR THE CONTAINER, CARRIAGE FOR THE HOLDER AND INK JET PRINTER

(75) Inventors: Hiroyuki Inoue, Yokohama; Sadayuki Sugama, Tsukuba; Soichi Hiramatsu, Hachiohji; Hideki Yamaguchi; Toshihiko Ujita, both of Yokohama; Akihiro Yamanaka, Kawasaki; Takashi Nojima, Mitaka; Yasuo Kotaki, Machida; Keiichiro Tsukuda; Hitoshi Nakamura, both of Kawasaki; Akira Kida, Yokohama; Hideaki Kawakami, Yokohama; Takeshi Iwasaki, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/169,978

(22) Filed: Oct. 13, 1998

Related U.S. Application Data

(62) Division of application No. 08/796,519, filed on Feb. 7, 1997, which is a division of application No. 08/518,730, filed on Aug. 24, 1995, now Pat. No. 5,619,237.

(30) Foreign Application Priority Data

| | | |
|---|---|---|
| Aug. 24, 1994 | (JP) | 6-199809 |
| Feb. 21, 1995 | (JP) | 7-032347 |
| Feb. 28, 1995 | (JP) | 7-040814 |
| Feb. 28, 1995 | (JP) | 7-041107 |

(51) Int. Cl.[7] ..... B41J 2/175

(52) U.S. Cl. ..... 347/86

(58) Field of Search ..... 347/84, 85, 86, 347/87, 152, 7

(56) References Cited

U.S. PATENT DOCUMENTS

| | | | | |
|---|---|---|---|---|
| 4,771,295 A | * | 9/1988 | Baker et al. | 347/87 |
| 4,853,708 A | | 8/1989 | Rasmussen et al. | 347/86 |
| 4,872,026 A | | 10/1989 | Walters | 347/56 |
| 4,907,018 A | | 3/1990 | Pinkerpell et al. | 346/139 R |
| 4,969,759 A | | 11/1990 | Suzuki et al. | 400/124 |

(List continued on next page.)

FOREIGN PATENT DOCUMENTS

| | | |
|---|---|---|
| DE | 92 03 206 | 7/1992 |
| DE | 93 00 132 | 6/1993 |
| DE | 94 05 723 | 7/1994 |
| EP | 0 139 508 | 5/1985 |
| EP | 395197 | 2/1990 |

(List continued on next page.)

*Primary Examiner*—Anh T. N. Vo
(74) *Attorney, Agent, or Firm*—Fitzpatrick, Cella, Harper & Scinto

(57) ABSTRACT

An ink container for containing ink to be supplied to an ink jet head to which the ink container is detachably mountable, inclues an ink supply port for supplying the ink to the ink jet head; a air vent for fluid communication with ambience; a claw-like projection provided on a first side of the ink container; a latching lever provided on a second side opposite from the ink container, the latching lever being resiliently supported on the ink container and having a latching claw.

64 Claims, 45 Drawing Sheets

U.S. PATENT DOCUMENTS

| | | | | | |
|---|---|---|---|---|---|
| 5,155,502 | A | | 10/1992 | Kimura et al. | 347/87 |
| 5,156,470 | A | | 10/1992 | Suzuki et al. | 400/124 |
| 5,156,471 | A | | 10/1992 | Suzuki et al. | 400/124 |
| 5,156,472 | A | | 10/1992 | Suzuki et al. | 400/124 |
| 5,156,473 | A | | 10/1992 | Suzuki et al. | 400/124 |
| 5,158,377 | A | | 10/1992 | Suzuki et al. | 400/124 |
| 5,174,665 | A | | 12/1992 | Suzuki et al. | 400/124 |
| 5,221,148 | A | | 6/1993 | Suzuki et al. | 400/124 |
| 5,245,361 | A | | 9/1993 | Kashimura et al. | 347/50 |
| 5,250,957 | A | * | 10/1993 | Onozato | 347/7 |
| 5,328,279 | A | | 7/1994 | Suzuki et al. | 400/124 |
| 5,359,357 | A | | 10/1994 | Takagi et al. | 347/49 |
| 5,421,658 | A | | 6/1995 | Suzuki et al. | 400/124 |
| 5,515,091 | A | | 5/1996 | Kimura et al. | 347/86 |
| 5,534,899 | A | | 7/1996 | Uchikata et al. | 347/49 |
| 5,552,816 | A | * | 9/1996 | Oda et al. | 347/86 |
| 5,561,450 | A | | 10/1996 | Brewster et al. | 347/49 |
| 5,583,549 | A | * | 12/1996 | Ujita et al. | 347/86 |
| 5,619,239 | A | | 4/1997 | Kotaki et al. | 347/86 |

FOREIGN PATENT DOCUMENTS

| | | | | | |
|---|---|---|---|---|---|
| EP | 0 376 719 | | | 7/1990 | |
| EP | 0 378 240 | | | 7/1990 | |
| EP | 496642 | | | 1/1992 | |
| EP | 551752 | | | 12/1992 | |
| EP | 0546832 | | | 6/1993 | B41J/2/175 |
| EP | 0 546 832 | | | 6/1993 | |
| EP | 0 560 729 | | | 9/1993 | |
| EP | 0622208 | | | 2/1994 | B41J/2/175 |
| EP | 0 590 669 | | | 4/1994 | |
| EP | 623471 | | | 4/1994 | |
| EP | 0 604 940 | | | 7/1994 | |
| EP | 0 607 928 | | | 7/1994 | |
| EP | 622208 | | | 11/1994 | |
| EP | 0 655 336 | | | 5/1995 | |
| EP | 0 676 294 | | | 10/1995 | |
| JP | 1-109378 | | | 4/1989 | |
| JP | 5104735 | A | * | 4/1993 | B41J/2/175 |
| JP | 53-18762 | | | 12/1993 | |
| WO | 89/08028 | | | 9/1989 | |

* cited by examiner

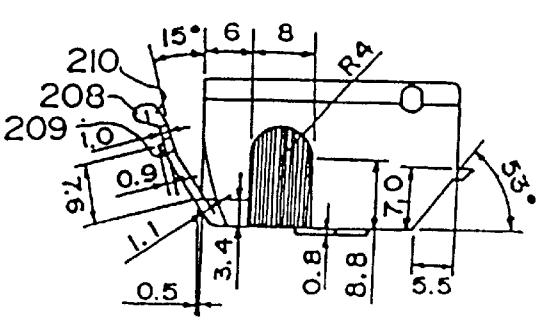
FIG. 32c
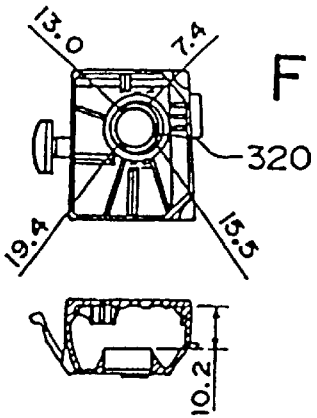
FIG. 32e
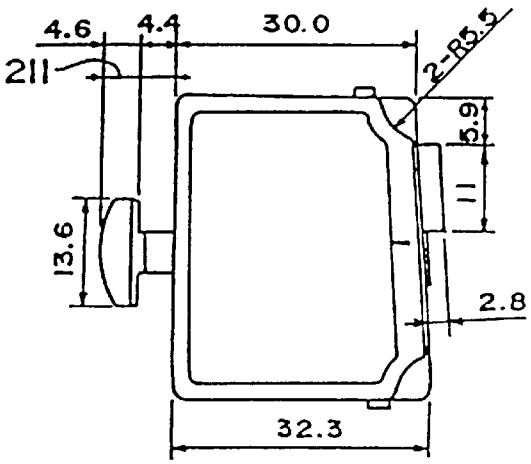
FIG. 32b
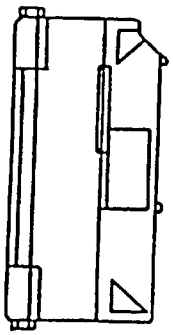
FIG. 32d
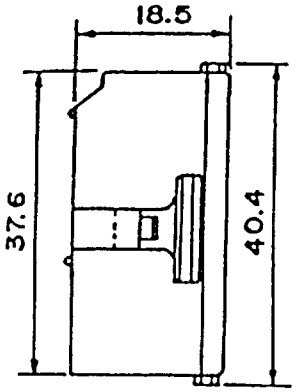
FIG. 32a
FIG. 32f

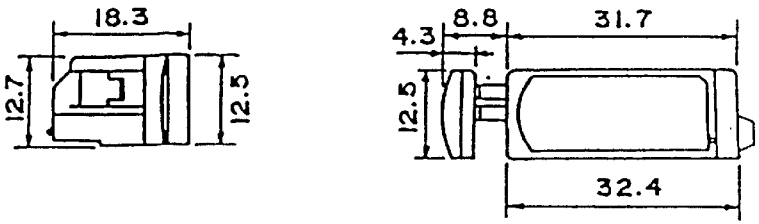
FIG. 33a
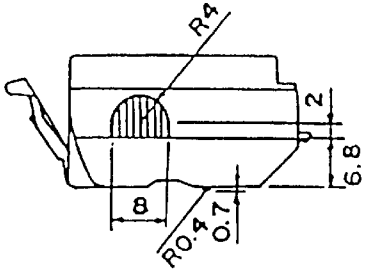
FIG. 33b
FIG. 33c
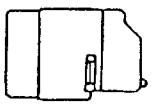
FIG. 33d
FIG. 33e
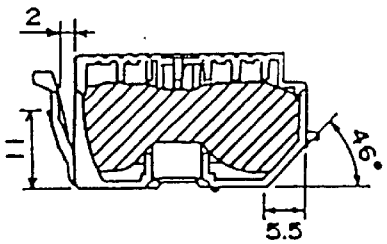
FIG. 33f
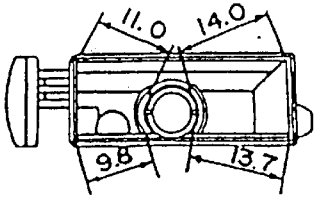
FIG. 33g

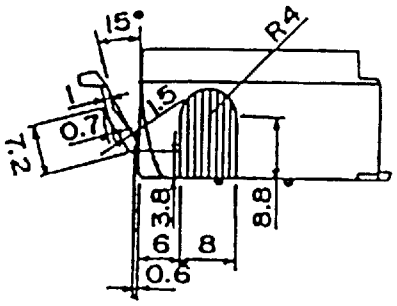
FIG. 34a
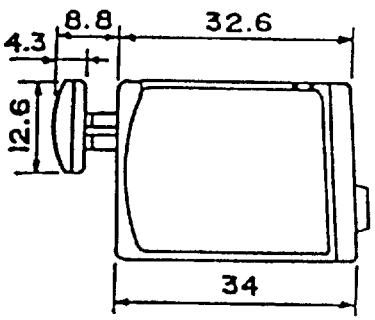
FIG. 34b
FIG. 34c
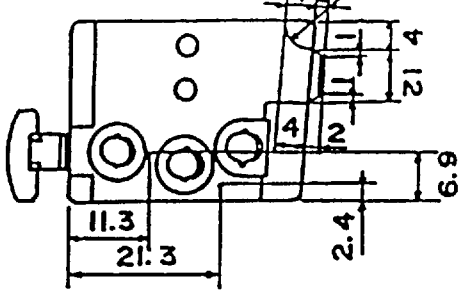
FIG. 34d
FIG. 34e
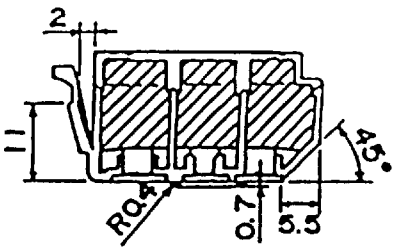
FIG. 34f

INK CONTAINER FOR INK JET PRINTING, HOLDER FOR THE CONTAINER, CARRIAGE FOR THE HOLDER AND INK JET PRINTER

CROSS-REFERENCE TO RELATED APPLICATIONS

This application is a division of application Ser. No. 08/796,519 filed Feb. 7, 1997, now pending, which is a division of application Ser. No. 08/518,730, filed Aug. 24, 1995, which issued as U.S. Pat. No. 5,619,237 on Apr. 8, 1997.

FIELD OF THE INVENTION AND RELATED ART

The present invention relates to a replaceable ink tank for an ink cartridge that is useable with an ink jet recording apparatus for recording images on recording mediums by means of ejecting ink thereon. It also relates to such an ink jet recording apparatus comprising: an ink container for storing the recording ink; an ink container holder for removably holding the ink container, a carriage which removably holds the recording head, and is moved in a manner of scanning the recording medium, in terms of the relative movement between the carriage and recording medium.

Conventionally, the recording apparatus, which records images on a recording medium (hereinafter, it may be called "recording paper") such as paper, fabric, plastic sheet, OHP sheet, or the like, has been proposed in the form of an apparatus capable of accommodating recording heads of various systems; for example, the wire-dot system, thermal system, thermal transfer system, and ink jet system.

Among such recording systems, the ink jet system is a quiet non-impact system, which records images on the recording medium by means of ejecting ink from ejection orifices (nozzles) aligned on a recording element. Therefore, recording apparatuses employing this ink jet system (hereinafter, an ink jet recording apparatus) can record with high density at a high speed.

The form of the ink jet recording apparatus is chosen to accommodate specific functions of a system in which the recording apparatus is employed, and also to match the way it is used. Generally speaking, the ink jet recording apparatus comprises: a carriage for mounting the recording ink container; conveying means for conveying the recording medium; and controlling means for controlling these sections.

When recording, a recording head which ejects ink droplets from a plurality of ejection orifices is moved in the direction (primary scanning direction) perpendicular to the direction (secondary scanning direction) in which the recording paper is conveyed, in a manner of serially scanning the recording medium. When not recording, that is, during the intervals between one line of the primary scanning and the following one, the recording medium is moved in the secondary scanning direction by a pitch equivalent to the recording width. Each time the recording head makes a single line of scanning run across the recording medium, a recording is made on the recording medium across a width corresponding to the number of nozzles aligned in the recording head in parallel to the secondary scanning direction.

Further, the ink jet recording apparatus is inexpensive to run, and its size can be easily reduced. In addition, it can be easily used with a plurality of color inks to record color images. Lastly, it can record at a high speed. In particular, when a line-type recording apparatus employing a line-type recording head, in which a large number of ejection orifices are aligned across the entire width of the recording medium, is used, the recording speed can be increased to a higher level.

Thus, the ink jet recording apparatus is used, being commercialized, as output means for information processing systems. For example, it is used as a printer as a peripheral output device for a copying machine, an electric typewriter, a word processor, a work station, and the like, or as a printer (or a portable printer) for a personal computer, a host computer, an optical disc apparatus, a video apparatus, and the like.

In terms of an energy generating element for generating the energy to be used for ejecting the ink from the ejection orifices of the recording head, there are: the ink jet recording heads employing electromechanical transducers such as piezoelectric elements; those employing electromagnetic devices such as a laser that irradiates electromagnetic wave to generate the heat to be used for ejecting the ink droplets; those employing electrothermal transducers comprising heat generating resistors to be used for heating the liquid; and the like.

Among the ink jet recording heads described in the foregoing, those employing the ink jet recording system that uses thermal energy to eject the ink droplets can record with high resolution (bubble jet printers), since the ejection orifices thereof can be aligned with high density. In particular, those employing the electrothermal elements as the energy generating elements enjoy several advantages in that their size can be easily reduced; they can be highly integrated, and their production cost is lower, since they can make full use of the highly advanced, reliable IC and microprocessing technologies, which have been developed in the semiconductor field.

The ink container for supplying the ink to the recording head generally comprises an ink absorbing member, a container for storing this ink absorbing member, and a cover member for sealing this container.

The aforementioned recording heads can be classified into two groups: a chip type head integral with the ink container, and a separate type head removably connectable to the ink container. In either type, the positional relationship between the recording head and ink container, or between a recording head cartridge comprising the recording head and ink container integral therewith, and the carriage, is an essential matter in terms of printing quality. One of the means for fixing their relationship comprises a hole, and a pin that engages into the hole, wherein the positional relationship can be accurately fixed as the hole and pin are engaged.

In the case of a small ink jet recording apparatus, a mechanism comprising a lever or the like, which is operated for moving the ink container or recording head cartridge in various directions, has been employed as a mechanism for fixing the aforementioned positional relationship between the recording head and ink container, or between the recording head cartridge and carriage, so that the installation or removal thereof requires a smaller space than otherwise.

SUMMARY OF THE INVENTION

The aforementioned mechanism, which moves the ink container or recording head cartridge in various directions during installation or removal thereof, requires only a small space for the installation or removal, and therefore, contributes to the size reduction of the ink jet recording apparatus.

However, its operation for installing or removing the ink container or recording head is relatively complicated. Therefore, it is important to obtain a structure which is small, simple to operate, trouble free during the installing or removing operation, and also does not reduce accuracy in the positional relationship.

Accordingly, the primary object of the present invention is to provide: an ink container, an ink container holder, and a carriage, which have a simple structure, and simplify the operation for mounting or removing the ink container, without reducing the positioning accuracy, and the sizes of which can be easily reduced; and an ink jet recording apparatus comprising such a carriage.

Another object of the present invention is to provide an ink container which is capable of effectively utilizing the available internal space for storing the ink, has a simple structure, can be mounted or removed through a simple operation, and which is more reliable and durable, and the size of which can be further reduced; and an ink jet recording apparatus comprising such an ink container and a holder for such an ink container.

Another object of the present invention is to provide an ink container structure that improves the ink supplying capacity while allowing the ink container size to be reduced.

From a different point of view, the object of the present invention is to provide an ink jet recording apparatus capable of improving operational properties.

Another object of the present invention is to provide a protective member which makes it possible to protect more reliably the ink container produced in accordance with the present invention, while it is sold or stored.

The present invention was made based on the discovery that the internal structure of the ink container affected the long term usage of the ink container, in terms of the ink supplying performance of a small ink container. Accordingly, another object of the present invention is to provide an internal structure for an ink container which can stabilize the ink supply performance.

Another object of the present invention is to provide an inexpensive ink container by means of simplifying the external configuration of the small ink container, and a method for reliably mounting such an ink container into the holder.

Another object of the present invention is to solve the problems that occur when an ink container, the ink supply port of which is fitted with a unidirectional ink supplying member, is mounted; in particular, when such an ink container is mounted through a rotary motion.

The present invention was made in consideration of the discovery that the ink container failed to be reliably mounted depending on acting point. Accordingly, another object of the present invention is to provide a structure and/or method, which is effective for mounting the ink container, in particular, when at least the width or length of the ink container is more than the thickness (height) thereof.

The present invention is an invention capable of accomplishing at least one of the aforementioned objects, and effectively solves various shortcomings of the ink container, which have not been recognized.

According to an aspect of the present invention, there is provided an ink container for containing ink to be supplied to an ink jet head to which the ink container is detachably mountable, comprising: an ink supply port for supplying the ink to the ink jet head; an air vent for fluid communication with ambience; a claw-like projection, provided on a first side of the ink container; a latching lever provided on a second side opposite from the ink container, the latching lever being resiliently supported on the ink container and having a latching claw.

According to another aspect of the present invention, there is provided an ink container holder for holding an ink container for containing ink to be supplied to an ink jet head, comprising: an opening for receiving the ink container; an ink receiving tube for receiving the ink from the ink container; a first internal wall having a first engaging hole for engagement with a claw-like projection of the ink container; a second internal wall having a second engaging hole for engagement with a latching claw of a latching lever of the ink container; and a projected portion for covering a part of the opening.

According to a further aspect of the present invention, there is provided an ink container holder for holding an ink container for containing ink to be supplied to an ink jet head with which the ink container is integral, the ink container holder is detachably mountable to a carriage reciprocally movable, comprising: the improvement residing in that an operating portion from mounting and demounting of the ink container and an operating portion for mounting and demounting thereof relative to the carriage, are provided in a same side relative to a movement direction of the carriage.

According to a further aspect of the present invention, there is provided a reciprocable carriage for an ink jet apparatus, comprising: a mounting portion for mounting an ink container holder; a positioning portion, on a first side, for positioning the ink container; an electric contact for electric connection with head contacts of an ink jet head mounted to the ink container; a guiding member, resiliently supported on a second side, for engagement with an engaging portion of the ink container holder.

The protective member in accordance with the present invention is a protective member for protecting an ink container, the bottom surface of which is provided with a delivery port for delivering the recording ink stored within the ink container, and one of the surfaces of the protective member is provided with a projection which is inserted into a recess of the holder into which the ink container is mounted; wherein the ink container is mounted into, or released from, the holder by means of engaging the latching claw of an elastic, operational latch lever, which is disposed on the container, on the surface opposite to the surface on which the projection is disposed, with the engagement portion of the holder, or disengaging them. It is characterized by comprising: a protective portion for covering, with no contact, the elastic, operational latch lever, on which the aforementioned latching claw is disposed; a bottom portion on which an absorbent member or a cap for sealing the peripheries of the aforementioned delivery port; a recess for accommodating the projection; and an engagement portion which engages with the upper corner of the ink container, on the side of the aforementioned elastic, operational latch lever. Therefore, the present invention can offer reliable, effective, and comprehensive protection for the ink container, by means of protecting and/or using the projection member of the ink container.

From the standpoint of the operational improvement accomplished by the present invention, the present invention is characterized by the provision of a first ink container and a second ink container, which are integral with a color recording head which records image by means of ejecting the ink onto the recording medium; are removably mountable on the carriage, which is reciprocated along the surface of the aforementioned recording medium in order to scan the recording medium by the recording head; and can be held in the ink container holder capable of holding a plurality of ink containers correspondent to the number of the recording heads. It is also characterized in that the first and second ink containers are marked with first and second colors, respectively, and the corresponding ink container retaining portions of the ink container holder are marked with the first and second colors, respectively. With the provision of toe above described structure and/or color marks, it is possible to eliminate ink container installation error as well as other operational errors.

As seen from the standpoint of the operational improvement of the ink jet recording apparatus, the ink jet recording apparatus in accordance with the present invention, which records images by means of ejecting the ink onto the recording medium, is characterized by comprising: a reciprocatively supported carriage; a holder, which is integral with the ink jet recording head, and is mountable on the carriage; and ink containers, the bottom surface of which is provided with a delivery port for delivering the recording ink stored in the ink container, and which is mounted into, or demounted from, the holder by means of engaging the latching claw with the engagement portion of the holder in which the ink container is mounted; wherein the colors of the ink containers are different from each other. It is preferred that three colors resemble the color of the carriage integrated with the apparatus, and the colors of the removably mountable ink containers are brighter than the carriage. Such a color scheme offers various advantages as will be described in the embodiments illustrated in FIGS. 19 and 27, in particular, when the mounting or demounting operation involves limited portions of the carriage or holder, since the structure involves in mounting or demounting of the ink containers can be easily recognized by the colors, making it easier to mount or demount the containers.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 32*a–f* are drawings of an embodiment of the black ink container 30, which give a left side view 32*a*, a top view 32*b*, a front view 32*c*, a right side view 32*d*, a further reduced projection 32*e* of the top view 32*b*, the absorbing member having been removed, and a further reduced sectional view 32*f* at a sectional plane that includes the center line of the unidirectional ink delivery member, wherein the container measurement has been accurately (proportionally) reduced.

FIGS. 33*a–g* are drawings of an embodiment of the black ink container 130: a left side view 33*a*, a top view 33*b*, a front view 33*c*, a right side view 33*d*, a bottom view 33*e*, a sectional view 33*f* at a sectional plane that includes the center line of the unidirectional ink delivery member illustrated in 33*c*, and a projection 33*g* of the top view 33*b*, the absorbing member having been removed, wherein the container measurement has been accurately (proportionally) reduced.

FIGS. 34*a–f* are drawings of an embodiment of the color ink container 160: a left side view 34*a*, a top view 34*b*, a front view 34*c*, a right side view 34*d*, a bottom view 34*e*, and a sectional view 34*f* of the front view 34*c* at a sectional plane that includes the center line of the unidirectional ink delivery member illustrated in 34*c*, wherein the container measurement has been accurately (proportionally) reduced.

DESCRIPTION OF THE PREFERRED EMBODIMENTS

Hereinafter, the embodiments of the present invention will be described with reference to the drawings.

Figure 1:
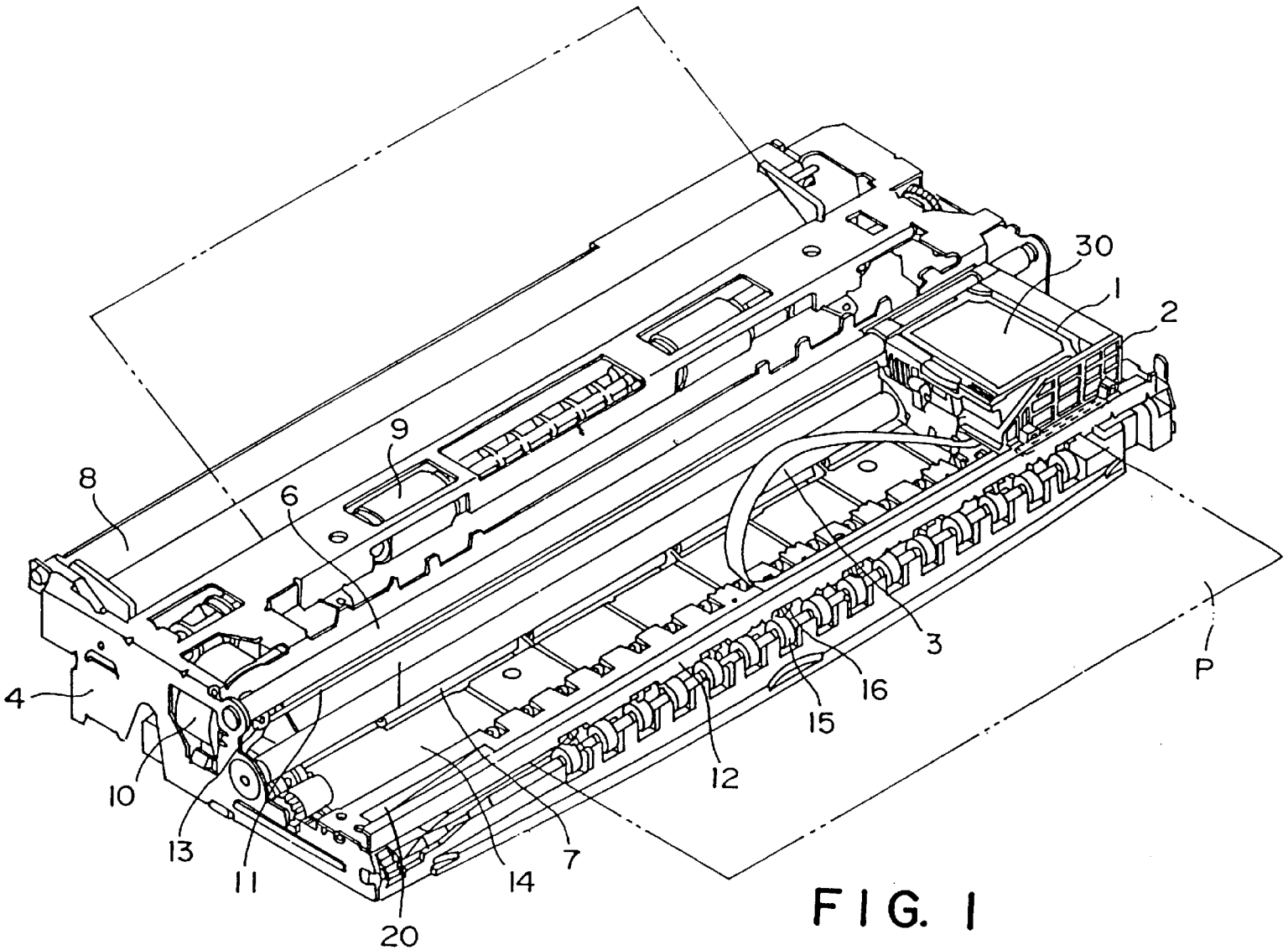
FIG. 1 is a perspective view of an embodiment of the ink jet recording apparatus in accordance with the present invention.

FIG. 1 is a perspective view of an embodiment of the ink jet recording apparatus in accordance with the present invention. In the drawing, a recording head cartridge 1 is removably mounted on a carriage 2, which is supported on a guide shaft 5 and a guide rail 12. The guide shaft 5 and guide rail 12 are fixed to a frame 4 at both ends, in parallel to each other, and the carriage 2 is slidable on these shafts 5 and 12 in the direction which is perpendicular to the direction in which-recording medium P is conveyed, and also is parallel to the surface of recording medium P. A carriage 2 is connected to a part of a carriage driving belt 11 which is stretched around a drive pulley 13 and a rotatively supported follower pulley (unillustrated). A driver pulley 13 is fixed to the output shaft of a carriage drive motor 10. As the carriage drive motor 10 is driven, the carriage driver belt 11 is rotated, reciprocating the carriage in the aforementioned direction.

The recording head cartridge 1 is constituted of an ink container holder comprising: a nozzle portion 50 (FIG. 5) as a recording head for ejecting the ink in response to a recording signal, that is, an electric signal for ejecting the ink; and a mono-color holder 60 (FIG. 5) which removably holds the ink container 30 for storing the ink. The nozzle portion 50 is located at the bottom (bottom end portion of the drawing) of the recording head cartridge 1, from which the ink is ejected downward of the drawing. The recording signal is sent from a controller circuit to the nozzle portion, through a flexible cable 3 provided on the carriage 2. The controller circuit controls the operation of this ink jet recording apparatus. The flexible cable 3 is disposed in parallel to the moving direction of the carriage 2, and forms a loop as the carriage moves. The recording head cartridge 1 and carriage 2 will be described in detail at a later time.

The recording medium P is mounted on a pressure plate 8 rotatively supported on the frame 4 at both ends. The pressure plate 8 is under a pressure directed toward a pickup roller 9 by a pressing means (unillustrated). The recording medium P placed on the pressure plate 8 is pressed upon the pickup roller 9. As the pickup roller 9 is rotated in response to a sheet feed command, the recording medium P is fed out by the friction that occurs between the pickup roller 9 and recording medium P. The pressure plate 8 has separating means (unillustrated) such as a separating claw, which is employed in a conventional automatic sheet feeding apparatus; therefore, only a single recording medium P, that is, the topmost sheet, is fed out by the function of this separating means.

The recording medium P having been fed out by the pickup roller 9 is fed downward of the carriage 2, being held between a conveyer roller 6, which is supported by the frame 4 at both ends, and a pinch roller 7 provided on a base 14. The recording is made on the recording medium P positioned in this manner. On the further downward side of the carriage 2, relative to the direction in which the recording medium P is conveyed, a sheet discharger roller 15 and a spur 16 are disposed, opposing each other, and the recording medium P having passed underneath the carriage 2 is held between the sheet discharger roller 15 and spur 16, and is subsequently discharged. The pickup roller 9, conveyer roller 6, and sheet discharger roller 15 are driven by a sheet feeder motor (unillustrated).

Hereinafter, the upstream side, relative to the recording medium P conveying direction, will be called a rear side, and the surface on the rear side will be called a back surface; the downstream side will be called a front side, the surface thereof being a front surface.

Figure 2:
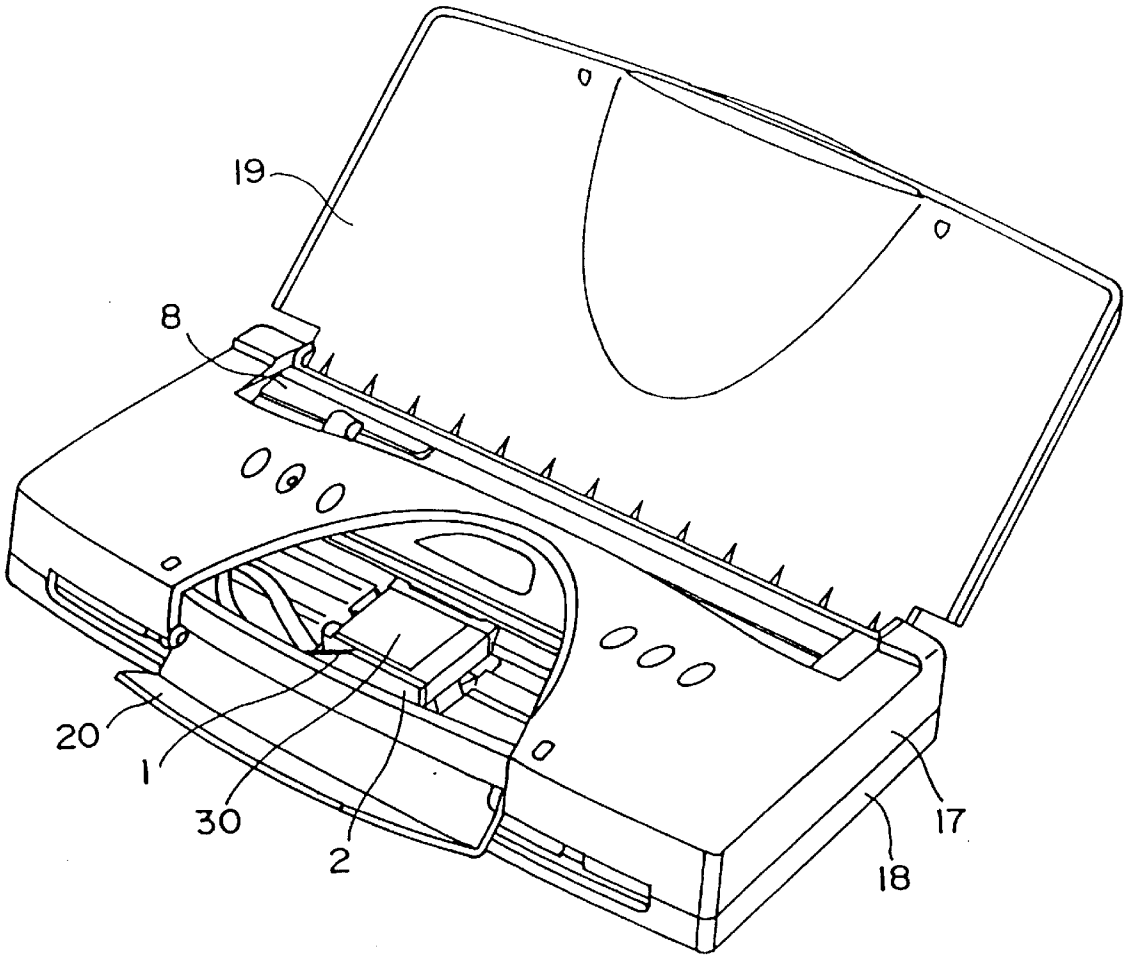
FIG. 2 is a perspective view of the ink jet recording apparatus illustrated in FIG. 1, which is in a case.

FIG. 2 is a perspective view of the ink jet recording apparatus illustrated in FIG. 1, wherein the apparatus is placed in a case. Referring to FIG. 2, the outer shell is constituted of a bottom case 18 and a top case 17, and the ink jet recording apparatus illustrated in FIG. 1 is placed in the shell.

At the rear side portion of the top case, a top cover 19 for covering the top case is attached. This top cover 19 can be freely opened or closed. The top case 17 has an opening which is located adjacent to the pressure plate 8, and the opened top cover 19 serves as a tray to be used for setting the recording medium P on the pressure plate 8. The top case 17 has another opening which extends from its central portion to the front surface, and from this opening, the recording head cartridge 1 or the ink container 30 can be mounted or dismounted. Therefore, when the recording head cartridge 1 or the ink container 30 is replaced, the carriage 2 is moved to the central point of its moving range through a predetermined operation. On the front side of this opening for exchanging the recording head cartridge 1 or ink container 30, a head cover 20 is attached, which covers a part of the top portion of this opening, and constitutes a portion of the front surface. This head cover 20 is also freely opened or closed, but, when the recording head cartridge 1 or ink container 30 is not exchanged, it is left closed to protect the recording head cartridge.

Figure 3:
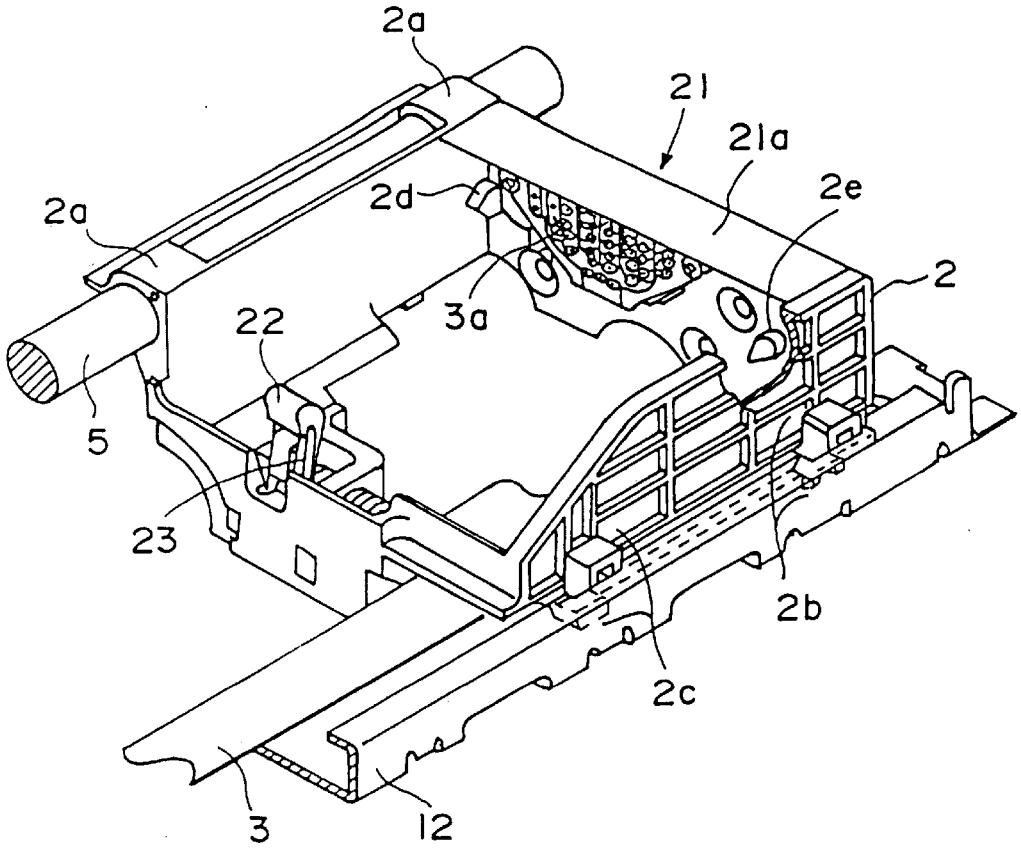
FIG. 3 is a perspective view of the carriage of the ink jet recording apparatus illustrated in FIG. 1.

Next, referring to FIG. 3, the carriage 2 will be described. FIG. 3 is a perspective view of the carriage 2 of the ink jet recording apparatus illustrated in FIG. 1.

Generally, the carriage 2 has a configuration like a frame, and in its void, the recording head cartridge 1 (FIG. 1) is mounted. On the back surface of the carriage 2, two bearings 2*a* are integrally attached, through which a guide shaft 5 is put. On the front surface of the carriage 2, two guide rail holders 2*b* as holding means, and a stopper 2*c* for preventing the carriage deformation, are integrally mounted. The guide rail holders 2*b* are located on the side of a cable retainer 21, and the carriage deformation preventing stopper 2*c* is located on the side of a head guide 22. The guide rail holder 2*b* and carriage deformation preventing stopper 2*c* are disposed a predetermined distance away from each other, and are constituted of two members, which hold a guide rail 12 in the form of plate, and vertically project. As is evident from the above description, the carriage 2 is supported by two bearings 2*a*, the guide rail holder 2*b*, and the carriage deformation preventing stopper 2*c*. With this arrangement, the carriage 2 is supported in parallel to the base 14 (FIG. 1), so that the distance between the nozzle portion 50 (FIG. 5) of the recording head cartridge 1 mounted on the carriage 2, and the recording medium P (FIG. 1), can be kept substantially stable.

However, the distance between the two members constituting the carriage deformation preventing stopper 2*c* is rendered larger than the distance between the two members constituting the guide rail holder 2*b*; therefore in practical terms, the carriage 2 is supported at three points excluding the carriage deformation preventing stopper 2*c*. This is due to the following factor. In consideration of the load applied by the sliding carriage 2, three supporting points, which are not in a straight line, are enough to support the carriage 2 in parallel to the base 4. Further, the provision of the carriage deformation preventing stopper 2*c* is for preventing the carriage 2 from being unnecessarily displaced or deformed by the load added to the guide rail holder 2*b* and bearings 2*a* when the recording head cartridge 1 is mounted on, or removed from, the carriage 2, so that operational troubles can be avoided. The reasons for disposing the carriage deformation preventing stopper 2*c* on the head guide 22 side is that, when the recording head cartridge 1 is mounted on, or removed from, the carriage 2, a certain amount of force is applied to this head guide 22.

The flexible cable 3 is routed through a predetermined path, and a cable terminal 3*a* attached to its end is fixed to the carriage 2, on the inner side of the right wall in the drawing. The cable terminal 3*a* comes in contact with the head terminal 53 of the recording head cartridge 1, establishing thereby an electrical connection for the recording head cartridge 1, when the recording head cartridge 1 is mounted on the carriage 2.

The cable retainer 21 is constituted of a bent plate member of electrically conductive material such as stainless steel. The top end constitutes a cover portion 21*a* extending further inward of the carriage 2 than the cable terminal 3*a*. Also, a part of the cable retainer 21 is in contact with the GND pattern of the flexible cable 3. In other words, the cable retainer 21 is grounded through the flexible cable 3. This arrangement is made so that the static electricity carried on the fingers or the like of the operator, the static electricity accumulated on the recording head cartridge 1, and the like, can be discharged to the GND, through the cable retainer 21, when an operator mounts the recording head cartridge 1 on the carriage 2, or removes it. With this arrangement, the aforementioned static electricity or the like is prevented from being discharged to the cable terminal 3*a*, preventing thereby the damage to the control circuit of this ink jet recording apparatus.

Since a portion of the cable retainer 21 constitutes the cover portion 21*a*, the cable terminal 3*a* comes under the cover portion 21*a*; therefore, it becomes unlikely for the fingers or the like of the operator to touch the cable terminal 3*a*. As a result, it becomes easier for the aforementioned static electricity or the like to be discharged to the cable retainer 21, and in addition, the cable terminal 3*a* itself can be protected by the cover portion 21*a*.

On the carriage 2 surface on which the cable terminal 3*a* is located, two projections is 2*d* and 2*e* for positioning the head are integrally formed. The head positioning projection 2*d* is in the form of a square pillar, and is located on the rear side of the cable terminal 3*a*. The other positioning projection 2*e* is in the form of a cylinder with a conic tip, and is located on the front side of the cable terminal 3*a*. When the recording head cartridge 1 is on the carriage 2, the head positioning projection 2*d* is in the head positioning notch 53*a* (FIG. 5) of the recording head cartridge 1, and the other head positioning projection 2*e* is in the head positioning hole 53*b* (FIG. 5) of the recording head cartridge 1, whereby the position of the recording head cartridge 1 on the carriage 2 is accurately fixed. As is evident from the above description, the head positioning projections 2*d* and 2*c* constitute the head positioning means of the carriage 2, and the head positioning notch 53*a* and head positioning hole 53*b* constitute the head positioning means of the recording head cartridge 1.

Also on the carriage 2, a contact spring 23 is disposed at a location facing the cable terminal 3*a*, and the head guide 22 formed of resin material is fixed to one end of the contact spring 23. In other words the head guide 22 is elastically supported on the carriage 2. When the recording head cartridge 1 is on the carriage 2, the head guide 22 is in the head pressing portion 60*b* (FIG. 6) of the recording head cartridge 1, and presses the recording head cartridge 1 toward the cable terminal 3*a* due to the force from the contact spring 23, as will be described later. The cable terminal 3*a* and head guide 22 are positioned to face directly to each other, so that the contact between the cable terminal 3*a* and head terminal 35 is guaranteed. Further, the head guide 22 plays the role of a guide when the recording head cartridge 1 is mounted on the carriage 2.

Figure 4:
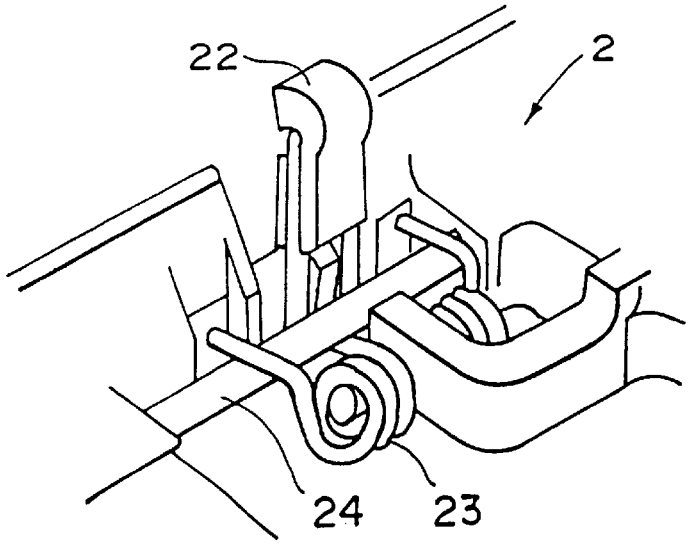
FIG. 4 is a perspective view of the head guide of the carriage illustrated in FIG. 3, and its peripheries.

Referring to FIG. 4, in this embodiment, a torsional coil spring of the double torsion type is employed as the contact spring 23, and two portions of the coil are supported by a supporting rod integrally formed on the carriage 2. A metallic shaft 24, which is supported on the carriage 2 at both ends, is held between the two end portions extending from each coiled portion. With this arrangement, the load imparted on the carriage 2 when a load is imparted to the contact spring 23 is dispersed to prevent the carriage 2 deformation. The pressure applied to the recording head cartridge 1 is set at approximately 2 kgf, so that, when the recording head cartridge 1 is mounted on the carriage 2, the cable terminal 3*a* and head terminal 53 are reliably placed in contact with each other.

As described above, a portion of the cable retainer 21 constitutes the cover portion 21*a*, and the head guide 22 is located at the point directly facing the cable terminal 3*a*; therefore, when the recording head cartridge 1 is mounted on the carriage 2, the carriage 2 surface on the head terminal 53 side is placed under the cover portion 21*a*, and the recording head cartridge 1 is rotated about the edge of the cover portion 21*a*. As a result, it requires only a small space to mount the recording head cartridge 1 on the carriage 2, with the cover portion 21*a* serving as a guide.

Further, the cover portion 21*a* extends over the cable terminal 3*a*; therefore, if an attempt is made to mount the recording head cartridge 1 without placing the head terminal 35 side of the recording head cartridge 1, under the cover portion 21*a*, the base plate 51 or the like of the recording head cartridge 1 touches the cover portion 21*a* before it comes in contact with the cable terminal 3*a*, preventing thereby the recording head cartridge 1 from damaging the cable terminal 3*a*.

Figure 5:
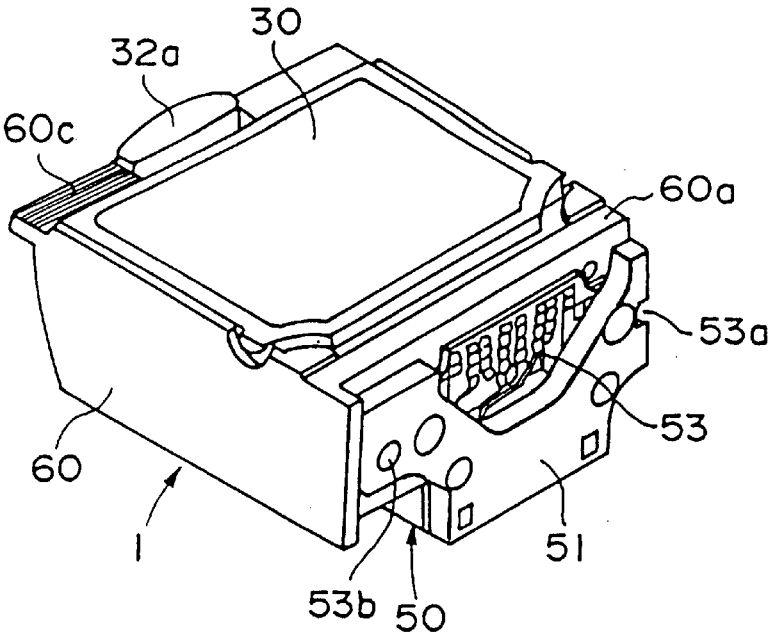
FIG. 5 is a perspective view of a monochrome recording head mountable in the ink jet recording apparatus illustrated in FIG. 1, being connected with the ink container, and oriented to show the head terminal.
Figure 6:
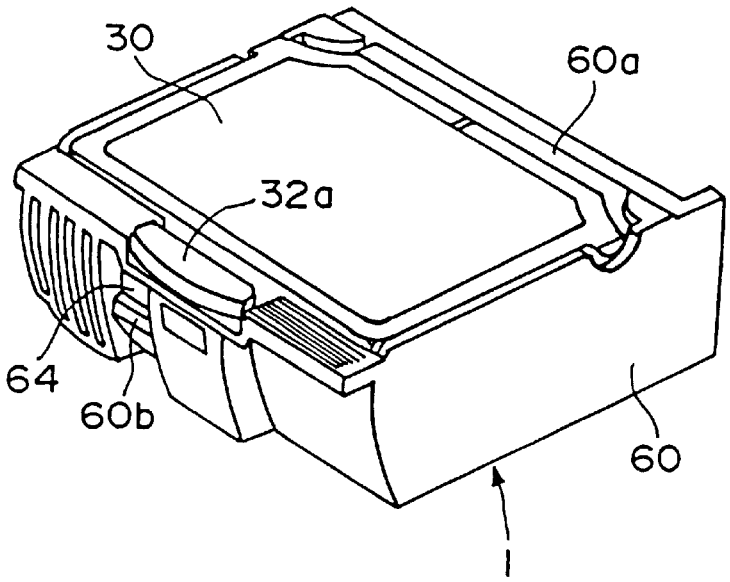
FIG. 6 is a perspective view of the monochrome recording head cartridge mountable in the ink jet recording apparatus illustrated in FIG. 1, being connected with the ink container, and oriented to show the side opposite to the side where the head terminal is located.
Figure 7:
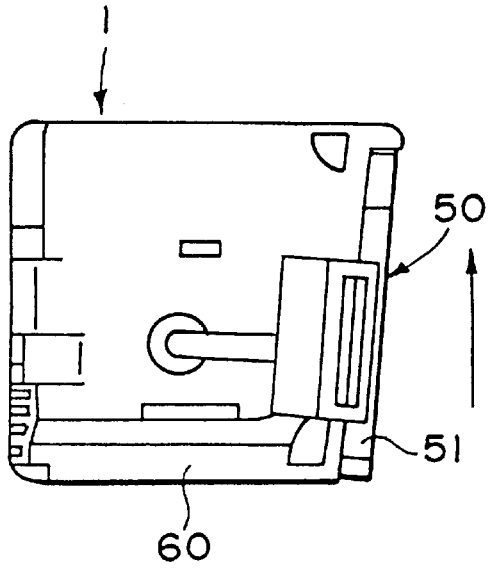
FIG. 7 is a plan view of the bottom of the monochrome recording head cartridge mountable in the ink jet recording apparatus illustrated in FIG. 1.

Next, the recording head cartridge 1 will be described. FIG. 5 is a perspective view of the recording head cartridge 1 with an ink tank therein of the ink jet recording apparatus illustrated in FIG. 1, as seen from the direction from which the head terminal 53 can be seen. FIG. 6 is a perspective view of the recording head cartridge 1 of the ink jet recording apparatus illustrated in FIG. 1, as seen from the direction from which the recording head cartridge 1 surface, opposite to the head terminal 35, can be seen. FIG. 7 is a bottom view of the recording head cartridge 1 of the ink jet recording apparatus illustrated in FIG. 1, and FIG. 8 is an enlarged perspective view of the essential portions of the nozzle portion 50 of the recording head cartridge 1, illustrated in FIG. 7.

This recording head cartridge 1 is a cartridge for monochrome printing. Referring to FIGS. 5–7, it integrally comprises the nozzle portion 50 for ejecting the ink, and the mono-color ink tank holder 60. The mono-color holder has side and bottom walls, and its top surface is open. In the internal space of the mono-color holder 60, the ink container 30 containing monochromatic ink is removably mounted.

Figure 8:
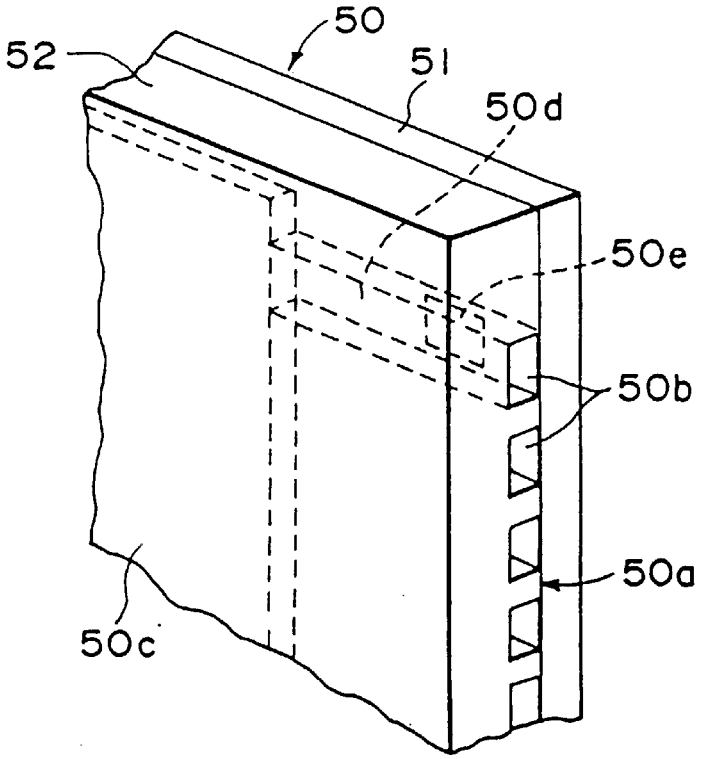
FIG. 8 is an enlarged perspective view of the nozzle portion of the recording head cartridge illustrated in FIG. 7.

Referring to FIG. 8, an enlarged drawing, the nozzle portion 50 comprises a base plate 51 formed of metallic material such aluminum, and a grooved member 52. The grooved member has various grooves for forming a plurality of liquid passages 50*d* and a common liquid chamber 50*c* and is fixed to the base plate. On the ejection orifice surface 50*a* of the nozzle portion 50, which faces the recording medium P (FIG. 1), a plurality of ejection orifices 50*b* are formed, constituting the opening ends of the plurality of ink passages 50*d*. On the base plate 51, electrothermal transducers (heat generating resistors or the like) for generating the energy to be used for ejecting the ink are disposed in correspondence to the aforementioned plurality of ink passages 50*d*, which are arranged at a predetermined pitch. The common liquid chamber 50*c* is connected to the ink container (FIG. 5), and the ink is supplied to the common liquid chamber 50*c* from the ink container 30. Each electrothermal transducer 50*e* is electrically connected to the head terminal 53 through wiring (unillustrated).

The head terminal 53 is constituted of a piece of electrical substrate such as glass epoxy resin fixed to the base plate, and the wiring connected to the electrothermal transducer 50*e* is also connected to the head terminal 53 using the wire bonding means. Referring to FIG. 7, the base plate 51 is tilted one to four degrees, relative to the recording medium P conveying direction; therefore, the line formed by the ejection orifices 50*b* is also tilted one to four degrees, relative to the recording medium P conveying direction.

The ink, which is temporarily stored in the common liquid chamber 50*c* after having been supplied thereto from the ink container, enters the liquid passage 50*d* due to the capillarity, and forms a meniscus at the ejection orifice 50*b*. This meniscus keeps the liquid passage filled with the ink. Under this condition, power is supplied to the electrothermal transducer 50*c* in response to the recording signal transmitted to the head terminal 53, and the electrothermal transducer 50*e* generates heat. Then, the ink on the ink electrothermal transducer 50*e* is suddenly heated to cause the film-boiling, and develops bubbles in the liquid passage 50*d*. A s these bubbles expand, the ink is ejected from the ejection orifices 50*b*. In the above description, the electrothermal transducer 50*c* was quoted as the energy generating element, but the energy generating element is not limited to the electrothermal transducer 50*c*. Instead, a piezoelectric element, which generates mechanical energy capable of instantly applying the ejection pressure to the ink, may be employed.

Also on the base plate 51, a head positioning notch 53*a* with which the head positioning projection 2*d* in the form of a square pillar engages, and a head positioning hole 53*b*, with which the cylindrical head positioning projection 2*e* engages, and formed in correspondence to the locations of the head positioning projections 2*d* and 2*e* of the carriage 2 (FIG. 3), respectively.

The base plate 51 is fixed to one of the lateral walls of the mono-color holder 60, using the thermal welding, the ultrasonic welding, or the like welding method. On the upper surface of the mono-color holder 60, a stepped portion 60*a* is formed at the end portion, on the side of the base plate 51; in other words, this portion is one step lower than the other portions. When the recording head cartridge 1 is mounted on the carriage 2, the recording head cartridge 1 can be easily positioned with substantial accuracy, by means of placing the top surface of this stepped portion 60*a* under the cover portion 21*a* (FIG. 3) of the cable retainer 21.

As for the mechanism for mounting the recording head cartridge 1 on the carriage 2, or removing it, a head pressing portion 60*b* and a head mounting-dismounting tab 60*c*, are formed on the mono-color holder 60, on the outward facing surface of the lateral wall located on the opposite side of the base plate 51. The head pressing portion 60*b* is a head fixing portion, which is held by the head guide 22 (FIG. 3) of the carriage 2 when the recording head cartridge 1 is mounted on the carriage 2. The head mounting-dismounting tab 60*c* is a tab to be used to mount the recording head cartridge 1 on the carriage 2, or remove it. The head pressing portion 60*b* is a recessed portion formed on the mono-color holder 60, on the wall opposite to the base plate 51, extending from the bottom edge of the surface to the top edge thereof. The top end portion of the head pressing portion 60*b* constitutes a head guide engaging portion 64, which is further r recessed, and when the recording head cartridge 1 is mounted on the carriage 2, the head guide 22 of the carriage 2 is engaged with this head guide engaging portion 64. As the head guide 22 engages with the head guide engaging portion 64 the recording head cartridge 1 is accurately positioned and fixed on the carriage 2. The head mounting-dismounting tab 60*c* is located on the front side of the recording head cartridge 1 in the drawing, that is, on the surface where the head pressing portion 60*b* is formed, at the top portion of the area farthest away from the head pressing portion 60*b*. It is provided to make it easier for the operator to remove the recording head cartridge 1 from the carriage 2; the operator can place a finger on the tab to pull up the recording head cartridge 1.

Figure 12:
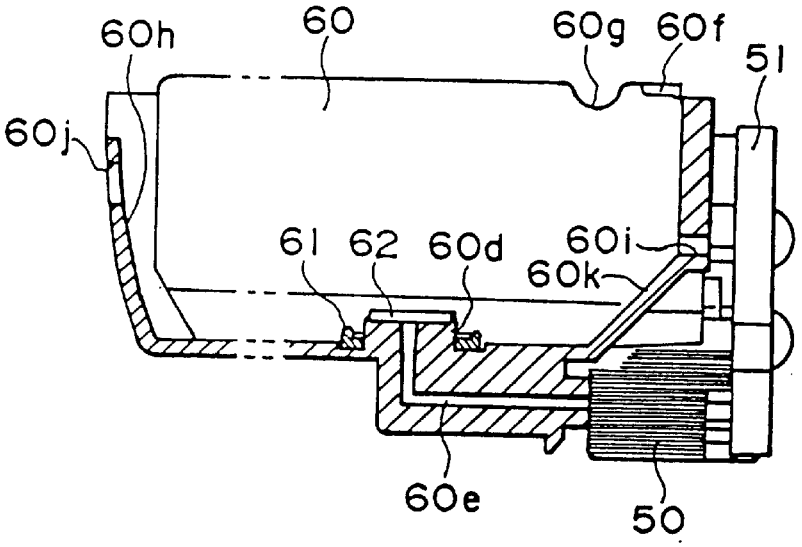
FIG. 12 is a sectional view of the recording head cartridge illustrated in FIG. 11, at a sectional line A—A.

The head pressing portion 60*b* is formed in one of the recessed regions, and the head mounting-dismounting tab 60*c* is formed in the other. These recessed regions are recessed relative to the neighboring (projecting) regions, which project due to the formation of a latch lever guide groove 60*h* (FIG. 12). The latch lever guide groove 60*h*, which will be described later, constitutes the guide for a latch lever 32*a*. Therefore, the limited space available for the recording head cartridge 1 is effectively used; a minimum space is used to provide a head fixing portion which is held by the head guide 22, and also, the head mounting-dismounting tab to be used when the recording head cartridge 1 is removed from the carriage 2.

At this time, the operation for mounting the recording head cartridge 1 on the carriage 2, or removing it, will be described.

Figures 9A, 9B:
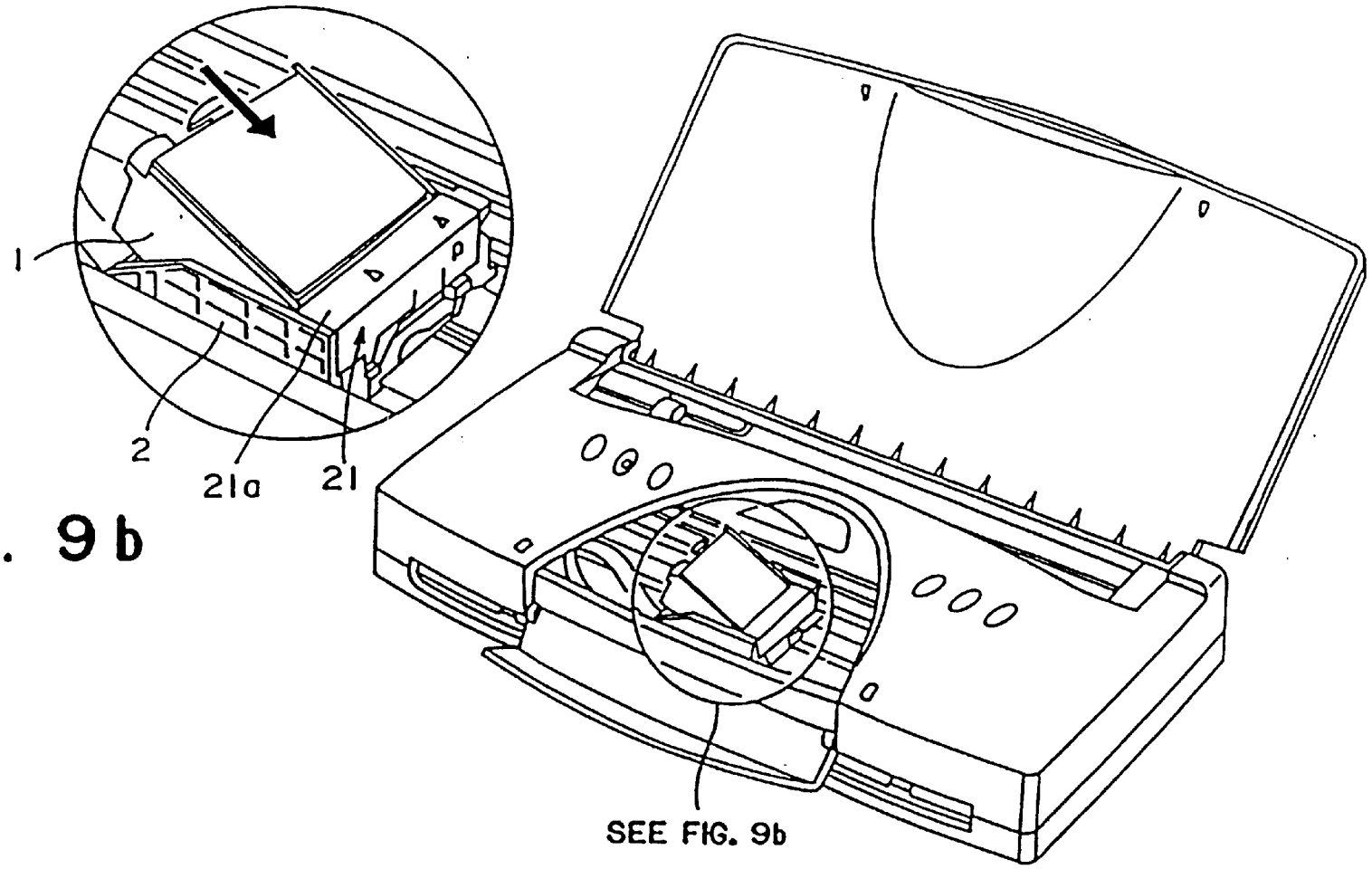
FIG. 9*a* and 9*b* are perspective views depicting the first step for mounting the recording head cartridge into the ink jet recording apparatus illustrated in FIG. 2.

When the recording head cartridge 1 is mounted on the carriage 2, the recording head cartridge 1 is diagonally inserted in the direction of an arrow mark, with the base plate 51 (FIG. 5) side being placed under the cover portion 21*a* of the cable retainer 21 disposed on the carriage 2, as shown in FIGS. 9*a* and 9*b*. With this procedure, the upright surface of the stepped portion, 60*a* (FIG. 5) of the recording head cartridge 1 runs into the edge of the cover portion 21*a*, fixing the position of the recording head cartridge 1 with substantially accuracy.

Figure 10A:
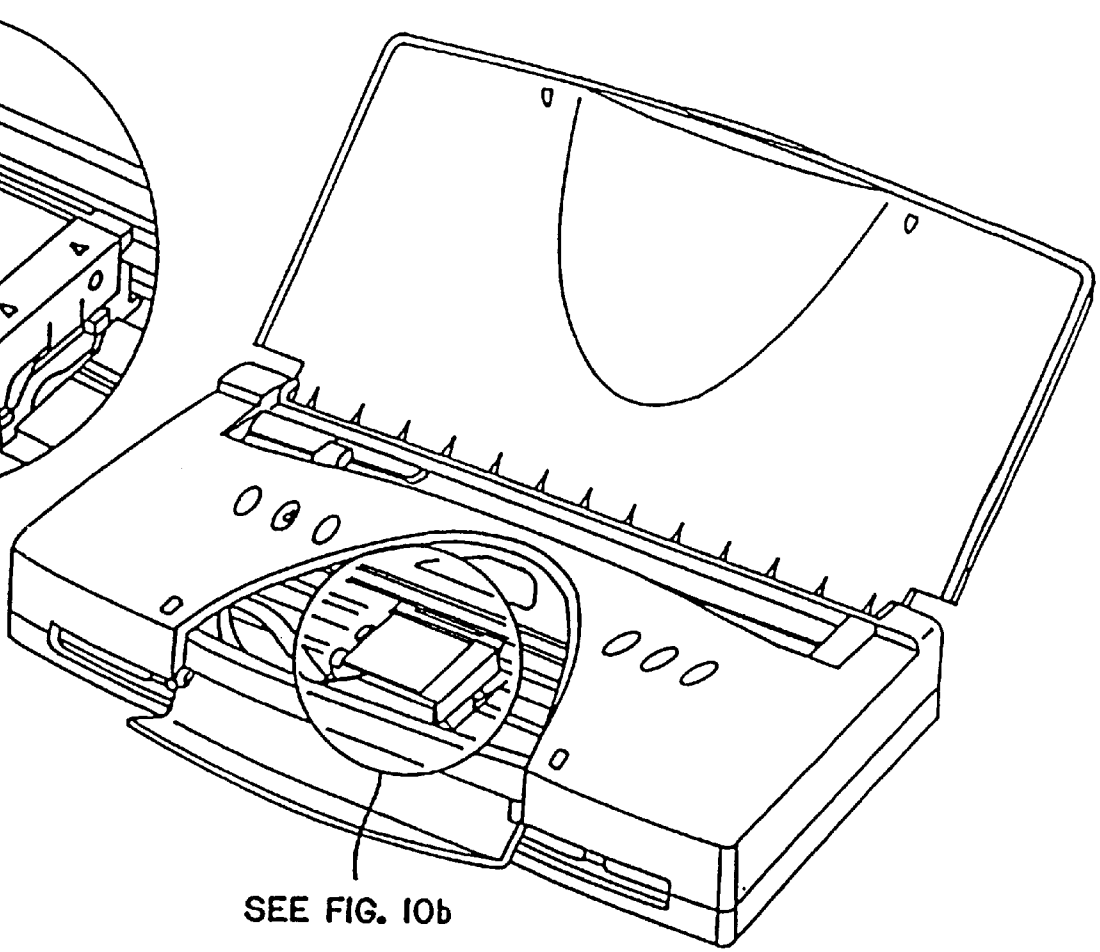
FIG. 10*a* and 10*b* are perspective views depicting the second step for mounting the recording head cartridge into the ink jet recording apparatus illustrated in FIG. 2.
Figure 10B:
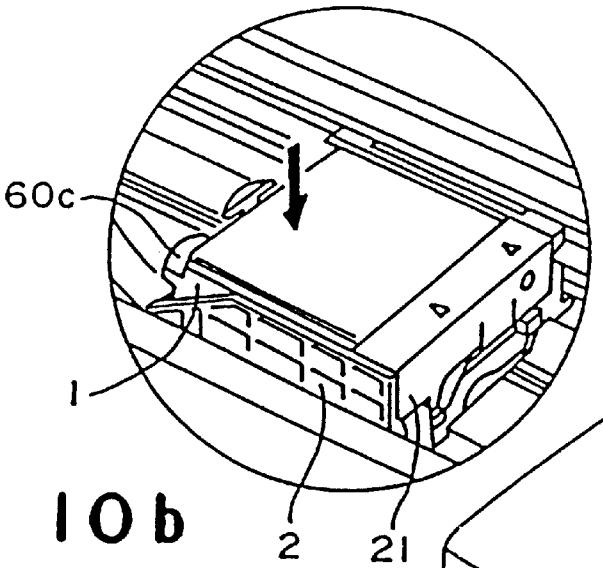

Next, the recording head cartridge 1 is pushed downward as shown in FIGS. 10*a* and 10*b*. At this time, the slanted surface of the heat pressing portion 60*b* (FIG. 6) of the recording head cartridge 1 is guided by the head guide 22 (FIG. 3) of the carriage 2, whereby the recording head cartridge 1 is smoothly mounted on the carriage 2, with the head positioning projections 2*d* and 2*e* of the carriage 2 engaging with the head positioning notch 53*a* and head positioning hole 53*b* of the recording head cartridge 1. As the recording head cartridge 1 is completely mounted the head guide 22 engages with the head guide engaging portion 64 (FIG. 6), whereby the position of the recording head cartridge 1 is fixed. Further, due to the pressure from the head guide 22, the head terminal 53 of the recording head cartridge 1 is pressed upon the cable terminal 3*a* of the carriage 2, assuring a reliable electrical connection between them.

When the recording head cartridge 1 is removed from the carriage 2, the head mounting-dismounting tab 60*c* of the recording head cartridge 1 is pulled upward. With this action, the engagement between the head guide 22 and head guide engaging portion 64 is broken, and as a result, the head pressing portion 60*b* climbs over the head guide 22.

As the head pressing portion 60*b* climbs over the head guide 22, the recording head cartridge 1 becomes tilted, with the head mounting-dismounting tab 60*c* side projecting from the carriage 2. Then, the recording head cartridge 1 can be easily taken out of the carriage 2 by grasping the portion projecting from the carriage 2.

Further, the head mounting-dismounting tab 60*c* is located on the same surface as the head pressing portion 60*b*, at a point farthest away from the head pressing portion 60*b*; therefore, when the head mounting-dismounting tab 60*c* is pulled up to disengage the head guide engaging portion 64 from the head guide 22, a larger moment is generated. Therefore, the recording head cartridge 1 can be removed by a lesser force; it can be easily removed while being securely held. To sum up, in order to make it possible to remove the recording head cartridge 1 by a smaller force, the head pressing portion 60*b* is to be disposed on the rear side of the recording head cartridge 1, relative to the center line of the recording head cartridge 1 parallel to the moving direction of the carriage 2, and the head mounting-dismounting tab 60*c* is to be disposed at the edge of the front side, relative to the same.

Figure 11:
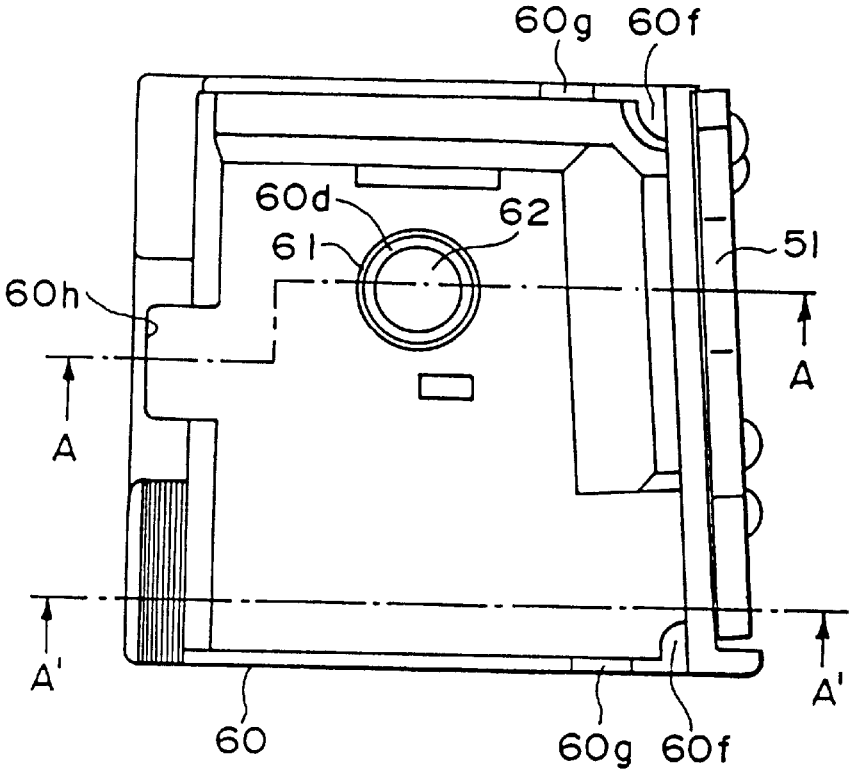
FIG. 11 is a plan view of the recording head cartridge illustrated in FIG. 5.

FIG. 11 is a plan view of the recording head cartridge 1 illustrated in FIG. 5, and FIG. 12 is a sectional view of the recording head cartridge 1 illustrated in FIG. 11, at a sectional line A—A. Referring to FIGS. 11 and 12, the bottom wall of the mono-color holder 60 has upstanding therefrom an ink tapping tube or pipe 60*d*, which projects from the bottom surface and an ink passage 60, one end of which opens up in this ink tapping tube 60*d*, and is connected to the common liquid chamber 50*c* (FIG. 8) of the nozzle portion 50. Around the ink tapping tube 60*d* a sealing ring 61 composed of an elastic material such as rubber is fixed. Further, at the projection end of the ink tapping tube 60*d*, a filter 62 is attached to prevent foreign matter from being taken into the nozzle portion 50.

Also on the mono-color holder 60, an extended portion 60*f* is formed at both top ends, on the base plate 51 side, and a container projection guiding portion 60*g*, which is a semicircular recessed portion, is formed adjacent to the extended portion 60*f*. On the other hand, the latch lever guide groove 60*h*, which serves as the latch lever 32*a* (FIGS. 5 and 6) guide when the ink container 30 (FIGS. 5 and 6) is mounted, is formed on the internal surface of the mono-color holder 60 wall located opposite to the base plate 51. Further, a slanted surface 60*k* is formed at the edge where the bottom mono-color holder 60 wall and the base plate 51 side wall join.

Figure 13:
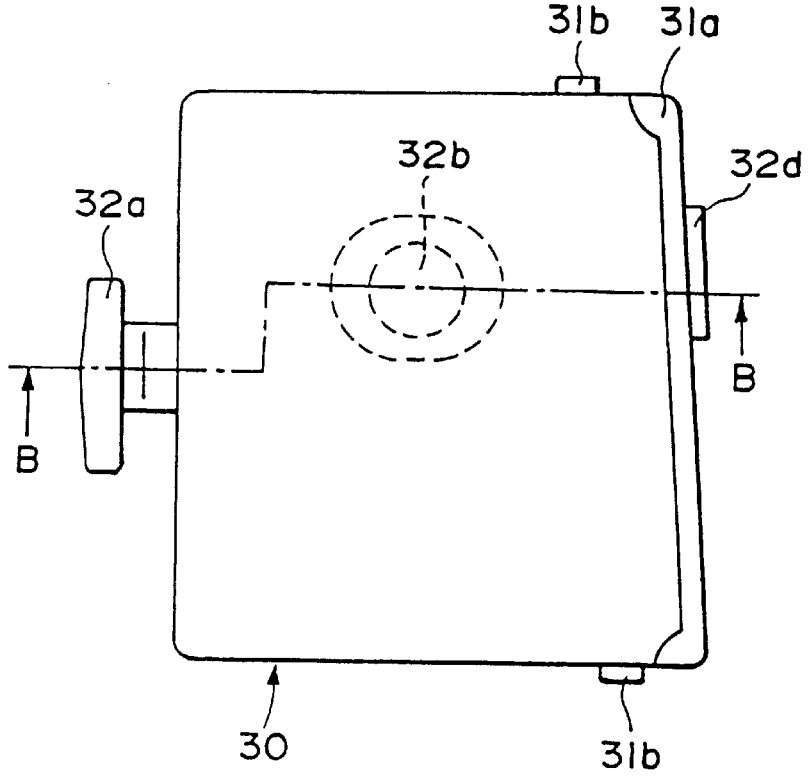
FIG. 13 is a plan view of an ink container mountable in the recording head cartridge illustrated in FIG. 5.
Figure 14:
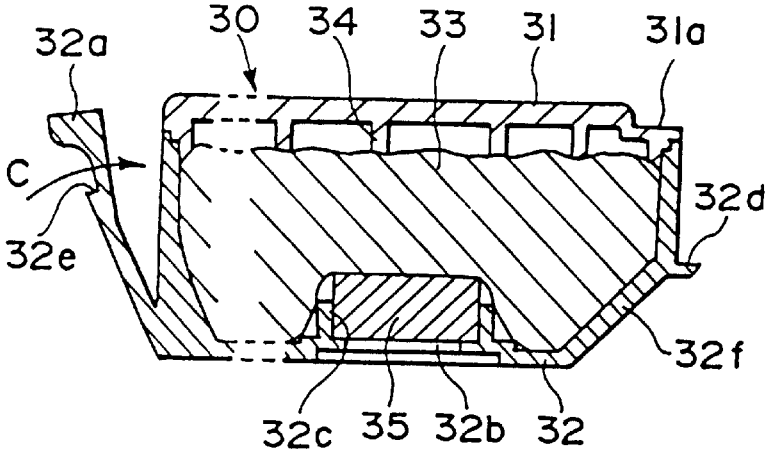
FIG. 14 is a sectional view of the ink container illustrated in FIG. 13, at a sectional line B—B.
Figure 15:
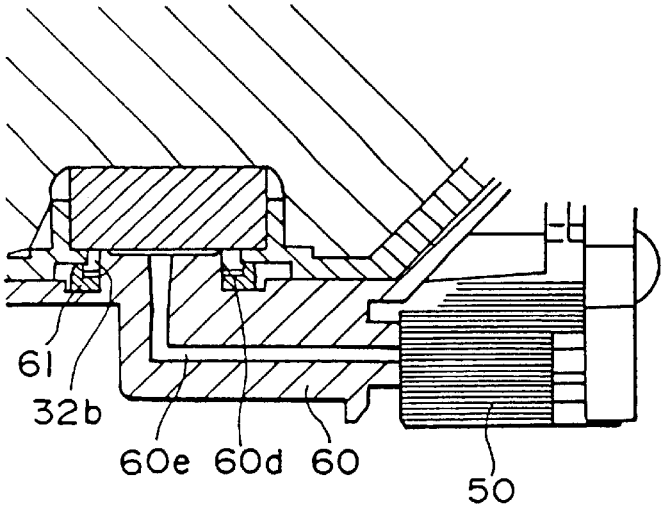
FIG. 15 is a sectional view depicting how the ink delivery port of the ink container illustrated in FIG. 14 is connected to a mono-color holder.

At this time, the ink container 30 to be mounted in this recording head cartridge 1 will be described. FIG. 13 is a plan view of the ink container or tank 30 to be mounted in the recording head cartridge 1 illustrated in FIG. 5, and FIG. 14 is a sectional view of the ink container 30 illustrated in FIG. 13, at a sectional line B—B.

The ink container 30 comprises a container 32 for holding the ink, and a cover or top member 31 for covering and sealing the container 32. The cover member 31 has an air vent (unillustrated).

At the bottom wall of the container 32, an ink delivery (supply) port 32*b* is formed, into which the ink tapping tube 60*d* (FIG. 12) of the mono-color holder 60 is inserted. Around the ink delivery port 32*b*, a cylindrical supporting portion 32*c* is erected. Before the ink container is mounted in the mono-color holder 60, its ink delivery port 32*b* remains sealed with a sealing member (unillustrated) to prevent ink leakage.

Within the container 32, an ink absorbing member 33 formed of sponge or the like material is stored, and the ink is absorbed and retained by this ink absorbing member 33. In the supporting portion 32*c*, an ink delivery member 35 constituted of a bundle of unidirectional fibers is inserted and supported, and the ink absorbing member 33 is airtightly placed in contact with the top end surface of the ink delivery member 35. The ink, having been absorbed and retained in the ink absorbing member 33, is led to the ink delivery port 32*b* by way of this ink delivery member 35. As the ink container 30 is mounted in the mono-color holder 60, the ink tapping tube 60*d* of the mono-color holder 60 is inserted into the ink delivery port 32*b*, forming an ink path, and then, the ink is supplied to the nozzle portion 50 through the ink passage 60*d*. At this time, the seal ring 61 fitted around the ink delivery port 32*b* is airtightly pressed on the peripheries of the ink delivery port 32*b*, preventing ink leakage.

In order to keep the ink delivery port 32*b* and the aforementioned air vent connected with an air layer, ribs or spacers 34 are formed on the internal surfaces of the container 30 and cover member 31, at predetermined locations (in FIG. 14, only the ribs 34 of the cover member 31 are illustrated), so that a predetermined amount of space is formed between the ink absorbing member 33 and the container walls, and between the ink absorbing member 33 and cover member 31; and also, a slit (unillustrated) for connecting the internal space of the container 32 to the outside is formed on the internal surface of the supporting member 32*c*. By means of connecting the internal space of the ink container 30 to the outside with the air layer, the ink is prevented from blowing out of the ink delivery port 32*b* or leaking therefrom when the sealing member sealing the ink delivery port 32*d* is peeled off. Further, even when the ambient temperature of the ink container 30 rises while recording, the ink within the ink container 30 is not forced out. Further, the ink ceases to adhere to the internal walls of the container 32; therefore, it becomes unnecessary to be concerned about the ink leak from the ink delivery port 32 and air vent, and also, the ratio of the usable ink increases.

On the other hand, as for the external structure of the ink container 30, the container 32 integrally comprises a disengagement prevention claw 32*d*, which is a claw-like projection. This disengagement prevention claw (engagement portion) 32*d* is located on the container surface, which comes in contact with the internal surface of the mono-color holder 60 wall on the base plate 51 side when the ink container 30 is mounted in the mono-color holder 60. The engagement portion 32*d* engages with a container disengagement prevention hole 60*i* (FIG. 12) provided on the mono-color holder 60. It also serves as a guide when the ink container 30 is mounted in the mono-color holder 60, and also plays a role for holding the ink container 30 when the ink container 30 is in the mono-color holder 60.

At the container 32 edge where the bottom wall joins with the side wall on which the disengagement prevention claw 32*d* is formed, a slanted surface portion 32*f* is formed. The angle and configuration of this slanted surface 32*f* are substantially the same as the slanted surface 60*k* (FIG. 12) of the mono-color holder 60.

On the opposite container 32 wall of the aforementioned container wall with the engagement prevention claw 32*d*, a latch lever 32 is integrally formed, the bottom portion of which is elastically supported. The latch lever 32*a* is extended upward in a manner to move away from the container 32 wall, and it forms a locking member for engaging with the latch lever guide groove 60*h* (FIGS. 11 and 12) of the mono-color holder 60. When the ink container 30 is in the mono-color holder 60, the latch lever 32*a* is under the pressure from the latch lever guide groove 60*h*, being bent in the direction of an arrow mark C indicated in FIG. 14, and the latch claw 32*e* formed on the latch lever 32*a* is in the latch claw engagement hole 60*j* formed in the latch lever guide groove 60*h* to secure container in place in the holder. In this embodiment, the latch lever 32*a* is integrally formed on the container 32.

As for the structure of the cover member 31, a stepped portion 31*a*, which is one step lower than the top surface of the cover member 31, is formed on the cover member 31 top surface, at the disengagement prevention claw 31*a* side end. When the ink container 30 is mounted in the mono-color holder 60, the ink container 30 is to b e inserted placing this stepped portion 31*a* under the extended portions 60*f* (FIGS. 11 and 12) of the mono-color holder 60, so that the ink container 30 can be positioned with substantial accuracy. Also on the cover member 31, a container projection 31*b* is formed, which engages with the container projection guide 60*g* of the mono-color holder 60.

Figure 16:
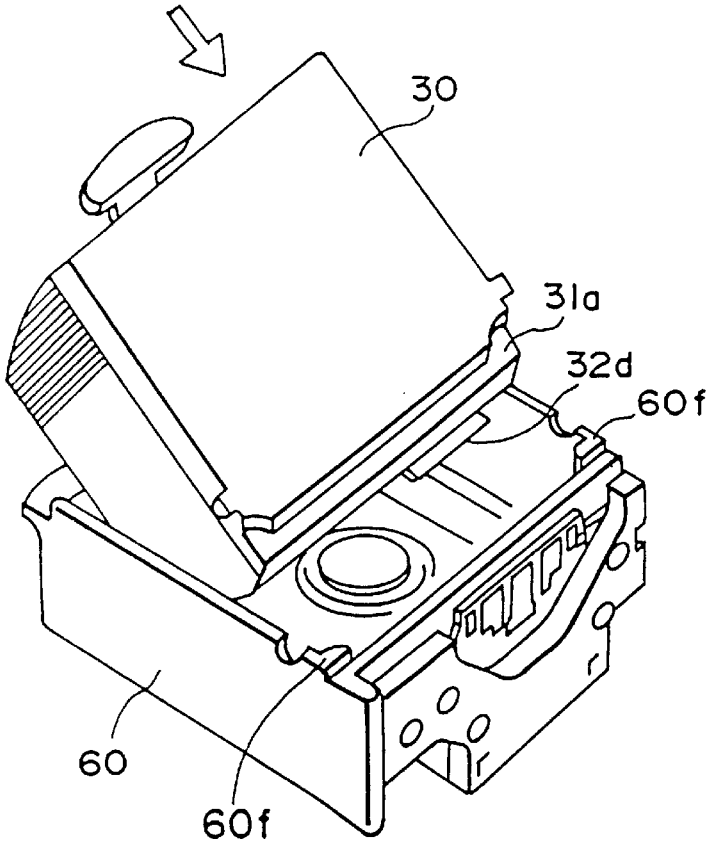
FIG. 16 is a perspective view depicting the first step for mounting the ink container into the recording head cartridge.

Next, the operation for mounting the ink container 30 in the mono-color holder 60, or removing it, will be described. When the ink container 30 is mounted in the mono-color holder 60, the sealing member sealing the ink delivery port 32*b* is first peeled. Then, the ink container 30 is diagonally inserted in t he direction of an arrow, from the engagement prevention claw 32*d* side, as shown in FIG. 16, placing the stepped portion 31*a* of the ink container 30 under the extended portion 60*f* of the mono-color holder 60, engaging the disengagement prevention claw 32*d* of the ink container 30 with the container disengagement prevention hole 60*i* (FIG. 12) of the mono-color holder 60, so that the ink container 30 is positioned with substantial accuracy. Since the slanted surface 32*f* is formed on the ink container 30, it is easy to place the stepped portion 31*a* of the ink container 30 under the extended portion 60*f* of the mono-color holder 60; all that is needed is to insert the ink container 30, keeping this slanted surface 32*f* substantially in parallel to the bottom wall of the mono-color holder 60. Also, since the mono-color holder 60 and ink container 30 are provided with the slant surfaces 60*k* and 32*f*, respectively, which match each other, a different type of ink container can not be mounted in this mono-color holder 60, preventing a wrong ink container from being mounted.

Figure 17:
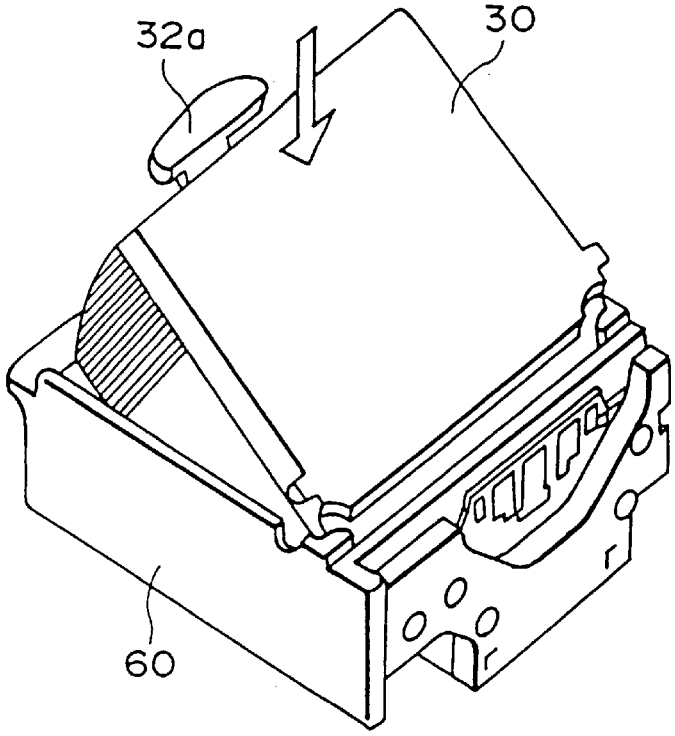
FIG. 17 is a perspective view depicting the second step for mounting the ink container into the recording head cartridge.

Next, referring to FIG. 17, the ink container 30 is pushed in downward, so moving its bottom wall toward the bottom wall of the ink cartridge that the latch lever 32*a* moves along the latch lever guide groove 60*h* (FIGS. 11 and 12). Then, the ink container 30 makes a substantially rotational movement about the ink container 30 portion having been already inserted in the mono-color holder 60. As a result, the latch lever 32*a* provides a latch member that is forced into the mono-color holder 60 aligned with the ink cartridge side walls, being bent inward by the latch lever guide groove 60*h*, and the latch claw 32*e* (FIG. 14) of the latch lever 32*a* engages with the latch claw engagement hole 60*j* (FIG. 12) of the mono-color holder 60, fixing the ink container 30 to the mono-color holder 60 with its bottom wall facing downward and its side walls. Further, there are a sound and a feel of clicking at the moment the latch 32*e* engages with the latch claw engagement hole 60*j*, assuring the operator that the ink container 30 has been successfully mounted. When dismounting the ink container 30 from the mono-color holder 60, the latch lever 32*a* is pushed inward, so that it becomes disengaged from the latch claw engagement hole 60*j*. Since the latch lever 32*a* is elastically supported at the bottom end, and is extended in the diagonally upward direction, it tries to restore the state illustrated in FIG. 14, as soon as the engagement between the latch claw 32*e* and latch claw hole 60*j* is broken. Therefore, the bottom side surface of the latch lever 32*a* slides up along the latch lever guide 60*h*, automatically tilting the ink container 30, that is, automatically raising the latch lever 32*a* side of the ink container 30 out of the mono-color holder 60. Then, the ink container 30 can be easily dismounted from the mono-color holder 60 just by grasping the raised portion.

Since the ink container 30 is mounted on the mono-color holder 60, or dismounted, through the substantially rotational movement, it requires only a small space to do so. Further, when mounting, the stepped portion 31*a* is placed under the extended portion 60*f* of the mono-color holder 60, with the slanted surface 32*f* of the ink container 60 serving as the guide; therefore, the direction in which the ink container 30 is inserted into the mono-color holder 60 is regulated. Further, the container projection 31*b* is provided on the ink container 30, and also, the container projection guide portion 60*g* is provided on the mono-color holder 60; therefore, it is also regulated where in the mono-color holder 60 the ink container 30 is inserted, and the ink container 30 is rotated substantially about the container projection 31*b*.

Therefore, the ink container 30 can be mounted without interfering with the filter 62 (FIGS. 11 and 12) of the mono-color holder 60, eliminating concern for the filter 62 damage which might occur when mounting the ink container 30. Further, since the ink container 30 is mounted into, or dismounted from, the mono-color holder 60, through the rotational movement, it requires only a small space to do so; therefore, the ink jet recording apparatus size can be further reduced.

Figure 18:
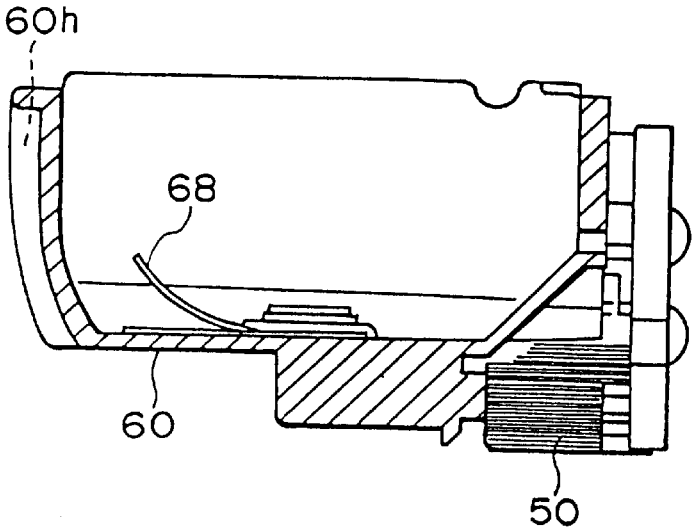
FIG. 18 is a sectional view of an example of a recording head cartridge at a sectional line equivalent to sectional line A'—A' drawn across the recording head cartridge in FIG. 11, wherein the mono-color holder of this head cartridge has a pop-up spring on its bottom wall.

In the embodiment described above, the ink container 30 is dismounted from the mono-color holder 60, using the phenomenon that the latch lever 32*a* side of the ink container 30 is raised by the resiliency of the latch lever 32*a*. In addition, to such usage of the latch lever 32*a* resiliency, a pop-up spring 68 as illustrated in FIG. 18 may be provided as pressing means for urging the other side (latch lever 32*a* side) of the ink container 30 bottom wall, so that the latch lever 32*a* side of the ink container 30 may be raised upwardly by the force of the pop-up spring 68. The pop-up spring 68 is a leaf spring fixed on the bottom wall of the internal space of the mono-color holder 60. Its free end extending from the nozzle portion of the mono-color holder 60 toward the latch lever guide groove 60*h*, is slightly curved upward. With the presence of this pop-up spring 68, the latch lever 32*a* side of the ink container 30 is lifted upward by the force of the pop-up spring 68 as soon as the latch claw 32*e* is disengaged from the latch claw engagement hole 60*j*. In this case, the ink container 30 is projected higher than it would be projected by the resiliency of the latch lever 32*a* alone; therefore, it is easier to remove the ink container 30. In FIGS. 16 and 17, the steps for mounting the ink container 30 on the recording head cartridge 1 which is on the carriage 2 (FIG. 2) are shown, but needless to say, the operation for mounting or dismounting the ink container 30 can be carried out even when the recording head cartridge 1 is on the carriage 2.

Figure 19:
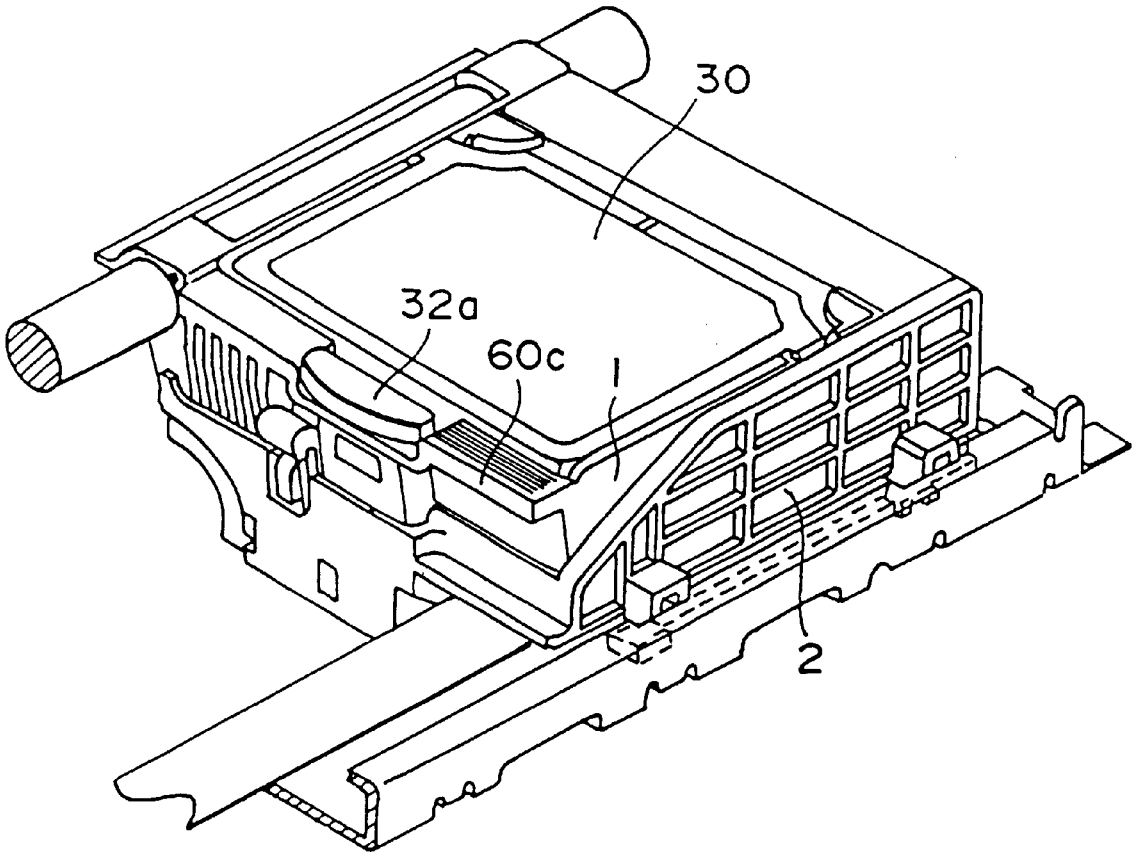
FIG. 19 is a perspective view of the carriage illustrated in FIG. 3, and the recording head cartridge illustrated in FIG. 6, wherein the cartridge is on the carriage.

FIG. 19 is a perspective view of the ink container 30, the recording head cartridge 1, and the carriage 2, wherein the ink container 30 is in the recording head cartridge 1, and the recording head cartridge 1 is on the carriage 2. As is evident from FIG. 19, the latch lever 32*a*, which is handled when the ink container 30 is mounted or dismounted, and the head mounting-dismounting tab 60*c*, which is handled when the recording head cartridge 1 is mounted or dismounted, are located on the same side, relative to the moving direction of the carriage 2. Therefore, the operator can easily recognize the different portions to be manipulated; in other words, operational consistency is realized, improving thereby operational efficiency: In addition, a very compact and logically manipulatable portion can be provided in terms of design. Further, when mounting or dismounting the ink container 30 or recording head cartridge 1, the ink container 30 or recording head cartridge 1 manipulating space for the operator is required only on the side where the latch lever 32*a* and head mounting-dismounting tab 60*c* are located; therefore, the ink container 30 and/or recording head cartridge 1 can be mounted or dismounted at an optional carriage 2 location, as long as the location satisfies the aforementioned space requirement.

The latch lever 32*a* and head mounting-dismounting tab 60*c* are disposed adjacent to each other, but the operation for removing the ink container 30 is an operation to push the latch lever 32*a* in the inward direction, and the operation for removing the recording head cartridge 1 is an operation to pull up the head mounting-dismounting tab 60*c*; therefore, an erroneous operation can be avoided because of the operational difference. Further, the latch lever 32*a* and head mounting-dismounting tab 60*c* are positioned at different levels; therefore, their functional difference can be easily recognized. In this case, comparing the mounting-demounting frequency of the ink container 30 with that of the recording head cartridge 1, the mounting-demounting frequency of the ink container 30 is higher; therefore, the head portion (where the operator places a finger) of the latch lever 32*a* is positioned above the head mounting-demounting tab 60*c*, in consideration of operational convenience.

In the embodiment described above, a mono color recording head cartridge is employed, but a color recording head cartridge may be employed. In another embodiment of the present invention, the latter is employed.

Figure 20:
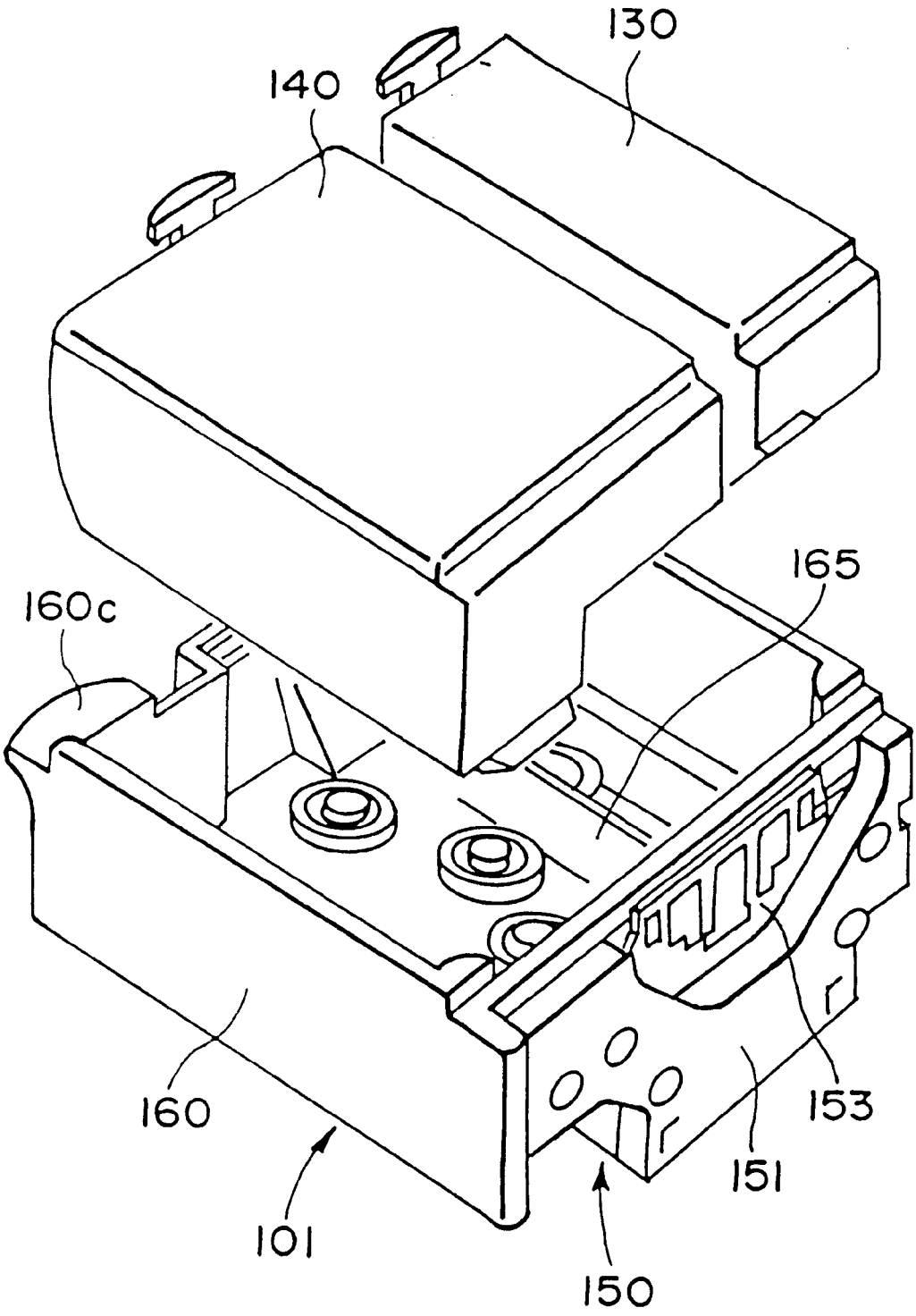
FIG. 20 is a perspective view depicting the color recording head cartridge mountable in the ink jet recording apparatus illustrated in FIG. 1, together with two ink containers to be mounted in this cartridge.

FIG. 20 is a perspective view of a color recording head cartridge to be mounted in the ink jet recording apparatus illustrated in FIG. 1, and two ink containers to be mounted in this recording head. This color recording head cartridge 10 is structured to removably accommodate a black ink container or tank 130 for storing black ink, and color ink container or tank 140 for storing three color inks: yellow, magenta, and cyan inks, and ejects four inks of different colors. Therefore, the orifices of the nozzle portion 50 are also divided into four groups corresponding to the four inks of different color: black ink ejection orifice group 150B, yellow ink ejection orifice group 150Y, magenta ink ejection orifice group 150M, and cyan ink ejection orifice group 150C. Further, in order to partition the ink tank 130 receptacle from the ink container 140 space, a partitioning plate 165 is integrally formed on the bottom wall of the color holder 160 to provide a common side wall for the adjacent receptacles.

As for the base plate 151 and head terminal 153, components common to the monochrome recording head cartridge 1 (FIG. 5) and color recording head cartridge 101 are employed. The external configuration of the color holder 160 is substantially the same as the mono-color holder 60 (FIG. 5), through they differ in details. In particular, the configurations of the color recording head cartridge 10 portions which face the internal surface of the carriage 2 wall, and the position of a head mounting-dismounting tab 160*c*, where a finger is placed when the recording head cartridge 101 is dismounted from the carriage 2, are the same as those of the monochrome recording head cartridge 1; therefore, this recording head cartridge 101 can be mounted on the same carriage 2, on which the monochrome recording head cartridge 1 is mounted. In other words, the user can optionally choose the monochrome recording head cartridge 1 or recording head cartridge 101 to use in the same ink jet recording apparatus.

Below, this recording head cartridge 101, and both of the ink containers 130 and 140, will be described. However, the portions facing the internal surface of the carriage 2 wall will be omitted from the description since they are the same as those of the monochrome recording head cartridge 1.

Figure 22:
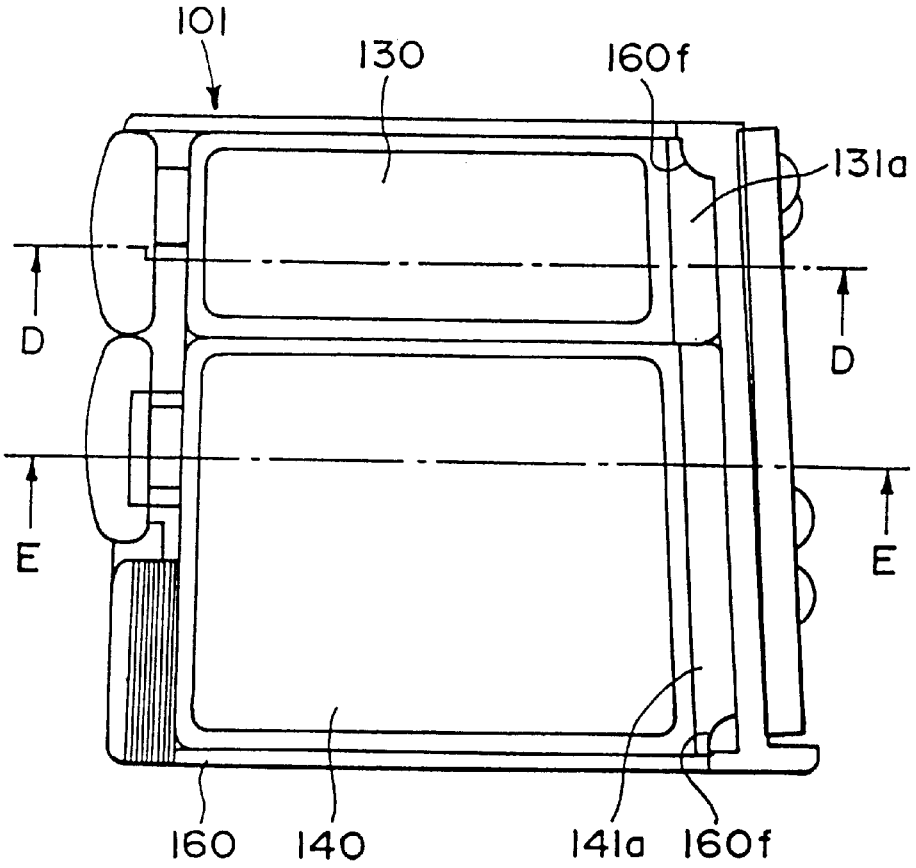
FIG. 22 is a plan view of the color recording head cartridge illustrated in FIG. 20, wherein two ink containers are in the cartridge.
Figure 23:
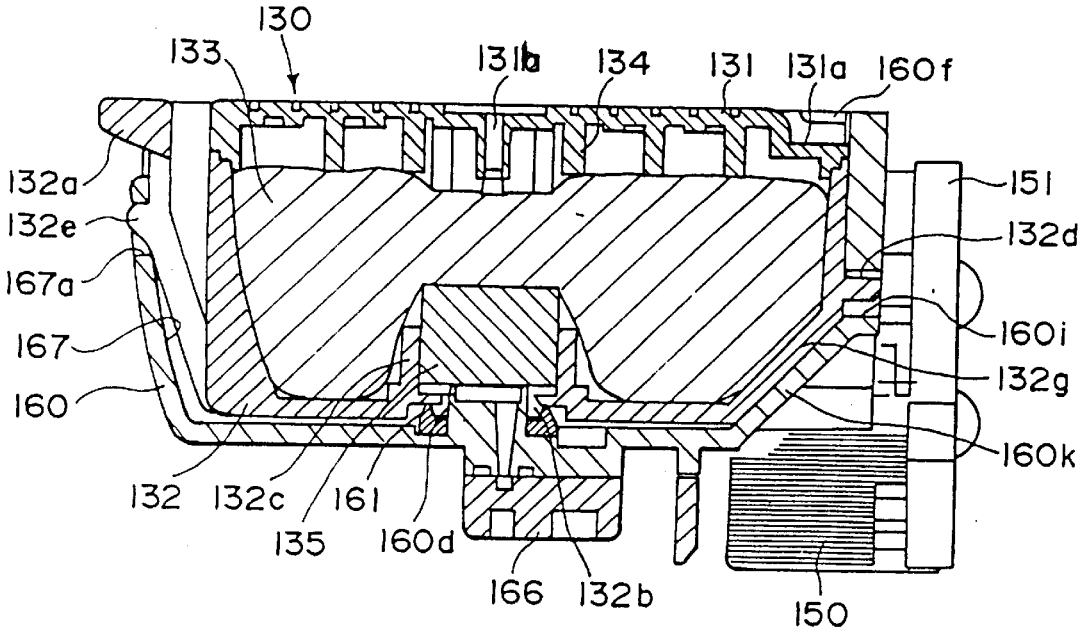
FIG. 23 is a sectional view of FIG. 22, at a sectional line D—D.
Figure 24:
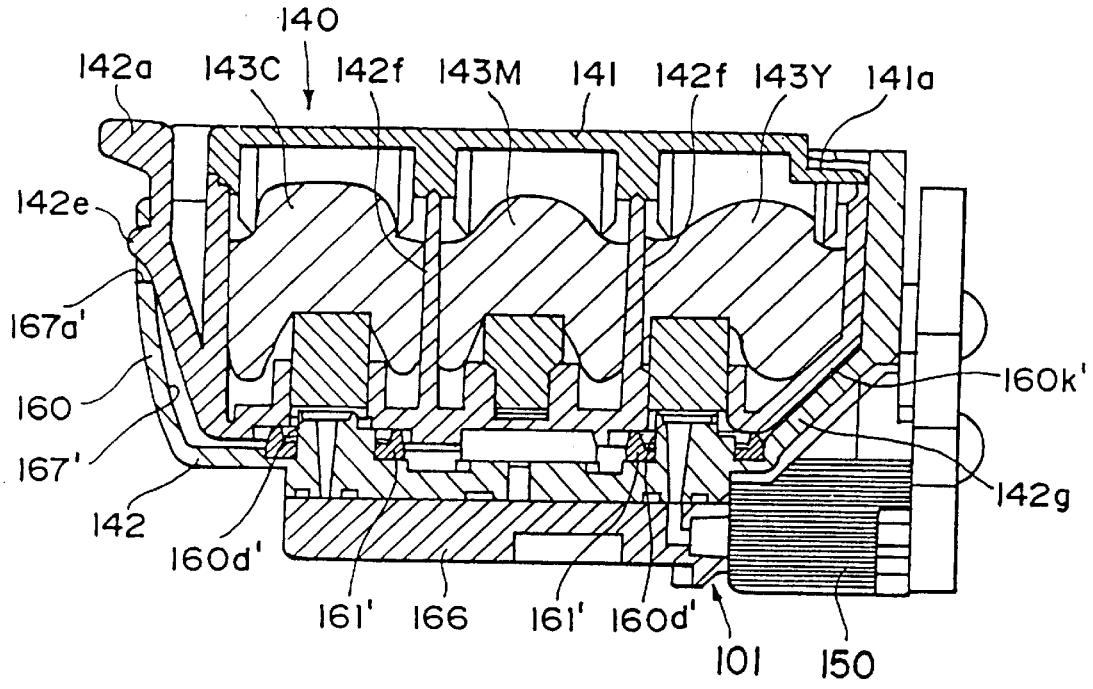
FIG. 24 is a sectional view of FIG. 22, at a sectional line E—E.

FIG. 22 is a plan view of the recording head cartridge 101 illustrated in FIG. 20, in which two ink containers 130 and 140 are in the cartridge 101. FIG. 23 is a section of FIG. 22, at a sectional line D—D, and FIG. 24 is a section of FIG. 22, at a sectional line E—E.

Figure 30A:
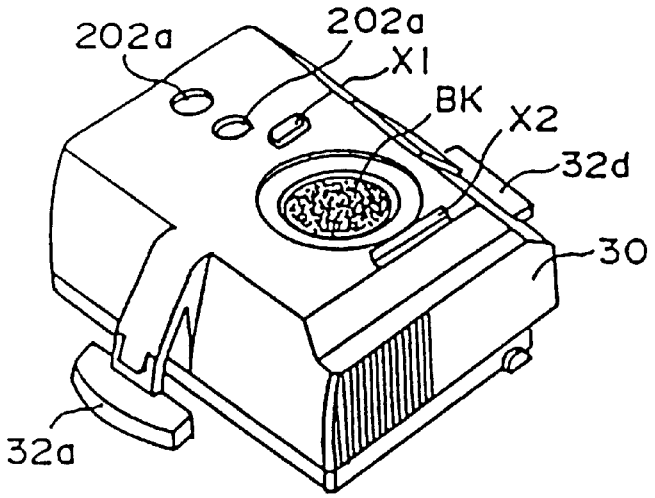
FIG. 30*a* is a perspective view of the black ink container 30, mainly showing the bottom thereof.
Figure 30B:
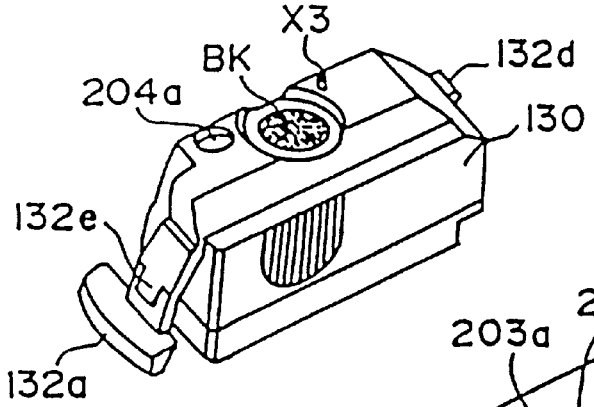
FIG. 30*b*, a perspective view of the black ink container 130, mainly showing the bottom thereof.
Figure 30C:
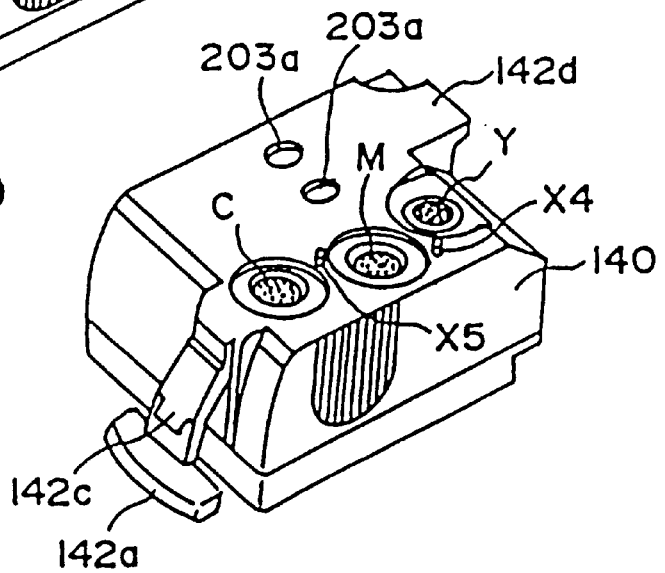
FIG. 30*c* is a perspective view of the color ink container 140, mainly showing the bottom thereof.

Referring to FIG. 22, the black ink container 130 and color ink container 140 are mounted side by side on the color holder 160. The configuration formed by the combination of the black ink container 130 and color ink container 140 is substantially the same as the configuration of the monochrome ink container 30 (FIG. 30) alone.

Referring to FIG. 23, the black ink container 130 comprises a container or tank 132 for storing the black ink, and a cover or top member 131 for covering and sealing the container 132. The cover member 131 has an air vent.

At the bottom wall of the container 132, an ink delivery (supply) port 132*b* is formed, into which the upstanding black ink tapping tube 160*d* (FIG. 12) of the color holder 60 is inserted. Around the ink delivery port 132*b*, a cylindrical supporting portion 132*c* is erected. Before the container 132 is mounted in the color holder 160, the ink delivery port 132*b* remains sealed with a sealing member (unillustrated) to prevent ink leakage.

Figure 21:
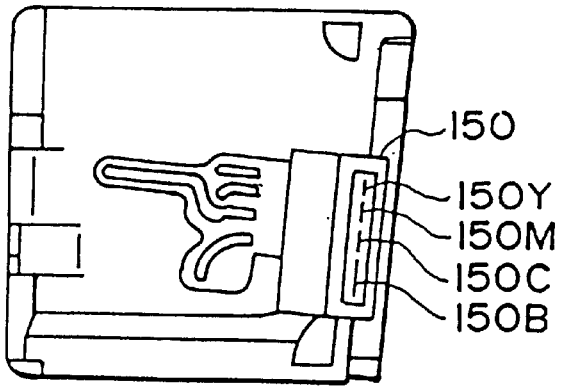
FIG. 21 is a plan view of the bottom of the color recording head cartridge illustrated in FIG. 20.

Within the container 132, an ink absorbing member 133 is stored, and the black ink is absorbed and retained by this ink absorbing member 133. In the supporting portion 132*c*, an ink delivery member 135 constituted of a bundle of unidirectional fibers, is inserted and supported, and the ink absorbing member 133 is airtightly placed in contact with the top end surface of the ink delivery member 135. The ink, having been absorbed and retained in the ink absorbing member 133, is led to the ink delivery port 132*b* by way of this ink delivery member 135. As the black ink container 130 is mounted in the color holder 160, the ink tapping tube or pipe 160*d* of the color holder 160 is inserted into the ink delivery port 132*b*, forming an ink path, and then, the ink is supplied to the black ink ejection orifice group 150B (FIG. 21) of the nozzle portion 150 through the ink passage constituted of the color holder 160 and a liquid passage cover 166 (FIG. 23 does not illustrate the path to the nozzle portion 150 because of the location of the sectional plane). At this time, the seal ring 161 fitted around the ink delivery port 132*b* is airtightly pressed on the peripheries of the ink delivery port 132*b*, preventing ink leakage.

In order to keep the ink delivery port 132*b* and the aforementioned air vent 131*b* connected with an air layer, ribs or spacers 134 are formed on the internal surfaces of the container 130 and cover member 131, at predetermined locations (FIG. 23 illustrates only the ribs 134 of the cover member 131), so that a predetermined amount of space is formed between the ink absorbing member 133 and the container 130 walls, and between the ink absorbing member 133 and cover member 131; and also, a slit (unillustrated) for connecting the internal space of the container 132 to the outside is formed on the internal surface of the supporting member 132*c*.

On the other hand, as for the external ink container 130 structure for mounting the black ink container 130 into the color holder 160, the container 132 integrally comprises a disengagement prevention claw 132*d*, which is located on the container surface, which comes in contact with the internal surface of the color holder 160 wall on the base plate 51 side when the black ink container 130 is mounted in the color holder 160. This disengagement prevention claw 132*d* engages with a container disengagement prevention hole 160*i* (FIG. 12) provided on the color holder 160. It also serves as a guide when the black ink container 130 is mounted in the color holder 160, and also plays a role for holding the black ink container 130 when the black ink container 130 is in the color holder 160. Also on the container 132, a latch lever 132*a* is integrally formed. It is located on the opposite surface of the surface with the disengagement prevention claw 132*d*, and its bottom end portion is elastically supported.

On the color holder 160, a latch lever guide groove 167 for the black ink container 130 is integrally formed corresponding to the location of the latch lever 132*a*. When the black ink container 130 is mounted in the color holder 160, the latch lever 132*a* forms a locking member for engaging the latch lever guide groove 167. When the black ink container 130 is in the color holder 160, the latch lever 132*a* is under the pressure from the latch lever guide groove 167 being bent inward, and the latch claw 132*e* formed on the latch lever 132*a* is in the latch claw engagement hole 167*a* formed in the latch lever guide groove 160*h* to secure the container in the holder.

Further, a slanted surface 160*k* similar to the one formed on the mono-color holder (FIG. 12) is formed on this color holder 160, in the area where the black ink container 130 is mounted, and a slanted surface 132*f* is also formed on the black ink container 130, on the surface correspondent to the slanted surface 160*k*.

As for the structure of the cover member 131, a stepped portion 131*a*, which is one step lower than the top surface of the cover member 131, is formed on the cover member 131 top surface, at the end portion of the disengagement prevention claw 131d side. Corresponding to this stepped portion 131*a*, an extended portion 160*f* similar to the extended portion 60*f* (FIG. 11) of the mono-color holder 60 is formed on the color holder 160.

The black ink container 130 is mounted in, or dismounted from, the color holder 160 in the same manner as the mono-color ink container 30 is mounted or dismounted. That is, when the black ink container 130 is mounted in the color holder 160, the black ink container 130 is to be diagonally inserted, placing this stepped portion 131*a* under the black ink container 130 side extended portions 160*f* (FIGS. 22) of the color holder 160, into the location where the black ink container 130 is to be mounted, and the disengagement prevention claw 132*d* is hooked into the container disengagement prevention hole 160*i* of the color holder 160. Then, the black ink container 130 is pushed down, being rotated about the disengagement prevention claw 132*d* side thereof, so that the latch claw 132*e* of the latch lever 132*a* is engaged with the latch claw engagement hole 167*a* of the latch lever guide groove 167. When dismounting the black ink container 130, all that is needed is to push in the latch lever 132*a* so that the latch claw 132*e* is disengaged from the latch claw engagement hole 167*a*.

The color ink or multi-ink container 140 has basically the same structure as the black ink container 130. Referring to FIG. 24, it comprises a container 142 for storing three inks of different colors, and a cover member 141 for covering the container 142. When the color ink container 140 is mounted into the color holder 160, it is diagonally inserted so that a stepped portion 141*a* formed on the cover member 141, at the location equivalent to the location at which the stepped portion of the black ink container 130 is formed on the cover member 131 of the black ink container 130, is placed under the extended portion 160*f* (FIG. 22) on the color ink container 140 side.

Figure 25:
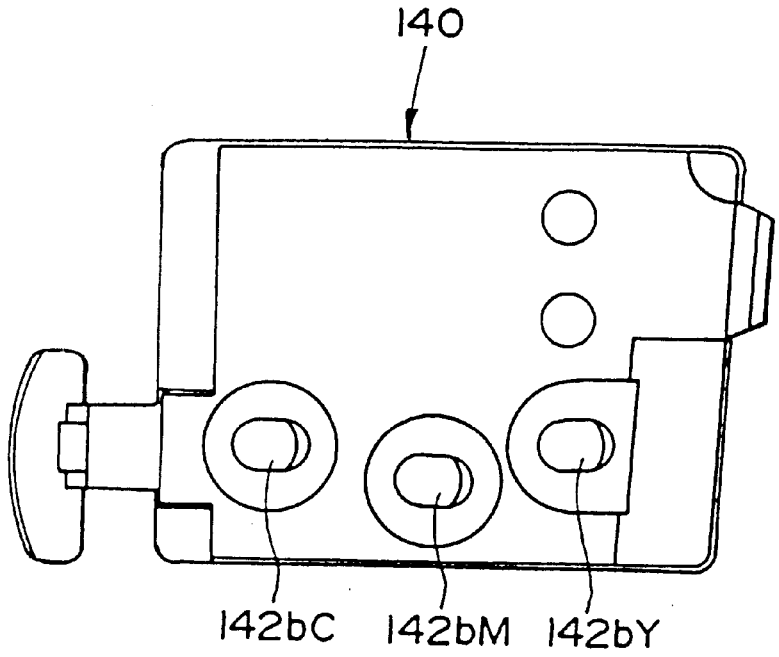
FIG. 25 is a plan view of the bottom of the color ink container illustrated in FIG. 20.

The internal space of the container 142 is partitioned into three spaces or chambers of a substantially equal volume, by two partitioning plates 142*f* placed in parallel to each other. These three spaces are aligned in the direction in which the color ink container 140 is inserted when the color ink container 140 is mounted in the color recording head cartridge 101. Each of these three spaces contains an ink absorbing member 143Y for absorbing and retaining yellow ink, an ink absorbing member 143M for absorbing and retaining magenta ink, and an ink absorbing member 143C for absorbing and retaining cyan ink, respectively. Referring to the bottom view given in FIG. 25, ink delivery ports 142*b*Y, 142*b*M and 142*b*C are formed so as to open up in the corresponding spaces, and they are aligned substantially in parallel to the direction in which the color ink container 140 is inserted.

The structure of each space is the same as the structure of the black ink container 130; therefore, its description will be omitted. Further, the structure of the cover member 141 is also the same as the structure of the cover member of the black ink container 130, except that an air vent (unillustrated) is formed for each space, and the cover member 141 is structured to seal each space from the other spaces; therefore, its description will be omitted.

On the color holder 160, three upstanding ink tapping tubes 160*d*' (FIG. 24 does not illustrate the magenta ink tapping tube due to the location of the sectional plane) are provided corresponding to the locations of the ink delivery ports 142*b*Y, 142*b*M and 142C. The ink tapping tubes 160*d*' are in connection to the corresponding ejection orifice groups 150Y, 150M and 150C (FIG. 21), through the ink passages constituted of the color holder 160 and a liquid passage cover 166. In FIG. 24, only the ink passage from the yellow ink space to the nozzle portion 150 is shown due to the location of the sectional plane. Also, a seal ring 161' is provided for each ink tapping tube 160*d*', but FIG. 24 does not show the ink tapping tube 160*d*' for the magenta ink space.

Figure 26:
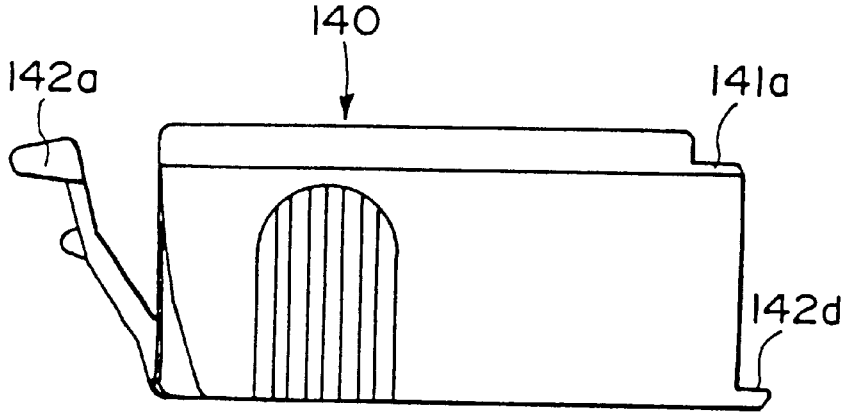
FIG. 26 is a side view of the color ink container illustrated in FIG. 20.

On the other hand, as for the color ink container 140 structure pertaining to its installation into the color holder 160, the color holder 160 also has a latch lever 142*a*, a disengagement prevention claw 142*d* as well as the aforementioned stepped portion 141*a*, as the black ink container 130 does, which is illustrated by the side view given in FIG. 26. Referring to FIG. 24, the latch lever 142*a* engages with the latch lever guide groove 167' formed on the color holder 160, and when the color ink container 140 is in the color holder 160, the latch claw 142*e* formed on the latch lever 142*a* is engaged with a latch claw engagement hole 167*a*' formed on the latch lever guide groove 167'. Referring to FIG. 26, the prevention claw 142*d* is located on the bottom end portion of the opposite surface of the surface with the latch lever 142*a*, and corresponding to this location of the latch lever 142*a*, an ink container disengagement prevention hole (unillustrated), which this disengagement prevention claw 142*d* engages, is formed on the color holder 160.

Also referring to FIG. 24, a slanted surface 160*k*', like the slanted surface formed on the mono-color holder 60 (FIG. 12), is formed on the color holder 160, in the area where the color ink container 140 is mounted, and a slanted surface 142*g*, which corresponds to the slanted surface 160*k*' is formed on the color ink container 140.

The operation for mounting the color ink container 140 into the color holder 160, or dismounting it, is similar to the mounting or dismounting operation for the black ink container 130. That is, when mounting, the disengagement prevention claw 142*d* side of the color ink container 140 is inserted into the color holder 160, and the color ink container 140 is rotated about the inserted portion, and when dismounting, the latch lever 142*a* is pushed in. In the case of the color ink container 140, the ink delivery ports 142*b*Y, 142*b*M and 142*b*C are aligned in parallel to the color ink container 140 inserting direction; therefore, when the color ink container 140 is mounted in the color holder 160, they become engaged with the correspondent ink tapping tubes 160', sequentially, starting from the one located nearest to the disengagement prevention claw 142*d*. As a result, the color ink container 140 is smoothly and reliably mounted in the color recording head cartridge 101.

Further, a pop-up spring like the one illustrated in FIG. 18 may be placed in the color holder 160 so that it is easier to remove the ink containers 130 and 140.

Figure 27:
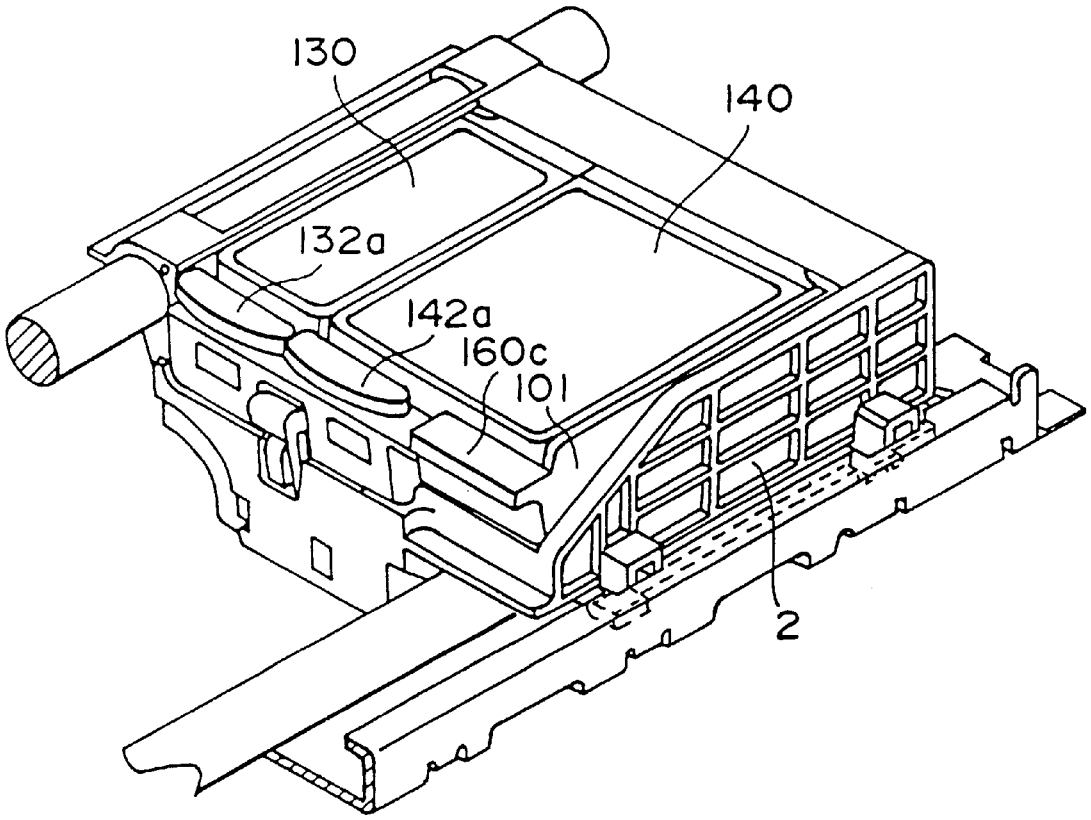
FIG. 27 is a perspective view of the carriage illustrated in FIG. 3, and the color recording head cartridge illustrated in FIG. 22, wherein the cartridge is on the carriage.

FIG. 27 is a perspective view of the black ink container 130, color ink container 140, color recording head cartridge 101, and the carriage 2. In this drawing the ink containers 130 and 140 are in the color recording head cartridge 101, and the cartridge 101 is on the carriage 2. As is evident from FIG. 27, the ink containers 130 and 140 are aligned in the direction perpendicular to the moving direction of the carriage 2; therefore, the latch lever 132*a* which is manipulated during the operation for mounting or dismounting the black ink container 130, the latch lever 142*a* which is manipulated during the operation for mounting or dismounting the color ink container 140, and the head mounting-dismounting tab 160*c* which is manipulated during the operation for mounting or dismounting the color recording head cartridge 101, are all on the same side, relative to the moving direction of the carriage 2. This arrangement not only improves the efficiency of the operation for mounting or dismounting the ink containers 130 and 140, and the color recording head cartridge 101, but also allows the structure to be very compact and logical in terms of design, as it does for the mono-color recording head cartridge 1 (FIGS. 9*a* and 9*b*). In addition, the head portions of the latch levers 132*a* and 142*a* are aligned in a straight line; therefore, the available space is effectively used to reduce the size of the color recording head cartridge 101. Further, as for the positional relationship between the latch levers 132*a* and 142*a*, and the head mounting-dismounting tab 160*c*, the levers 132*a* and 142*a* are positioned at a different level from the tab 160*c*; therefore, their functional difference can be easily recognized.

When the angles and configurations of the slanted surfaces 132*g* and 142*g* of the black ink container 130 and color ink container 140, respectively, are differentiated from each other, and the angles and configurations of the correspondent slanted surfaces 160*k* and 160*k'* of the color holder 160 are matched with those of the slanted surfaces 132*g* and 142*g* of the black ink container 130 and color ink container 140, respectively, the black ink container 130 and color ink container 140 are prevented from being erroneously mounted in the wrong side.

Next, referring to FIGS. 28*a*–44, various structures and their relationship, which have not been described with reference to FIG. 27 or prior drawings, will be described.

In these drawings, the aforementioned ink absorbing members 35 and 165 are constituted of fibrous material which is bundled so as to deliver the ink unidirectionally. They are used as ink delivery members for unidirectionally delivering the ink. As is apparent from FIG. 30, they are placed in the recessed portions formed in the bottom surfaces of the ink containers 30, 130 and 140, correspondingly, and their cross-sectional areas are different from each other. Referring to FIGS. 29*a*–*b* and 30*a*–*c*, the leaf springs 68, 68C and 68B, which work on the corresponding ink containers during the mounting or dismounting operation, are fixed to thermally crimping members 202, 203 an 204 of the ink container holders 60 and 160. These thermally crimping members 202, 203 and 204 project into the ink container mounting spaces; therefore, recesses 202*a*, 202*a*, 203*a*, 203*a* and 204*a* are formed on the bottom surfaces of the corresponding ink containers 30, 130 and 140, in order to assure that the absorbing members of the ink containers are airtightly placed in contact with the filters BK, BK, Y, M and C of the corresponding ink containers holders.

The leaf springs 68, 68B and 68C are deformed as the ink containers are positioned in the holders, and their elastic resiliency works to push up the ink containers. This upward pushing force makes the aforementioned latch claws and disengagement claws engage with the holders. The reaction force from this upward force further stabilizes the engagement between the ink delivery ports, and the filters which slightly project from the holder bottoms. At this time, referring to FIGS. 28*a*–*b* and 37, the visual characteristic of each ink container will be described. As may be suspected from the aforementioned structures, in which the carriage, ink container holder, and one or two ink containers are packed into a small space, it is probable that it becomes impossible to know which lever should be manipulated to carry out a desired operation. Therefore, in this embodiment, not only are the configurations of the levers varied, but also, the colors of the levers are differentiated from each other, the colors of the levers being the same as the correspondent ink containers, so that operational efficiency is improved. More specifically, the common carriage is given a blackish color (preferably, the same color as the main assembly of the recording apparatus, since the carriage is never removed), and the ink containers 30, 130 and 140 are given greyish, transparent or reddish, and whitish colors, respectively. As for the holders BHD and BCHD integral with the head, they may be different in color, but in this embodiment, they are given a greenish color. With such a color arrangement, the components to be mounted or dismounted can be identified using color difference; in other words, the lever to be operated can be visually identified. Further, referring to FIGS. 30*a*–*c*, projections X1–X5 are provided on the correspondent ink containers, and referring to FIGS. 29*a*–*b*, recesses Y1–Y5 are provided on the ink container holders, at points correspondent to the projections X1–X5. The projections are provided on the ink containers because when the ink containers are mounted into the ink holders, with the ink delivery port opening facing downward, the presence of the projections prevents the ink delivery port openings from directly contacting the ink container holders. With the above structure, it is possible to prevent the ink container bottom, around the like delivery ports, from directly contacting the container mounting surfaces, as well as to prevent the ink from adhering thereto.

Figure 28A:
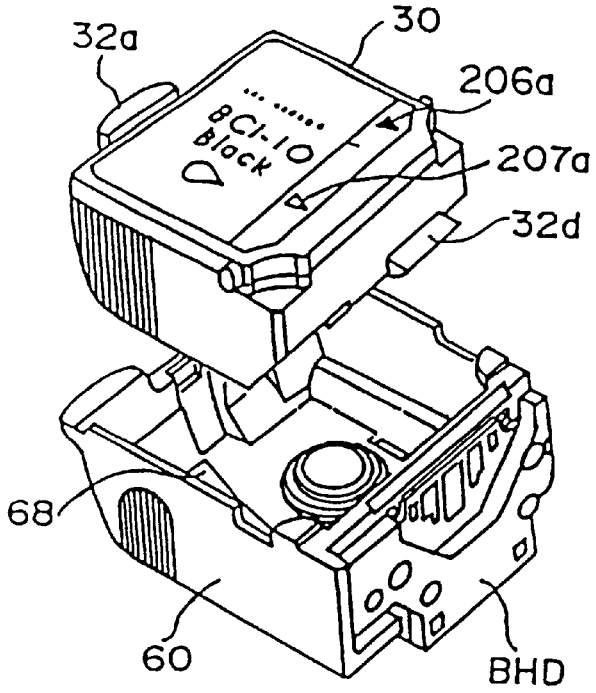
FIG. 28*a* is a perspective view of a container holder 60, which is integral with black-dedicated recording head BHD, and holds only the black ink container 30.
Figure 28B:
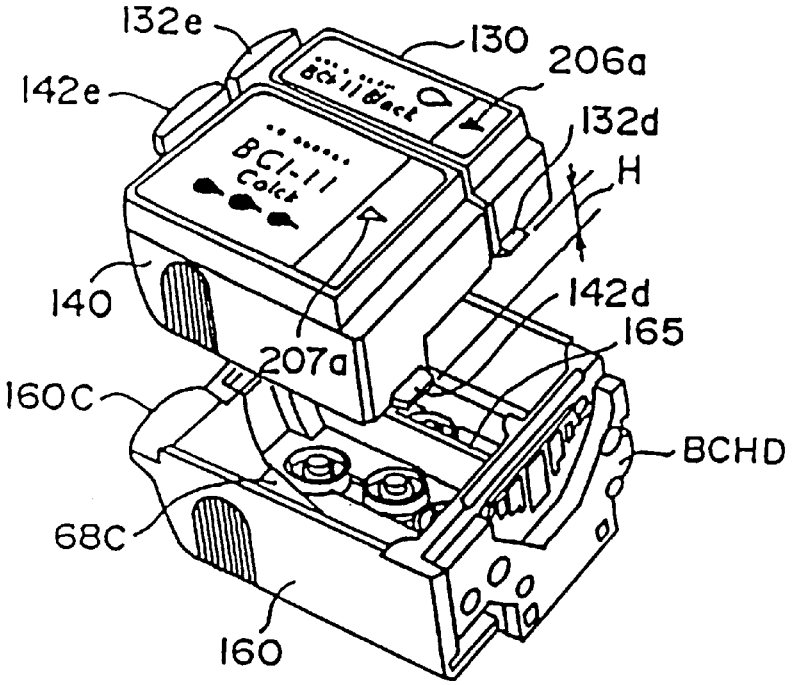
FIG. 28*b* is a perspective view of a container holder 160, which is integral with a black-color recording head BCHD, and holds a black ink container 130 and a color ink container 140.
Figure 29A:
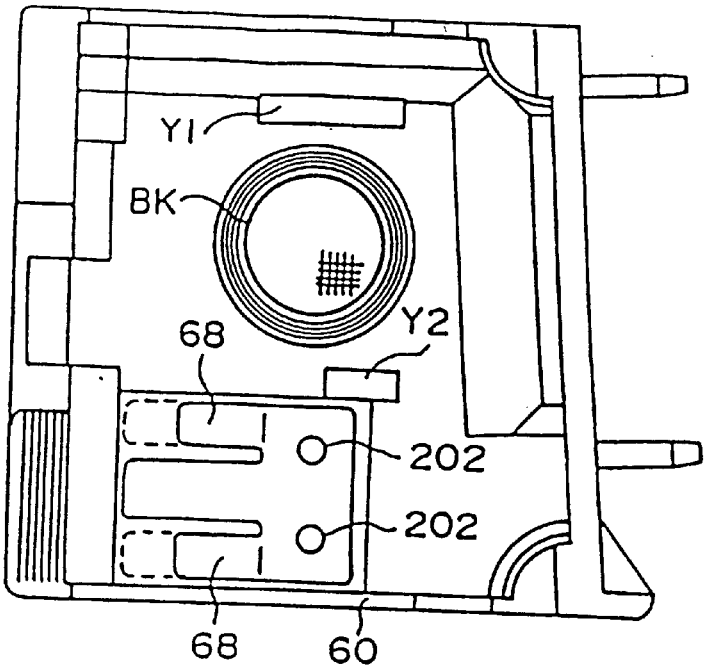
FIGS. 29*a* and 29*b* are top and bottom views of the container holders 60 and 160, respectively.
Figure 29B:
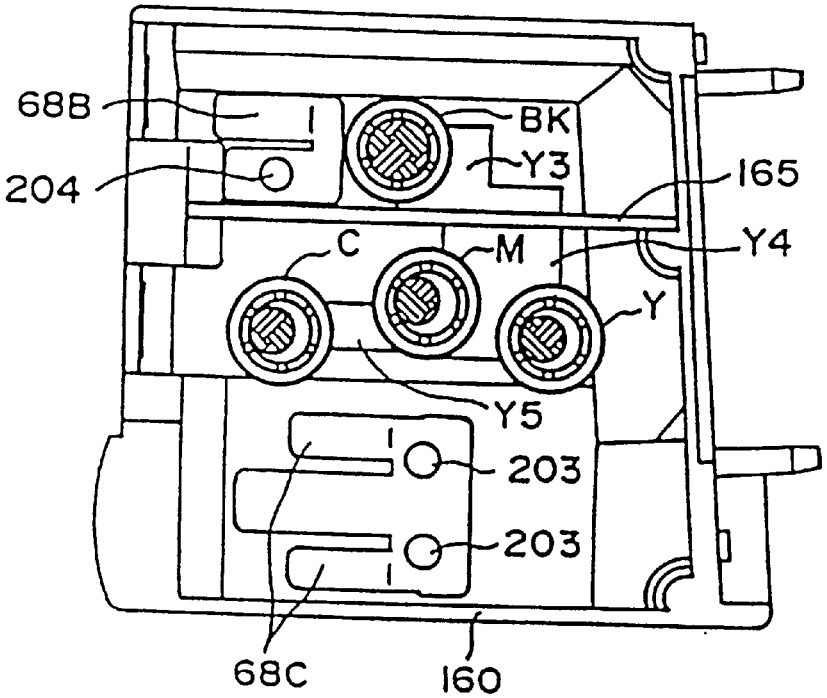
Figure 37:
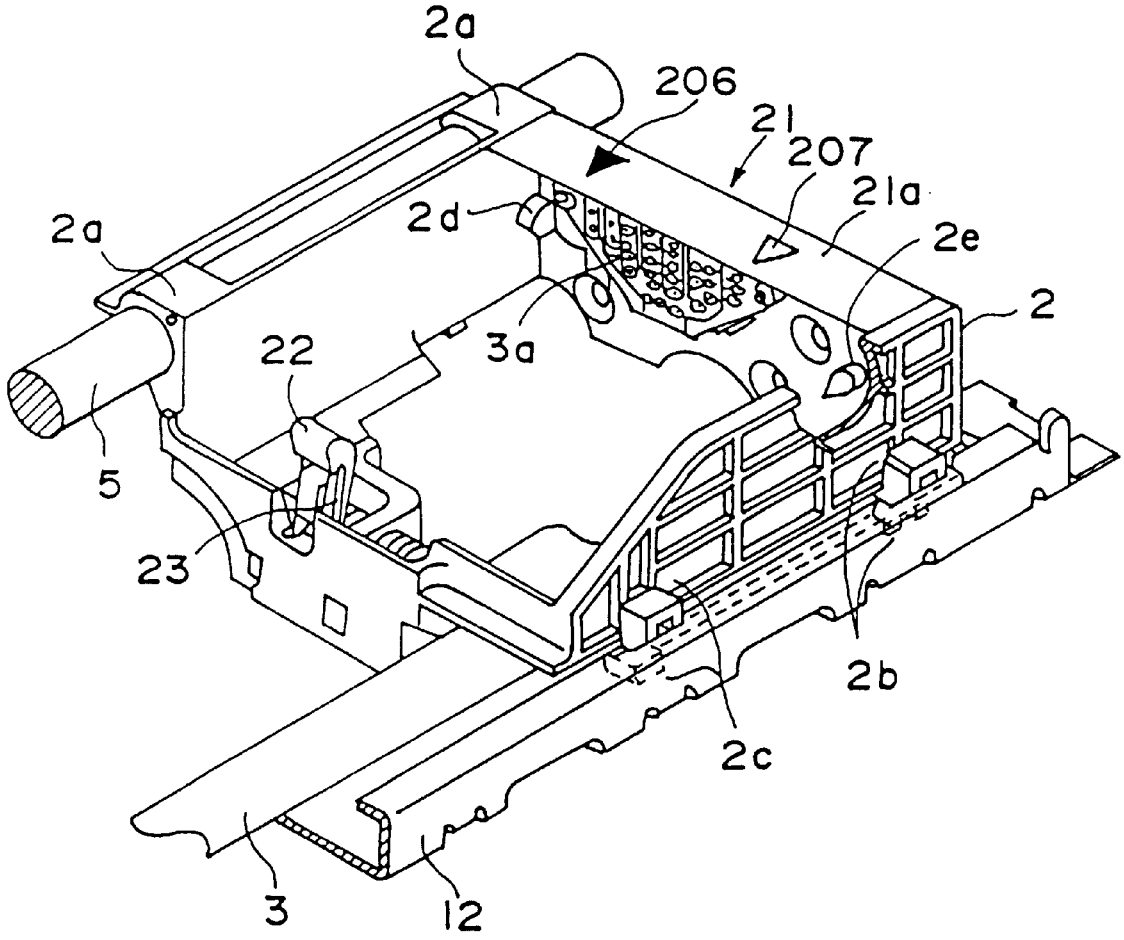
FIG. 37 is a perspective view of the structure of the ink jet recording apparatus carriage, on which the container holders 60 and 160 illustrated in FIG. 28 are mounted.

As is evident from FIGS. 28*a*–*b* and 37, the carriage 2 is given a black triangular mark 206, and a yellow triangular mark 207, meaning "color", on the ink container holder mounting side. The same marks are placed on the ink containers, on the spots correspondent to these triangular marks 206 and 207, respectively. The container 30 occupies the entire mounting space of the container holder 60;

therefore, it is given both the black triangular mark 206*a* and yellow triangular mark 207*a*, whereas the ink containers 130 and 140, which are to be mounted in the color holder 160, are given the black triangular mark 206*a* and yellow triangular mark 207*a*, respectively, corresponding to the colors and mounting locations. The presence of the ink containers can be confirmed from these marks; in other words, the presence or absence, ink container type, and the like can be visually confirmed just by looking at the carriage. Referring to FIG. 29*b*, all of the filters seen at the ink delivery ports of the color ink container holder are displaced in the opposite direction of the rotational center. This is due to the following reason. That is, the amount of filter deformation which occurs when the ink container is mounted in the ink container holder can be reduced by displacing the filter in the opposite direction of the rotational center; therefore, the container can be more reliably mounted.

Figures 31A, 31B, 31C:
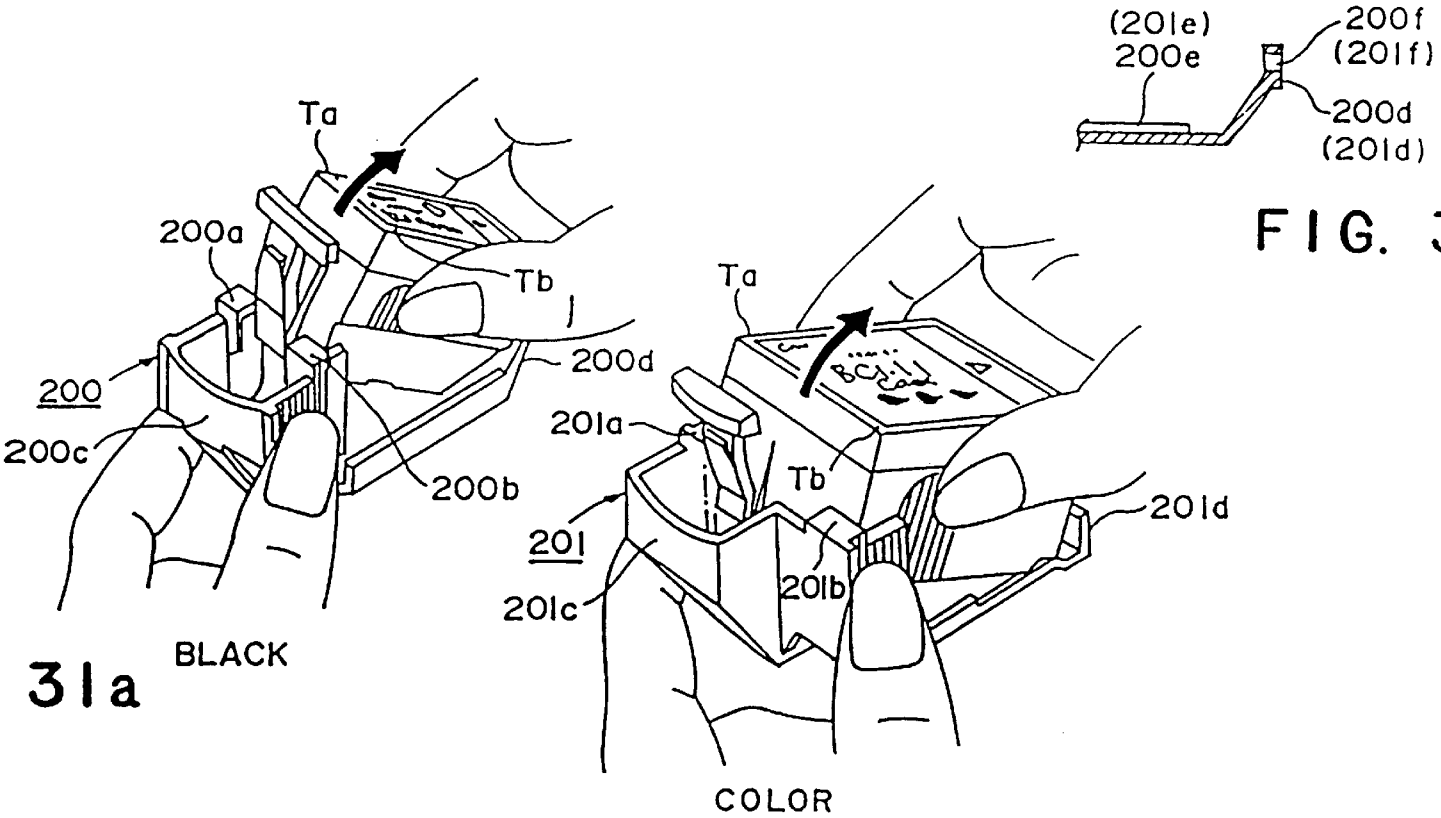
FIG. 31*a* is a perspective view depicting the operation for removing the black ink container 130 as well as the protective member 200.
FIG. 31*b*, a perspective view depicting the operation for removing the color ink container 140 as well as the protective member 201.
FIG. 31*c* is a sectional view of the partial structure of the protective member.
Figure 35:
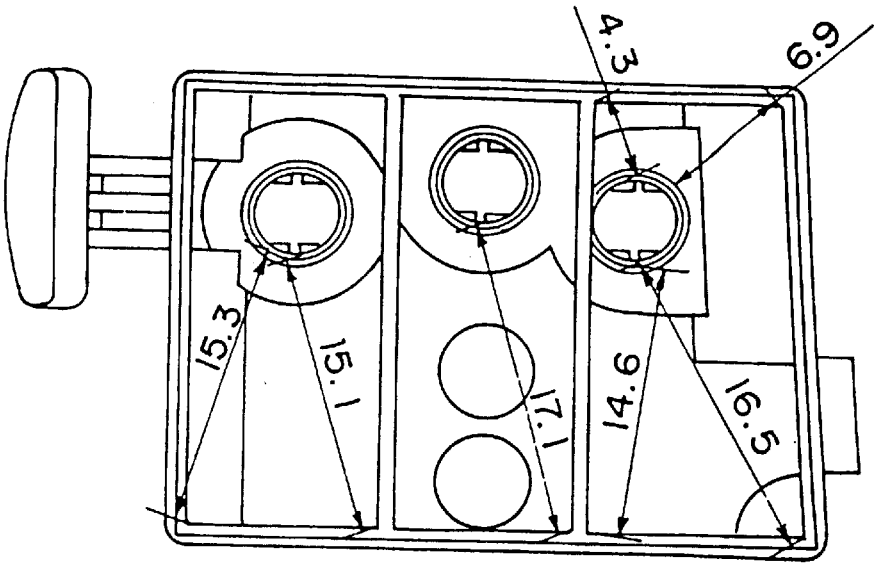
FIG. 35 is an enlarged projection of FIG. 34(*c*), that is, the top view, in which the absorbing member has been removed.

FIGS. 31*a–c* depict a protective member or cap for the ink container, and the structures related to the protective member. In this drawing, the protective member for the ink container 30 is not shown, but as long as its functions, configuration and the like are essentially the same as the color ink container, it is satisfactory. The protective members 200 and 201 are directly attached to the ink containers 130 and 140, and ink delivery port covering members 200*e* and 201*e*, as ink absorbing sheets or caps, make contact with the bottom surfaces of the ink containers 130 and 140, respectively. This ink delivery port covering portion prevents unnecessary splashing of the ink; in particular, the covering portion for the color ink container 140 prevents mixing of the inks.

In essence, the protective member in this embodiment is a protective member (200, 201) which is to be engaged with such an ink container (130, 140) that comprises: a delivery portion, which is located on the bottom wall, and delivers the recording ink stored in itself; a projection, which is located on one of the lateral walls, and is inserted into the recess of the holder in which the ink container is mounted; and an elastic latch lever, which has a latch claw, and is located on the opposite lateral wall of the one with the projection, and that is mounted into the holder, or dismounted from it, by means of engaging the latch claw into the engagement portion of the holder, or disengaging them. It is characterized by comprising: a protective or cover portion (200*c* 201*c*) which covers, in a non-contact manner, the peripheries of the manipulable elastic latch lever (132*a*, 142*a*) on which the aforementioned latch claw is located; a bottom surface portion with the absorbing member or cap (200*e*, 201*e*) for sealing the peripheries of the aforementioned ink delivery ports; a recessed portion (200*f*, 201*f*) for accommodating the aforementioned projection; and engagement portions (200*a* and 200*a*, 201*a* and 201*b*) which engage with the ink container, on the top corners (Ta, Tb) on the manipulable elastic latch lever side.

Figure 38:
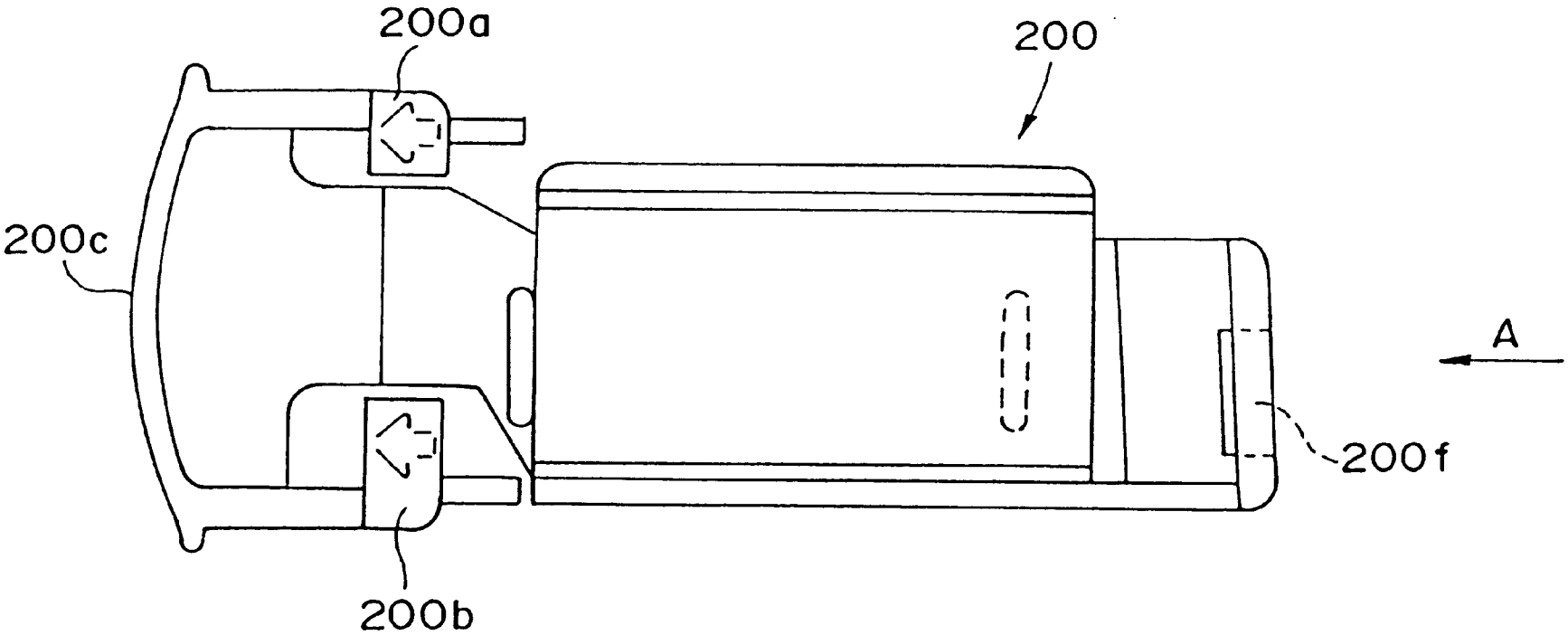
FIG. 38 is a top view of the protective member 200 of the black ink container 130.
Figure 39A:
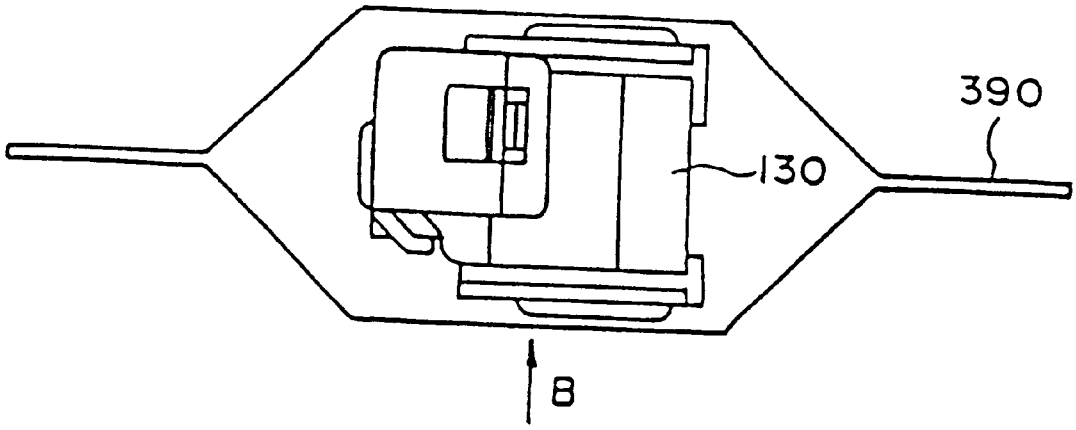
FIGS. 39*a* and 39*b* are drawings of the packaged protective member 200 containing the black ink container 130, wherein 39*a* is a drawing as seen from the direction of an arrow mark A in FIG. 38, and 39*b* is a drawing as seen from the direction of an arrow mark H in the drawing 39*a*.
Figure 39B:
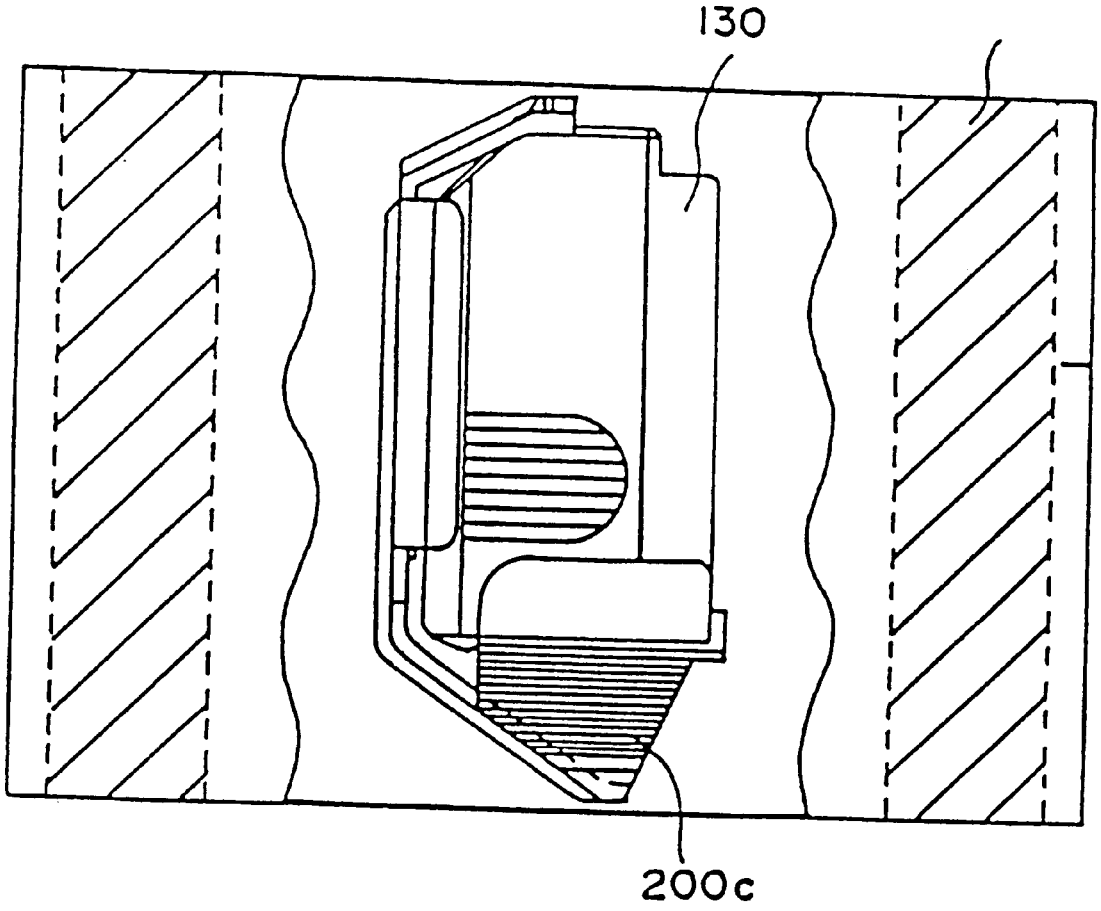
Figure 40:
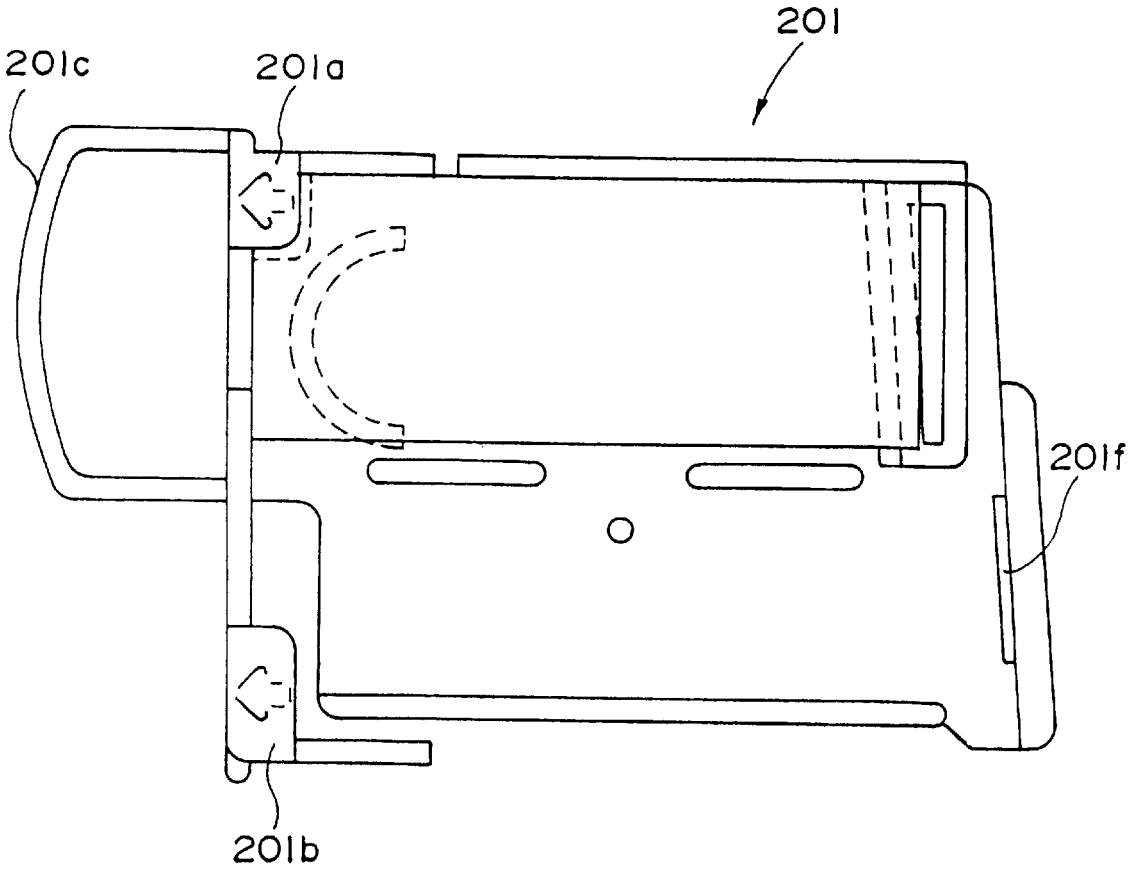
FIG. 40 is a top view of the protective member 201 of the color ink container 140.
Figure 41A:
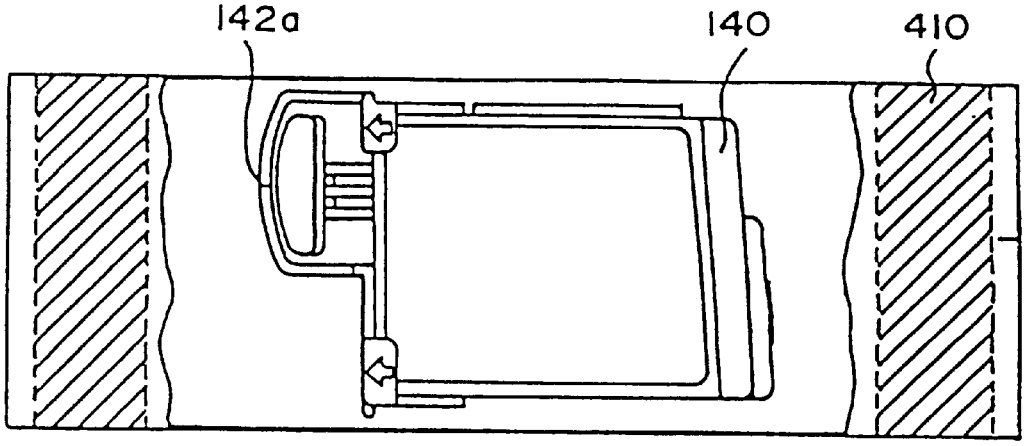
FIGS. 41*a* and 41*b* are drawings of the packaged protective member 201 containing the color ink container 140, wherein 41*a* is a top view, and 41*b* is a side view.
Figure 41B:
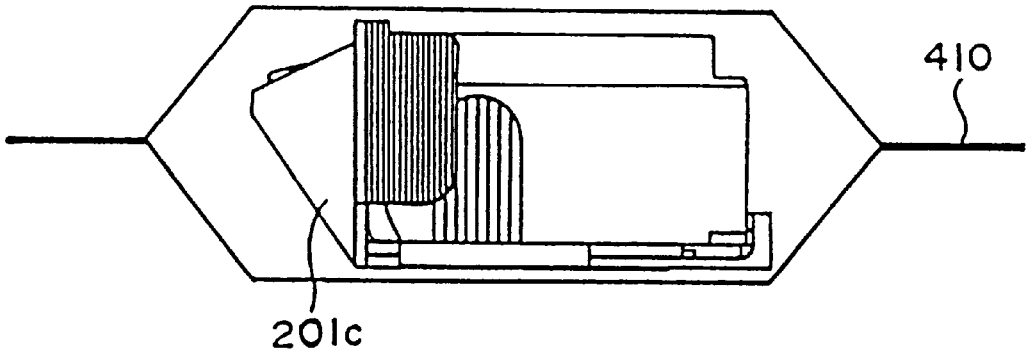

FIG. 38 is a top view of the protective member 200 for the black ink container 130, and FIG. 38 depicts the packaged protective member 200 containing the black ink container 130. FIG. 39*a* is a side view of FIG. 38 as seen from the direction of an arrow mark A, and FIG. 39*b* is a side view of FIG. 39*a* as seen from the direction of an arrow mark B. FIG. 40 is a top view of the protective member 201 for the color ink container 140, and FIG. 41 depicts the packaged protective member 201 containing the color ink container 140. FIGS. 41*a* and 41*b* are a top view and a side view, respectively.

Referring to FIGS. 39*a–b* and 41*a–b*, during shipment or the like, the ink containers 130 and 140 are protected by the protective members 200 and 201, respectively, and in addition, they are packed and sealed in envelopes 390 and 410.

At this time, the protective portions 200*c* and 201*c* formed on the protective members 200 and 201, respectively, will be described. As shown in the drawings, they are tapered so that the top portion of the latch levers (142*a* in FIG. 41*a*; not shown in FIGS. 39*a–b*), which are to be protected by the protective members 200 and 201, are allowed to project slightly.

The reason for such an arrangement is that, when separating the protective member from the ink container, it is liable for the protective portions 200*d* and 201*c* to be grasped, whether the entire lever is tightly fitted in the protective portion, or loosely. If the protective portion is grasped when the entire latch is tightly fitted in the protective portion, the protective portion itself sometimes breaks, and if the protective portion is grasped when the entire latch lever is loosely fitted therein, the latch lever may be inadvertently hooked by a finger, and the latch lever itself may be broken. In either case, such undesirable accidents occur when the protective member is hard to remove from the ink container.

In this embodiment, the protective portion is tapered to allow the top portion of the latch lever to project slightly, so that it is impossible to grasp the protective portion alone; therefore, occurrences of such undesirable incidents as described above are prevented.

Figure 42A:
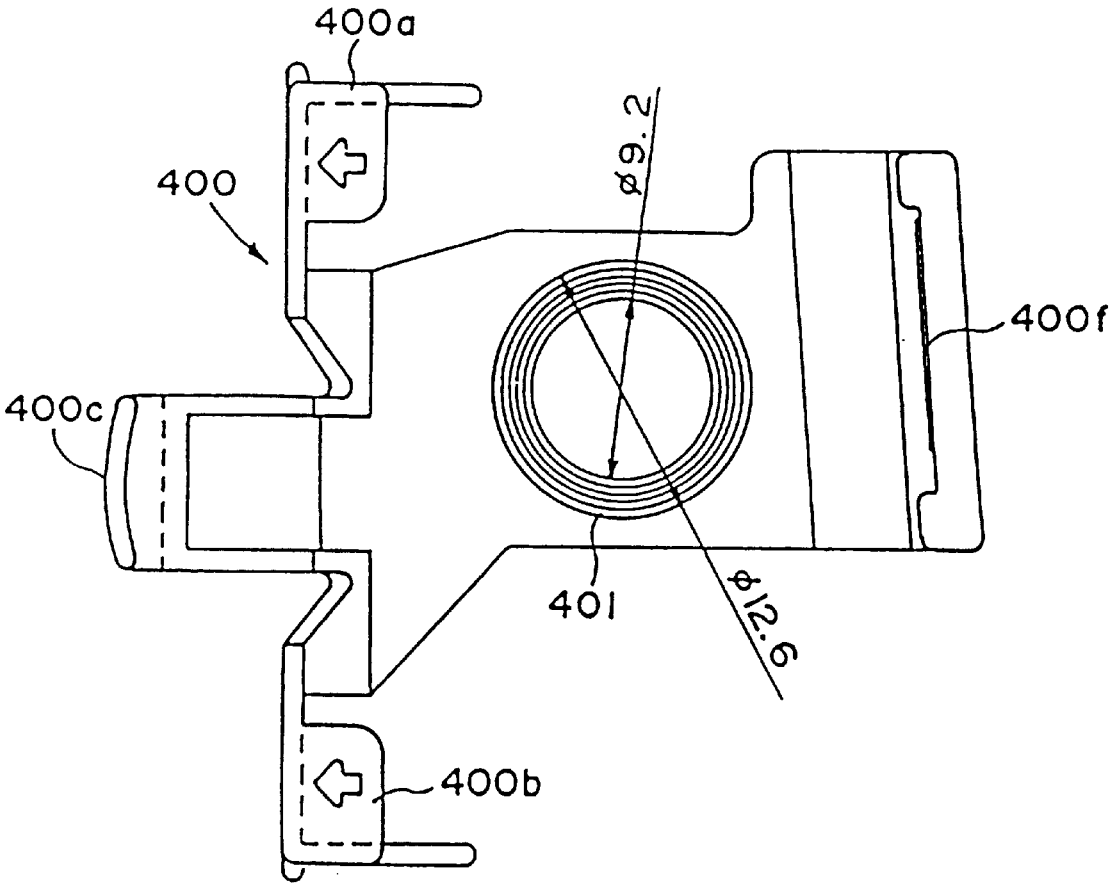
FIGS. 42*a* and 42*b* are drawings of the protective member 400 of the black ink container 300, wherein 42*a* is a top view, and 42*b* is a side view.
Figure 42B:
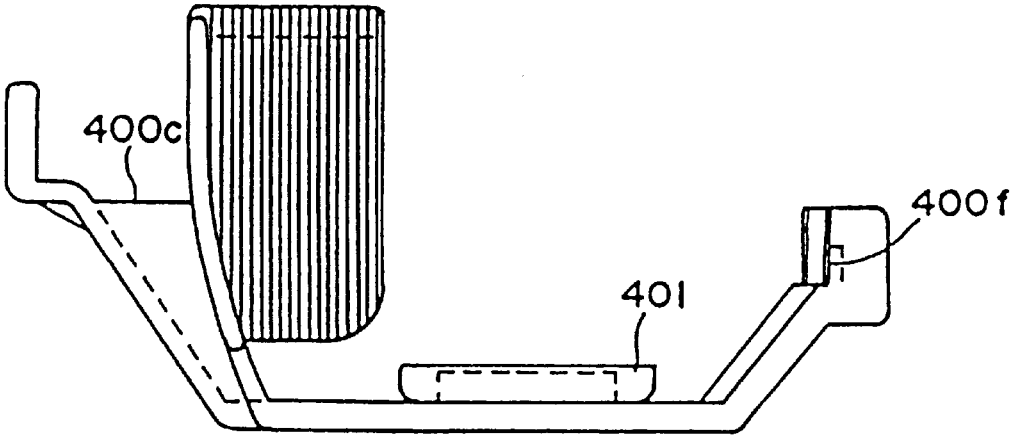
Figure 43A:
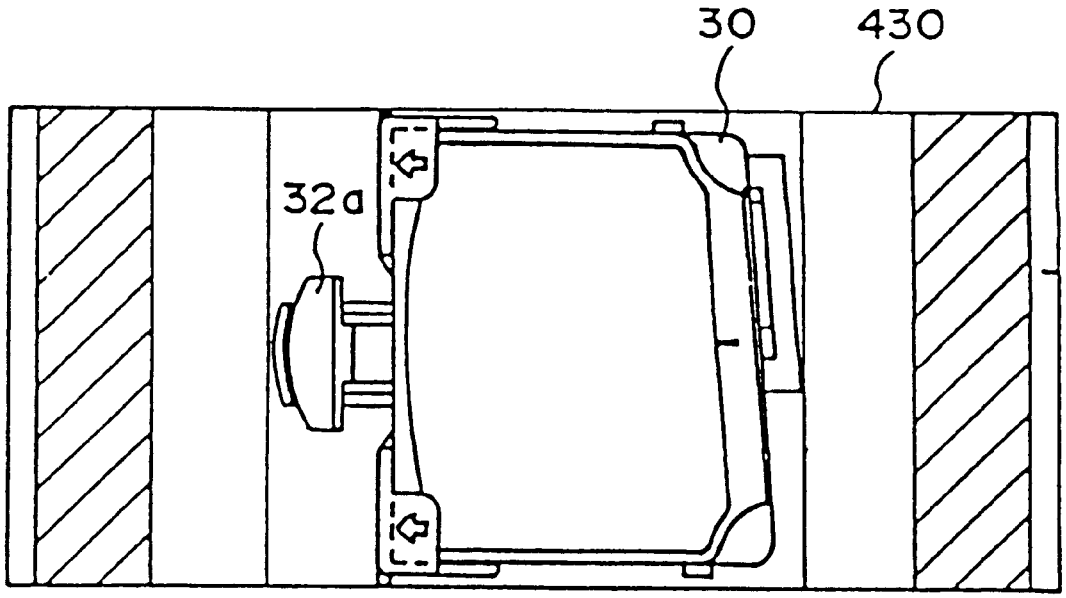
FIG. 43*a* and 43*b* are drawings of the packaged protective member 400 containing the black ink container 30, wherein 43*a* is a top view, and 43*b* is a side view.
Figure 43B:
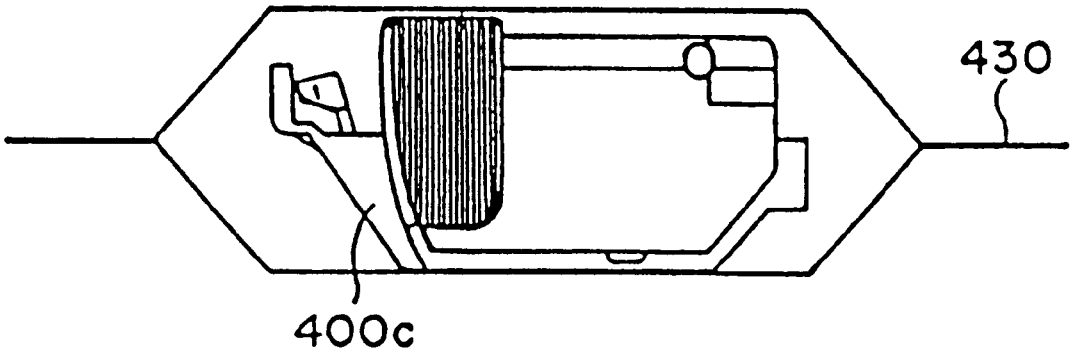
Figure 44A:
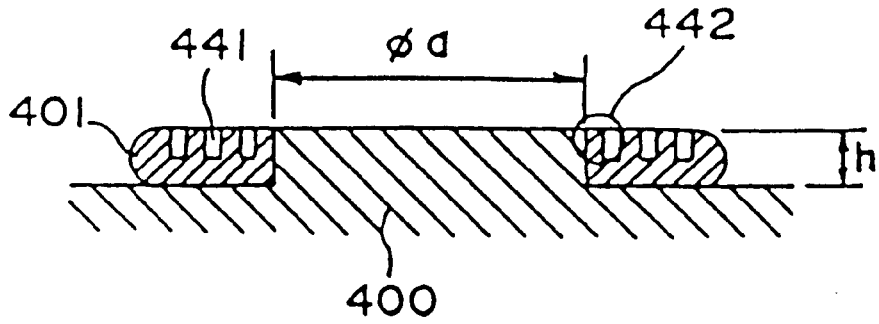
FIGS. 44*a–c* are detailed drawings of the protective member 400 illustrated in FIGS. 42 and 43, wherein 44*a* is a partial sectional view; 44*b*, an enlarged, partial view; and 44*c* is a partial sectional view depicting how the protective member 400 is engaged with the ink container.
Figure 44B:
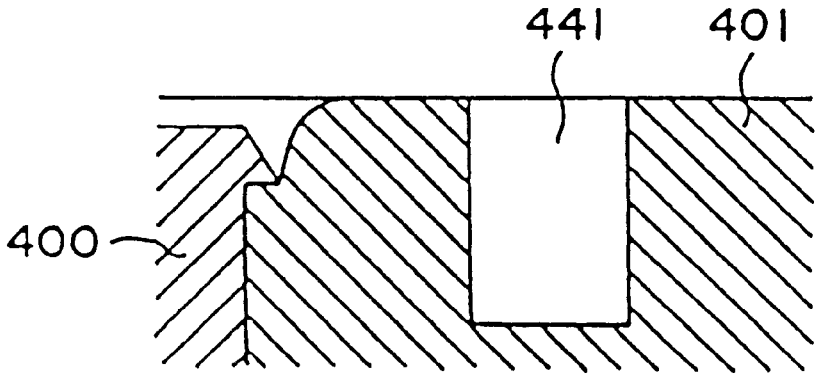
Figure 44C:
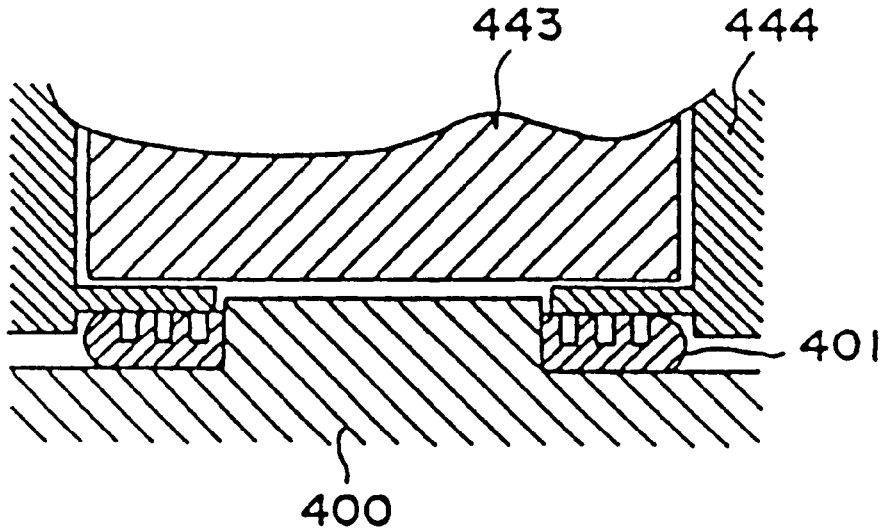

FIGS. 42*a* and 42*b* illustrate the protective member of the black ink container 30, wherein 42*a* is a top view, and 42*b* is a side view. FIGS. 43*a* and 43*b* depict the packaged protective member 400 containing the black ink container 30, wherein 43*a* is a top view, and 43*b* is a side view. FIGS. 44*a–c* depict in detail the ink delivery port of the protective member 400 depicted in FIGS. 42*a* and 43*b*, wherein 44*a* is a partial section; 44*b*, an enlarged section; and 44*c* is a partial section of the protective member 400 and ink container, depicting how two components are connected.

Also on the protective member 400, engagement portions 400*a* and 400*b*, a protective portion 400*c*, and a recessed portion 400*f* are formed, which are similar to those on the protective members 200 and 201. The protective portion 400*c* is also similar to those of the protective members 200 and 201 in that it is also formed to allow the latch lever 32*a* to project slightly when the latch lever is fitted in the protective portion 400*c*, and in that it is sealed in an envelope when handled. The protective member 400 is different from the protective members 200 and 201 illustrated in FIG. 31, only in that an O-ring 401 is provided on the ink delivery port covering portion since the ink container, with which the protective member 400 is engaged, is the black ink container 30, which has a large ink capacity.

It was previously described that the ink delivery port covering members 200*e* and 201*e*, as the ink absorbing sheets of caps, were formed on the protective members 200 and 201, on the portions which come in contact with the ink container bottom, on the basis of the ink capacity of the ink container with which they are engaged (in this case, it is acceptable, needless to say, to paste the ink absorbing sheet onto the ink container itself, and place the ink delivery port covering member on the protective member). However, in the case of the ink container 30 which stores a large volume of the ink, the O-ring is used to seal more reliably.

Next, referring to FIG. 44, the structure of the protective member 400 will be described.

As illustrated in FIG. 44*a*, a projection is formed on the protective member 400, at the location which corresponds to the ink delivery port area of the ink container 30, and an O-ring 401 is fitted around this projection. On the top surface of the O-ring 401, grooves 441 are provided to improve the sealing performance of the O-ring.

FIG. 44*b*, which is an enlarged view of the edge portion 442, shows how this O-ring 401 is attached to the protective member 400; after the O-ring 401 is fitted around the projection, the top of the projection is thermally deformed to retain the O-ring in a crimping manner.

Referring to FIG. 44*c*, the diameter of the projection illustrated in FIG. 44*a* is substantially the same as the diameter of the ink delivery port of the ink container 444 protected by the protective member. The height h of the projection is set to be such that, when the protective member is engaged with the ink container 444, the projection comes as close as possible to a compressed member 443, without touching it, which is placed within the ink container to absorb and retain the ink. More specifically, it is set to be no more than 0.2 mm. This is due to the following reason. That is, if the gap between the tip of the projection and the compressed member 442 is excessively large, the ink tends to accumulate in this gap when the ink container is dropped or when the like incident occurs, and the accumulated ink may lead to accidents; for example, the accumulated ink is liable to be splashed from the ink delivery port when the protective member is removed. This is particularly true with a large capacity ink container such as the ink container 30, since the large capacity ink container has a large ink delivery port.

In this embodiment, the height of the projection is set to be no more than 0.2 mm so that the ink is prevented from accumulating in the gap formed between the projection tip and compressed member 443; therefore, the aforementioned accident can be prevented.

Next, referring to FIGS. 32*a–f*, 33*a–g* and 34*a–f*, the characteristic pertaining to the ink container configurations will be described. Each ink container comprises a manipulable elastic latch lever, which is located on one of the lateral walls, and has a latch claw. As for the distance C, which the latch claw travels when it clicks (hereinafter, a clicking amount C), it is 0.9 mm in the case of the ink container 130 (FIG. 32*c*, and is 0.7 mm in the case of the ink container 140 (FIG. 34*c*). In either case, it is no more than 1 mm; the distance C for the ink container 130 (FIGS. 33*a–g*) is not shown. Though FIG. 32*a–f* do not illustrate how the latch claw engages with the ink container holder. FIG. 33*f* and FIG. 34*f* illustrate it; in either case, a separation distance TR, that is, the distance between the inward facing surface of the latch lever, and the container surface, on which the latch lever is located, is 2 mm for all containers.

If this clicking amount C is increased, the overall size of the container, as well as the size of the carriage on which the container is mounted, must be increased; therefore, the value of the clicking amount C is preferred to be no more than 1 mm. As for the value of the separation distance TR, it is necessary for this distance to be proportional to the clicking amount C, and also to be optimized; otherwise, the clicking amount C cannot be cleared, and/or clicking itself cannot occur. In consideration of such a situation, this embodiment was designed so that the clicking amount C satisfies the following requirement:

$$3C \geqq TR(C=0.7);\ 2C \geqq TR(C=0.9).$$

With such an arrangement, the latch lever reliably engages with a sound and feel of clicking, and also, the separation is simple and reliable. Further, it was discovered that the separating operation was reliable when the value of the TR is no less than 1.5 times the clicking amount C.

To sum up, the ink container in accordance with this embodiment comprises an ink delivery port, formed on the bottom wall for delivering the recording ink stored therein, and mounted into an ink container holder, or dismounted therefrom, by means of engaging the latch claw with the engagement portion of the holder in which the ink container is mounted, wherein the clicking amount C, which the latch claw travels to engage with the engagement portion, is no more than 1 mm, and the separation distance TR between the inward facing side of the projection tip and the container surface satisfies:

$$1.5C <= TR <= 3C.$$

With the employment of this structure, the ink capacity of the ink container can be maximized in the available space without complicating the structure of the holder and carriage, and also, space necessary for manipulating the latch or latch lever can be minimized, while making the mounting or dismounting operation more reliable.

A more preferable condition is for the separation distance TR to satisfy:

$$2C \leqq TR \leqq 3C.$$

Further, it was discovered that in the case of a single chamber ink container as illustrated in FIG. 32*b*, when the distance 211 between the outward facing surface of the manipulable elastic latch lever and the container lateral wall, on which the latch lever was anchored, was set to be no more than 10.0 mm (for example, 9.0 mm in FIG. 32*b*, and 8.8 mm in FIG. 34*b*), the latch lever engaged with a distinct sound and feel of clicking, improving mounting or dismounting efficiency.

Further, referring to FIG. 32*c*, in order to minimize the container size, and improve operational efficiency, the manipulable tab 208 of the elastic latch lever is tapered. That is, the manipulable tab 208 surface (tapered surface 210) facing the lateral wall of the container is slanted in such a manner that the top portion of the manipulable tab 208 surface moves away from the lateral wall, at an angle which allows the tapered surface to be flatly placed in contact with the lateral wall of the container.

When the manipulable latch lever is placed on the lateral wall of the ink container as it is in this embodiment, it is preferable that the lever is durable to withstand repeated manipulation. Such durability can be realized by constructing the latch lever as illustrated in FIG. 32*c*, that is, by means of bending the latch lever portion 209, adjacent to the latch claw, toward the lateral wall of the container. Needless to say, this structure is applied to each container as shown in FIG. 33*c* or FIG. 34*c*. When the angle between this bent portion and the lateral wall is no more than 20 deg. (15 deg. for each container in this embodiment), the structure is more practical and durable.

When the manipulable elastic latch lever is formed of inexpensive material, the latch lever strength is reduced. As for the means for strengthening the structure of such a latch lever, it is preferable that the latch lever thickness at the longitudinal center line portion is increased in the direction of the bend.

Figure 36:
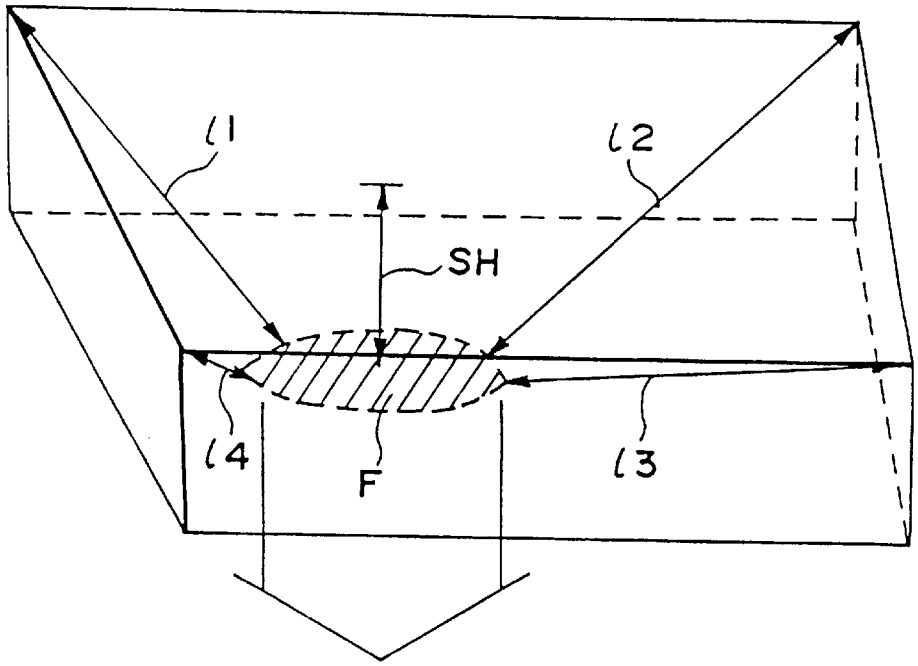
FIG. 36 is a conceptual drawing depicting the relationship among the various measurements of the ink container, which contributes to increase the ink delivery efficiency.

When attention was paid to the correlation between the size reduction of the ink container itself and the ink delivery performance, it was discovered that the dimension of the ink retaining surrounding area of the ink delivery port as shown in FIG. 36 affected, to a certain degree, the ink delivery performance in the gravity direction. This discovery was strictly limited to a flat ink container comprising an ink delivery port located on the bottom wall, and an ink delivery member which is constituted of a bundle of unidirectional fiber, and is placed within the ink delivery port.

When the container height (thickness) SH from the surface F, which is the interface between the ink delivery member and ink absorbing member, was no more than 20 mm, the following characteristic manifested. Referring to FIG. 36, 11–14 represent maximum distances from the periphery of the interface F to the corners of the ink container containing the ink. As is evident from the drawing, 11–14 are not equal; therefore, there is a concern in that the ink may not be uniformly delivered.

However, as long as the relationship between the distance 1, from the interface to the corner, and the SH, satisfies the following formula, at least in two directions, the ink container size could be reduced in a space efficient manner while maintaining preferable ink deliver performance:

$$SH \leqq 1 \leqq 2.5 \times SH$$

Figure 45:
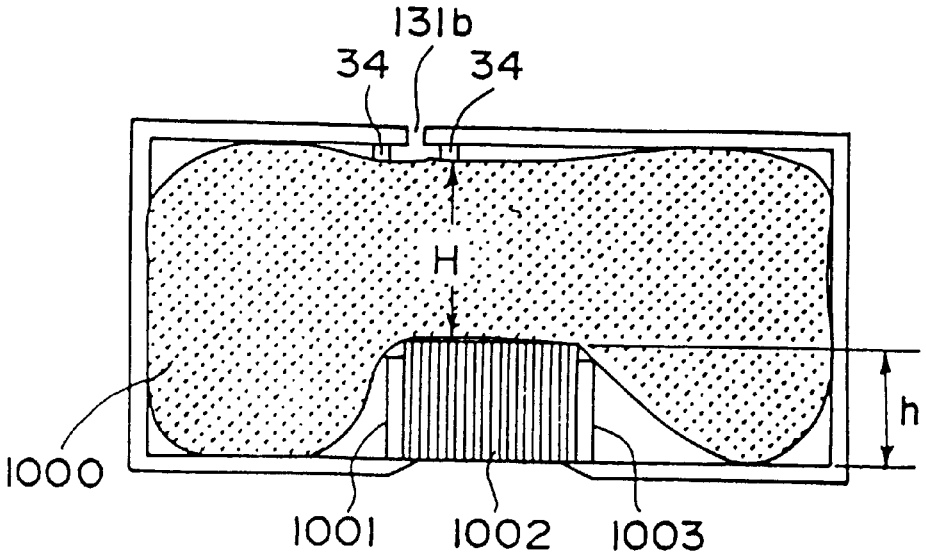
FIG. 45 is an explanatory drawing describing the first aspect of the present invention $h \leqq H \leqq 4h$.

Referring to FIG. 45, a reference numeral 1000 designates an ink absorbing member (sponge or the like). It practically fills the entire internal space of the flat ink container, including the surrounding area of the unidirectional ink delivery member 1002 of the ink delivery port region, and the space thereabove. Reference numerals 1001 and 1003 designate guiding members which allow the ink delivery member 1002 to move. The ink delivery performance of the flat ink container is preferable when the ratio of the height H of the ink absorbing member portion, occupying the space above the ink delivery member 1002, to the h of the ink delivery member 1002, is within a predetermined range. More specifically, when the maximum and minimum values of this height H satisfy the following formula, the container offers a preferable ink delivery characteristic:

$$h \leqq H \leqq 4h$$

When H is no more than h, the ink cannot be sufficiently collected toward the ink delivery port, and when H exceeds 4h, the ink delivery performance itself does not deteriorate, but such a configuration cannot satisfy the requirement for a small and flat ink container.

Parenthetically, each ink container, the measurement of which are given in FIGS. 32*a–f*, 33*a–g* or 34*a–f*, satisfies:

$$h \leqq H \leqq 2h \text{ (FIG. 32)}$$

$$1.45h = H \text{ (FIG. 33)}$$

$$3.5h = H \text{ (FIG. 34)}$$

All of these ink containers satisfy: h<=H<=4h; therefore, they can stably deliver the ink, and also, the unusable amount of the ink within the ink container can be reduced compared to the conventional ink container.

Figure 46:
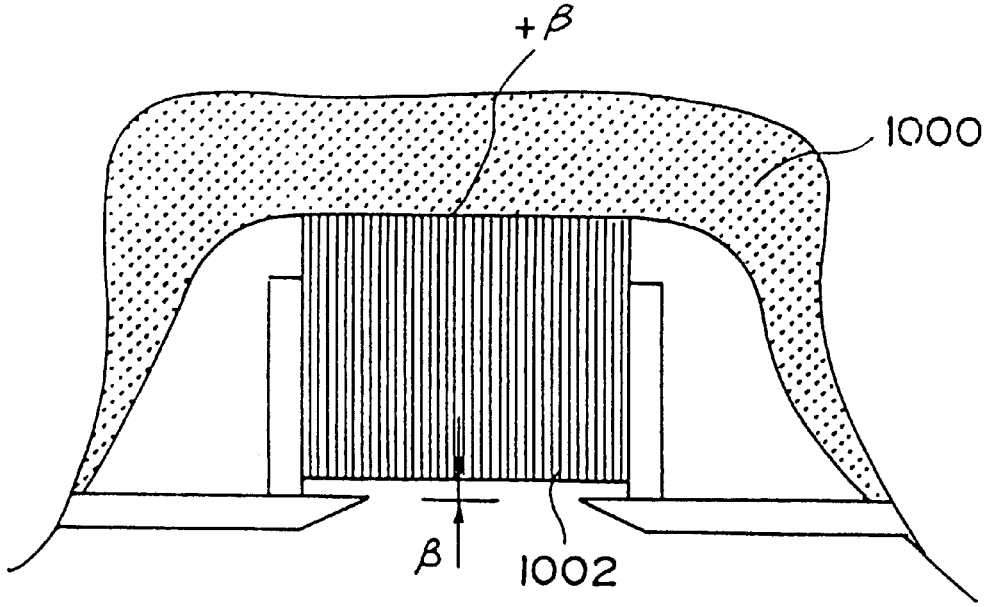
FIG. 46 is an explanatory drawing describing the fifth aspect of the present invention: the movement is no less than 0.1 mm and no more than 0.5 mm.

FIG. 46 is a conceptual drawing describing the amount of the unidirectional ink delivery member movement, that is, the distance B which the bottom surface of the ink delivery member 1002 moves upward from its location prior to the ink container installation, by being pushed by the ink tapping tube when the ink container is mounted in the holder. The ink absorbing member 1000 is also affected by this movement; it is compressed by +β. When the amount of compression is too small, the ink absorbing member and unidirectional fiber bundle do not make satisfactory contact, but when excessively large, the capillarity of the ink absorbing member becomes larger than that of unidirectional fiber bundle, failing to deliver a sufficient amount of the ink. In either case, the ink container cannot offer a satisfactory ink delivery performance.

The ink container can offer a referable ink delivery performance when 0 satisfies the following requirement:

$$0.1 \text{ mm} \leqq \beta \leqq 0.5 \text{ mm}$$

For example, in the case of the ink container illustrated in FIGS. 33*a–g*, 34*a–f* or 35, the distance B which the bottom surface of the ink delivery member 1002 moves when the ink container is mounted in the holder as illustrated in FIGS. 28*a–b* is 0.3 mm for all three containers, which satisfies the aforementioned condition; therefore, local contact failure between the absorbing member 1000 and ink delivery member 1002 as illustrated in FIG. 45 can be reliably prevented, and the ink absorbing member is not compressed excessively. As a result, the ink distribution within the ink absorbing member is not affected unnecessarily.

Figure 47:
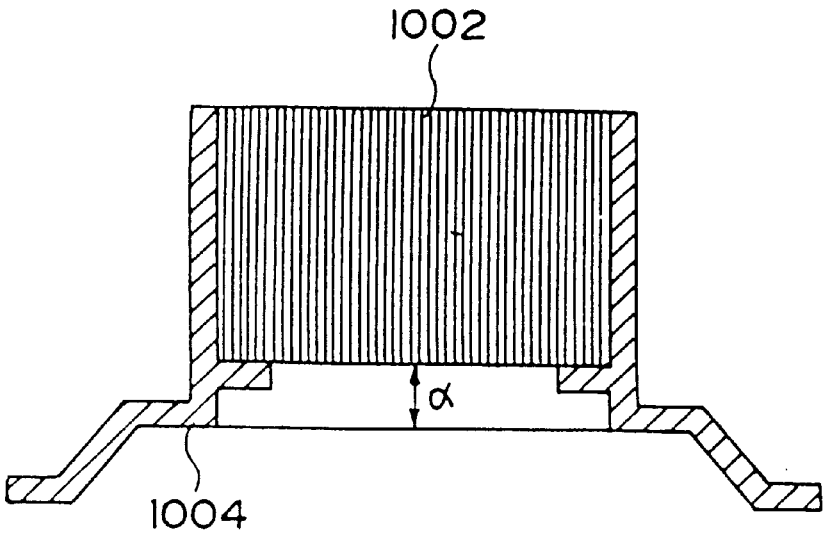
FIG. 47 is an explanatory drawing describing the third aspect of the present invention: $0.3\ \text{mm} \leqq \alpha \leqq 0.8\ \text{mm}$.
Figure 48:
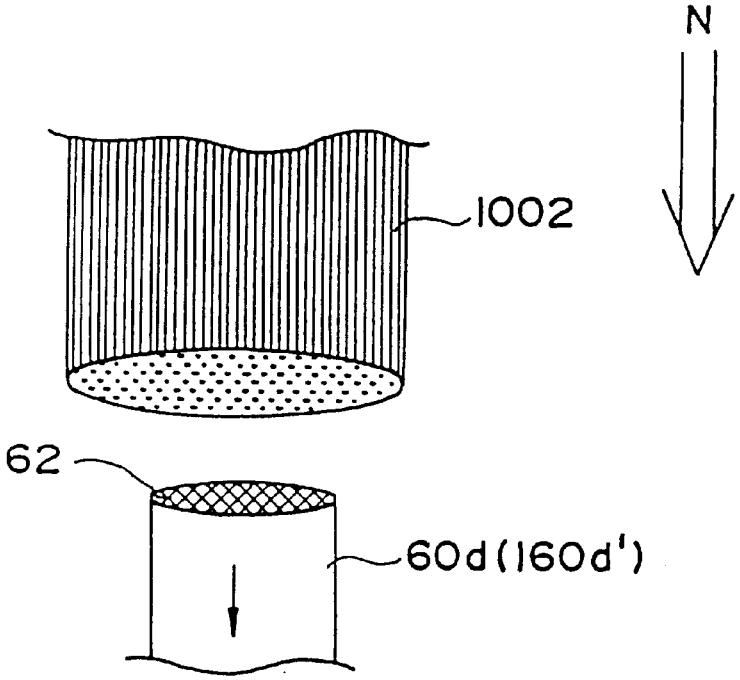
FIG. 48 is an explanatory drawing describing the fourth aspect of the present invention: $40\ \text{gf/mm}^2 \leqq N \leqq 80\ \text{gf/mm}^2$, wherein N is a contact pressure.

Referring to FIG. 47, a reference numeral 1004 designates the ink container surface on which a seal ring 61 is placed, and a Greek reference d designates the distance from the surface 1004 to the location of the bottom surface of the ink delivery member prior to the ink container installation. The distance d is preferred to satisfy the following predetermined condition:

$$0.3 \text{ mm} \leqq d \leqq 0.8 \text{ mm}$$

When this condition is satisfied, the leaked ink can be satisfactorily disposed with the absorbing member placed in the cap (protective member) 200, even if an unexpected situation forces the ink to leak from the ink delivery port while the ink container is in storage. If the distance d is excessively small, the ink delivery member 1002 is liable to be excessively exposed to the outside, inviting the adhesion of foreign matter. In the case of the ink container in FIGS. 33*a–g*, 34*a–f* or 35, the distance d is 0.5 mm, 0.4 mm and 0.6 mm, correspondingly.

When the contact pressure N, with which the ink tapping tube 60*d* (160*d*) on the holder side is pressed onto the filter 62 placed at the end portion of the aforementioned unidirectional ink delivery member 1002, satisfies the following predetermined condition, the ink container can offer a preferable ink delivery performance, and also, ink consumption can be improved:

$$40 \text{ gf/mm}^2 \leqq N \leqq 80 \text{ gf/mm}^2$$

When the contact pressure N is too small, the flow of the ink from the ink container to the recording head is liable to be interrupted, whereas, when it is too much, the unidirectional ink delivery member excessively compresses the ink absorbing member, changing the capillary structure of the ink absorbing member into such a structure that interferes with the ink flow. When the ink containers illustrated in FIGS. 32*a–f*, 33*a–g* and 34*a–f* are mounted in the holder illustrated in FIGS. 28*a–b*, the contact pressures N maintained by the aforementioned latching structure are 56 gf/mm$^2$, 69 gf/mm$^2$ and 66 gf/mm$^2$ for both containers, correspondingly, which can offer the above effects. Practically speaking, it is more preferable for the contact pressure N to be no less than 50 gf/mm$^2$ and no more than 56 gf/mm$^2$ as it is in this embodiment.

Figure 49:
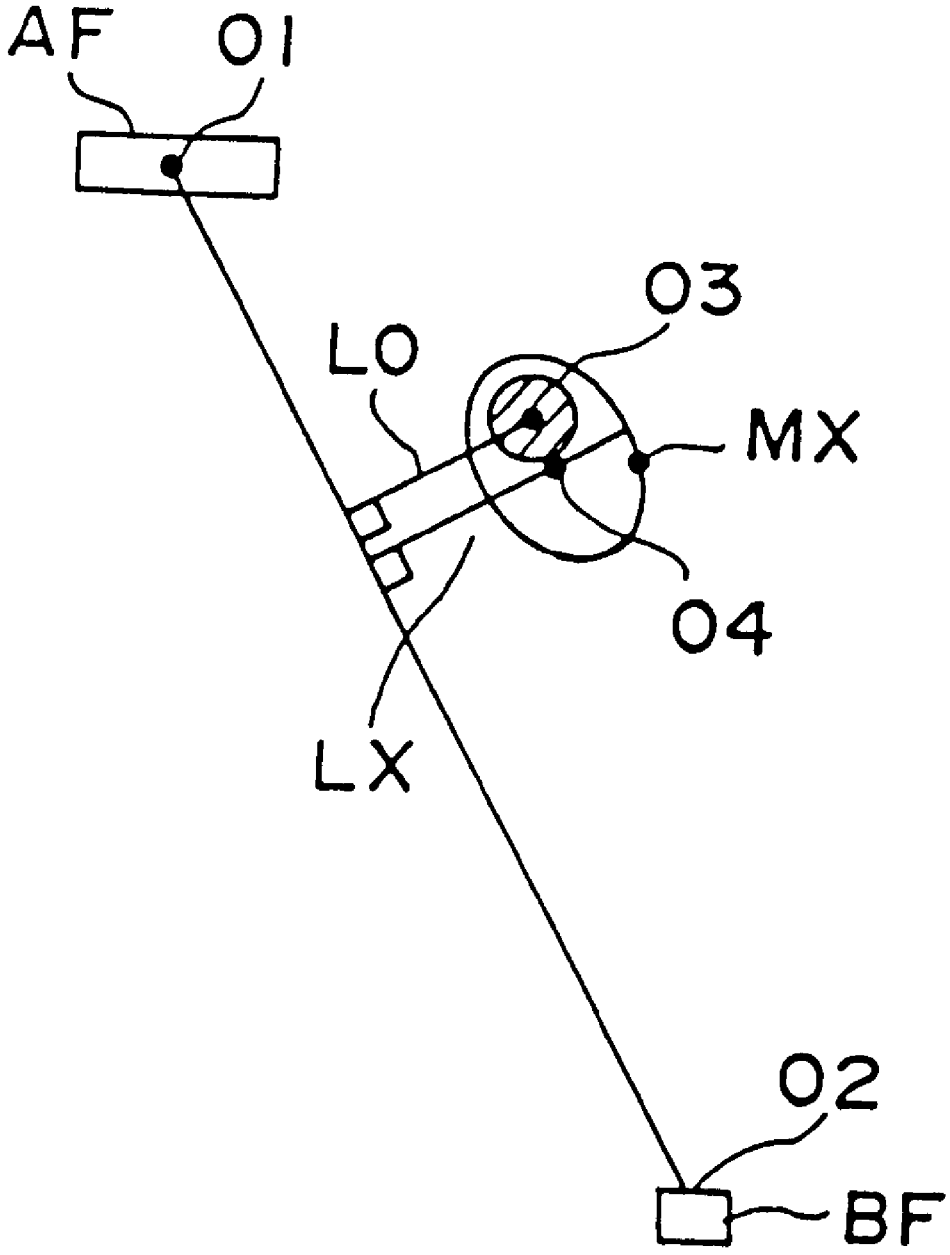
FIG. 49 is an explanatory drawing describing the second aspect of the present invention: the distance is no more than 10 mm.

FIG. 49 is an explanatory drawing for describing one of the conditions for maintaining a preferable ink delivery performance. In the drawing, alphabetic references LX and LO designate perpendiculars drawn from the centers O4 of the ink delivery port of the ink container and the center O3 of the area where the filter located at the ink tapping tube of the head makes contact, to the imaginary line connecting the centers O1 and O2 of the acting portions of the opposing walls of the ink container, and MX designates the maximum distance from the ink delivery portion to the imaginary line (in the case of the aforementioned ink container illustrated in FIG. 32*e*, 33*g* or 34*c*, the imaginary line is equivalent to the line connecting the center of the latch portion and the center of the claw).

It is preferable that a least one of the distances represented by the perpendiculars LX and LO, respectively, and the maximum distance MX, more preferably, all of these distances, are no more than 10 mm. When this condition is satisfied, the reaction from the force which works on the surface AF and BF during the installation of the ink container effectively works to press the ink delivery portion, and the ink tapping tube of the head side, against each other, assuring thereby satisfactory connection between the two components. When this condition is satisfied, the reaction force sometimes fails to join satisfactorily the ink delivery port of the ink container, and the ink tapping tube of the head. In addition to this dimensional condition, the ink delivery port is preferred to be on the aforementioned imaginary line as depicted in FIGS. 32*a–f* or 33*a–g*.

More specifically, with the latching portion being in place for a recording operation, the distance from the center in FIGS. 32*a–f* is 1 mm, the maximum being 6 mm, and the ink delivery port is on the imaginary line. Also in FIGS. 33*a–g*, the distance from the center is 1 mm, the maximum being 6 mm, and the ink delivery port is on the imaginary line. Further, in FIG. 34, the distances from the centers of the ink delivery ports Y, M and C are 2.5 mm, 7.0 mm, and 7.0 mm, the maximum being 4.5 mm, 9.0 mm and 9.0 mm, correspondingly. In the case of this second aspect of the present invention, the internal structure of the ink delivery port is optional, and the same effects can be obtained with the absorbing member alone. When these numerical conditions are synergistically satisfied, the ink is more preferably delivered.

Figure 50:
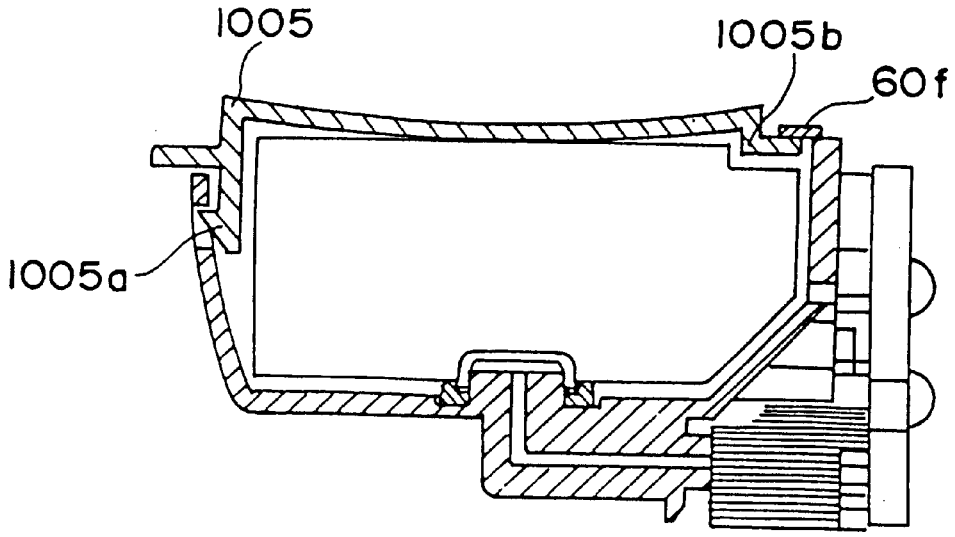
FIG. 50 is a sectional view of the modification of the ink container holder and ink container.

FIG. 50 and the rest of the drawings depict the modifications of the ink container holder and ink container, as well as the methods for mounting these modified ink containers in the modified ink container holders.

In the case of the modification example illustrated in FIG. 50, the ink container in the holder does not have the latching member or the latching claw; the ink container is held in the ink holder, with the use of a cover member 1005, the top wall of which is warped in the direction to press the ink container. The cover member has engagement portions 1005*b* and 1005*a*, which engage with an overhang portion 60*f* and an engagement hole, respectively. When the ink container is mounted, these portions engage each other, and the warped portion presses the ink container.

With the provision of the above structure, the ink container can be simply and reliably mounted without forming the claw portion and projection on the ink container itself.

Figure 51:
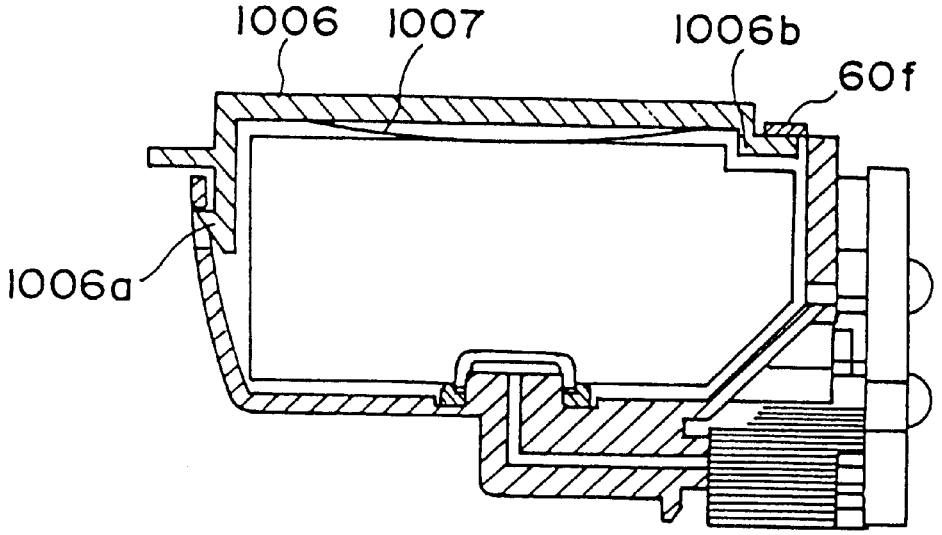
FIG. 51 is a sectional view of further modification of the ink container holder and ink container.

In the case of the modification example illustrated in FIG. 51, the cover member itself does not press the ink container. Instead, the ink container is press by a spring 1007 placed between the cover member 1006 and ink container. Also in this example, the engagement portions 1006*a* and 1006*b* engage with the ink container holder, and the ink container is reliably held down by the spring 1007.

Figure 52:
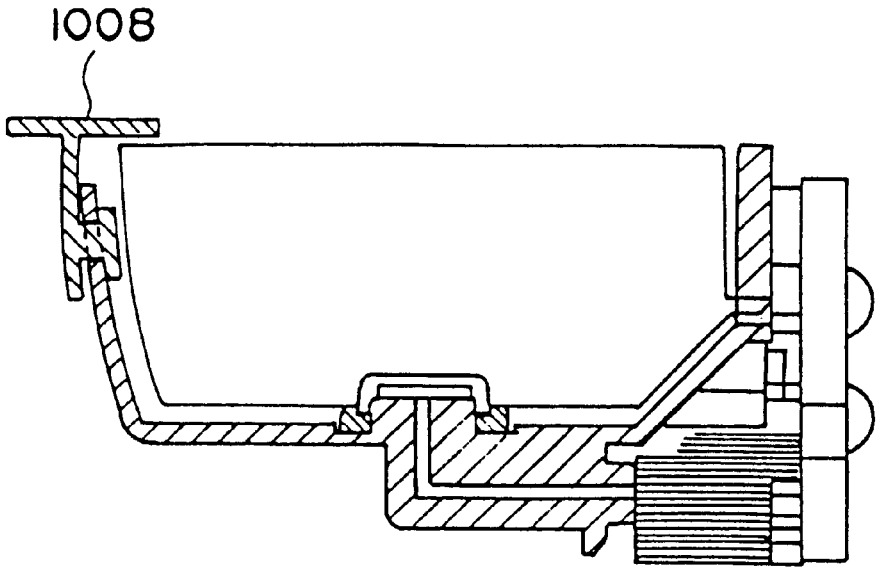
FIG. 52 is a sectional view of further modification of the ink container holder and ink container.

In the case of the modification illustrated in FIG. 52, only the claw portion is formed on the ink container, and the latching member is replaced with a pressing member 1008 which engages with the ink container holder. When the ink container is in the holder as illustrated in the drawing, the pressing member 1008 holds one end of the ink container, whereby the ink container is stabilized in the holder.

Figure 53:
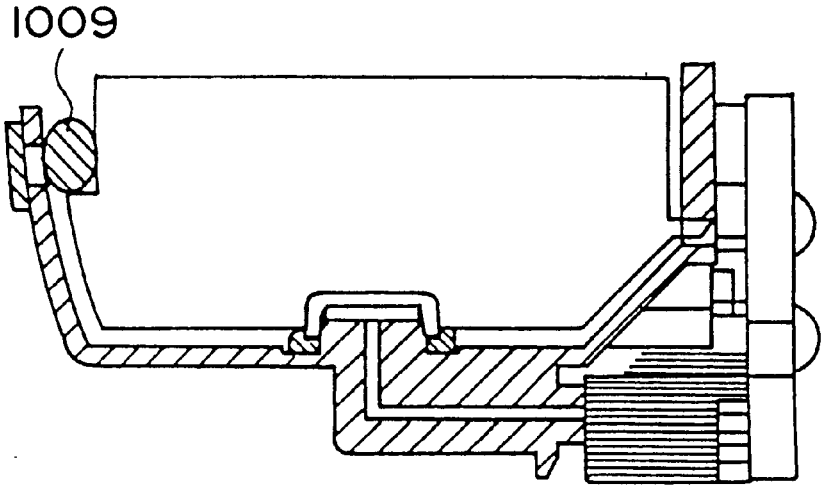
FIG. 53 is a sectional view of further modification of the ink container holder and ink container.

In the case of the example illustrated in FIG. 53, the ink container is cut away by a small piece, at the top corner portion opposite to the claw side, and a stopper 1009 composed of elastic material is inserted into the cutaway portion, to stabilize the ink container.

Figure 54:
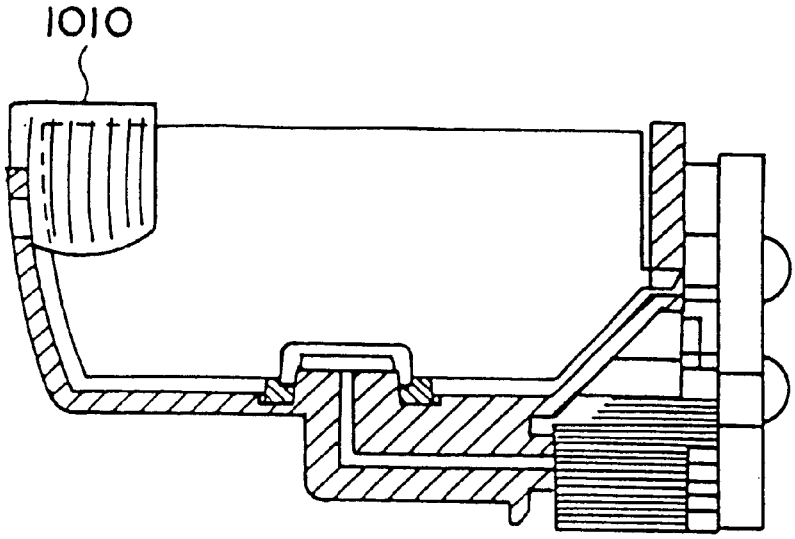
FIG. 54 is a sectional view of further modification of the ink container holder and ink container.

In the case of the example illustrated in FIG. 54, the ink container is held by a retainer 1010 like the protective member 400 illustrated in FIGS. 42*a–b*.

Figure 55:
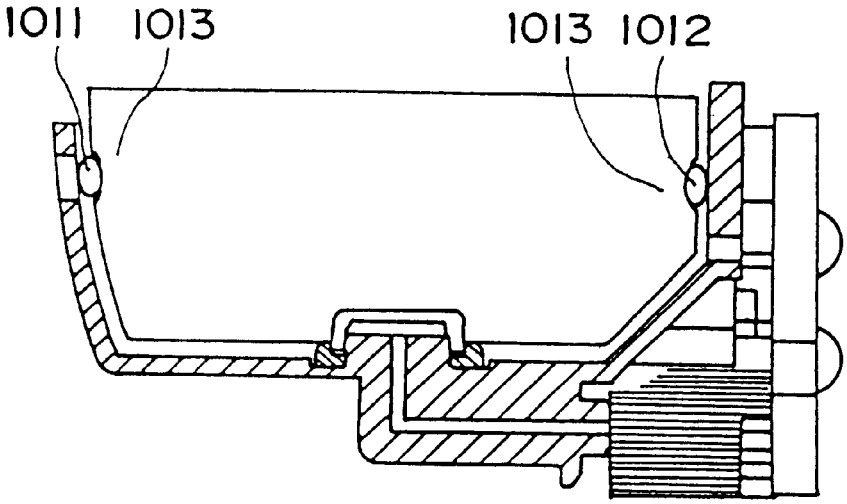
FIG. 55 is a sectional view of further modification of the ink container holder and ink container.

In the case of the example illustrated in FIG. 55, neither the latching portion nor the claw portion is formed on the ink container, but instead, a recessed portion 1013 is formed on the lateral surfaces. When the ink container is in the holder, the ink container is stabilized by an elastic member 1011 pinched between the surfaces of the ink holder and recessed portion.

In FIGS. 56–59, further modifications of the ink container are illustrated. Their descriptions will be given below.

Figure 56:
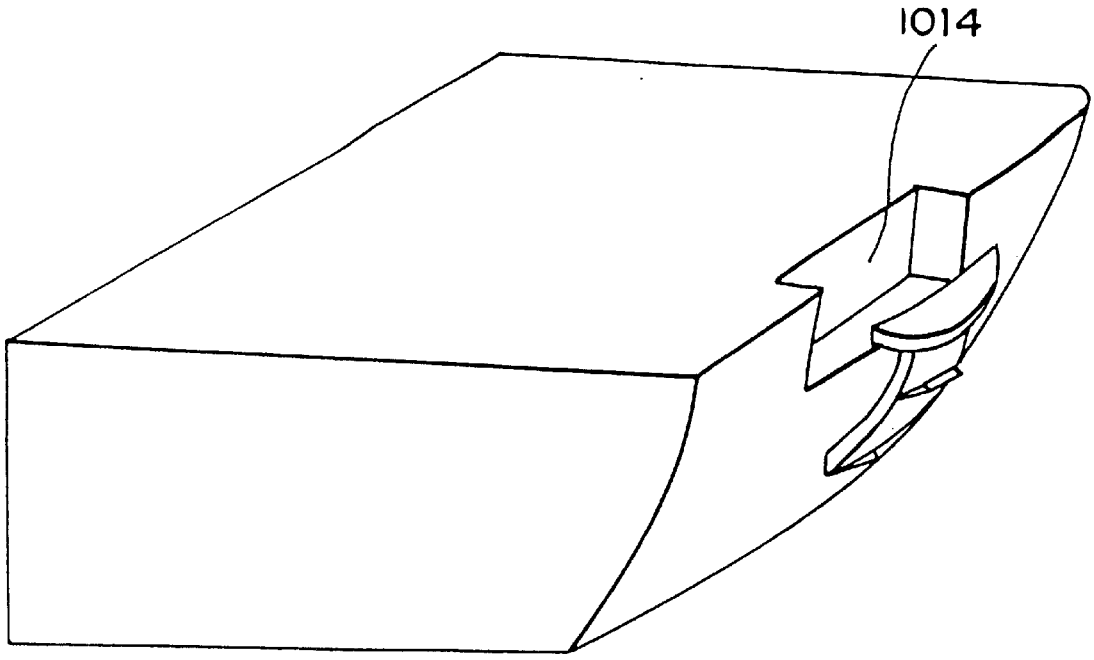
FIG. 56 is a perspective view of a modification of the ink container.

The ink container illustrated in FIG. 56 is provided with a recess 1014, which is located in the area toward which the latching portion is bent. This arrangement improves operational efficiency when mounting the ink container.

Figure 57:
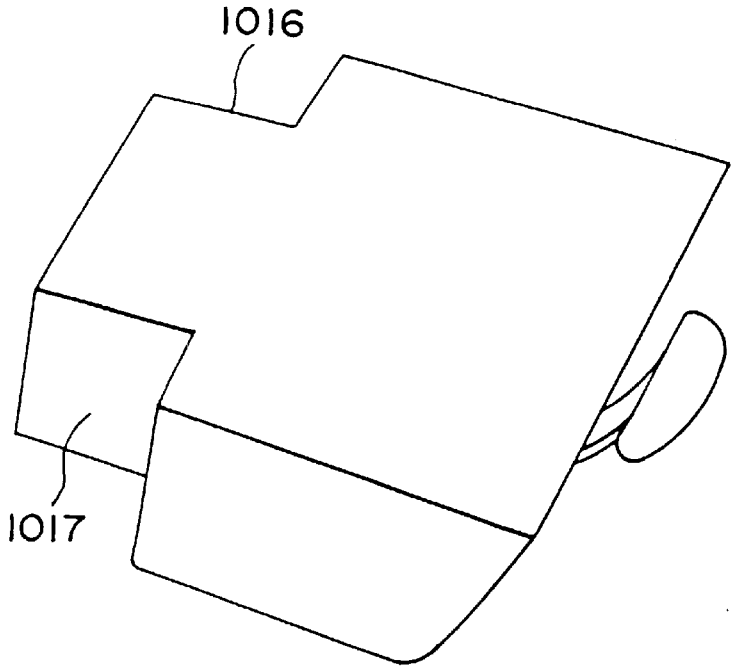
FIG. 57 is a perspective view of another modification of the ink container.

The ink container illustrated in FIG. 57 has cutaway portions 1016 and 1017, on the front surface, relative to the inserting direction, so that it is easier to insert the ink container. Though this structure reduces the ink capacity, it improves operational efficiency when mounting the ink container.

Figure 58:
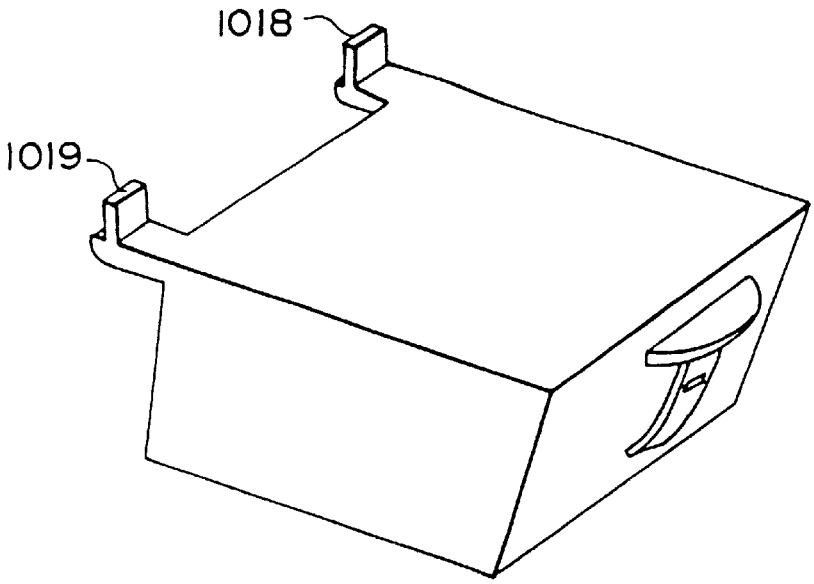
FIG. 58 is a perspective view of another modification of the ink container.

In the case of the ink container illustrated in FIG. 58, projections 1018 and 1019 are provided, which engage with the overhang portion when the ink container is mounted in the ink container holder with the overhang portion. The projections 1018 and 1019 come in contact with the bottom surface of the overhang portion, by the top surface of the portion projecting in the inserting direction. The top surface has two upward projections, which serve as stoppers for positioning the ink container.

Figure 59:
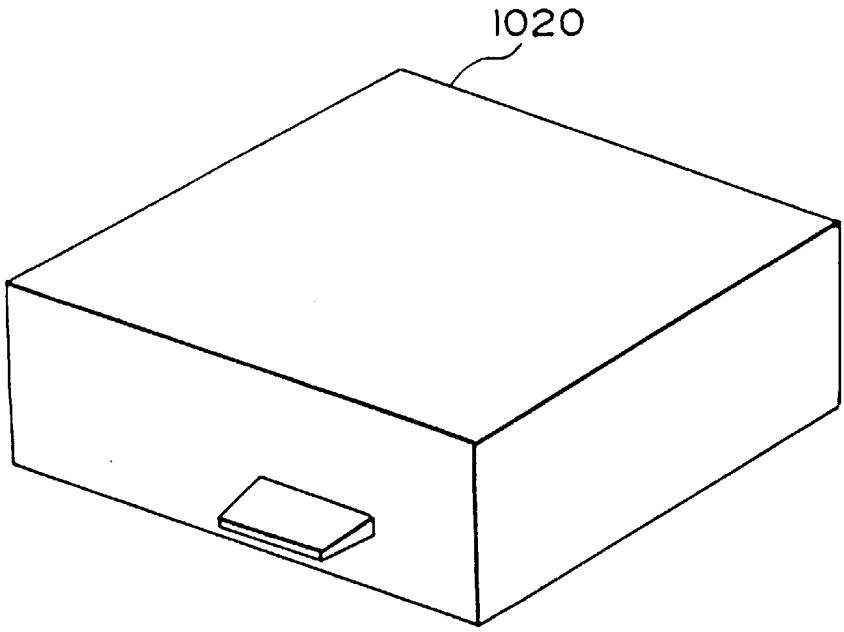
FIG. 59 is a perspective view of another modification of the ink container.

FIG. 59 depicts an ink container 1020, which has nothing but a claw portion like the one illustrated in FIG. 54.

Below, more structures for mounting the ink container will be described.

Figure 60:
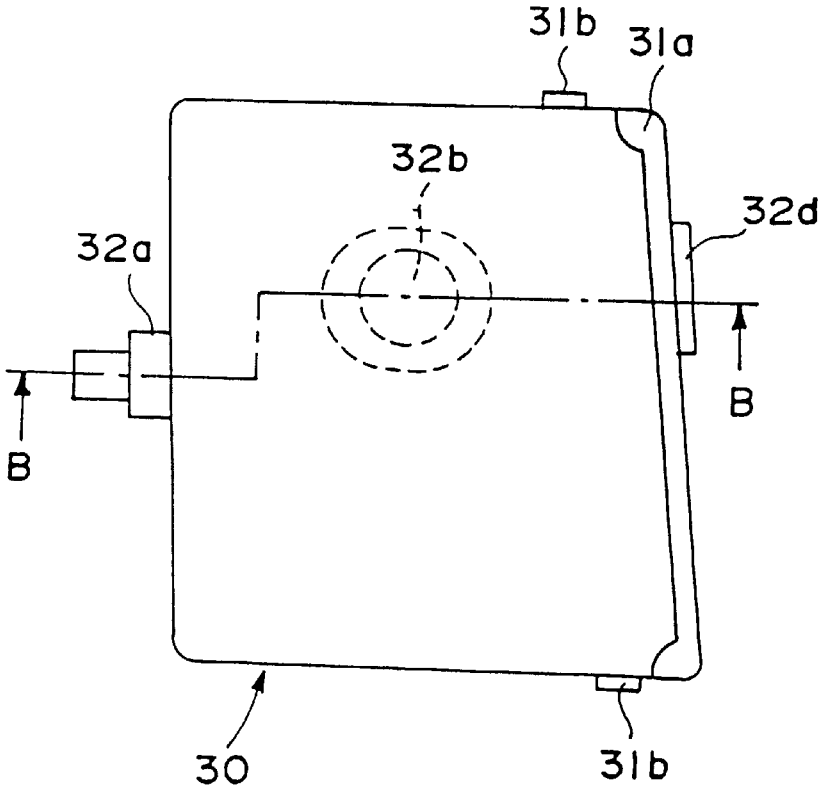
FIG. 60 is a plan view of another modification of the ink container.
Figure 61:
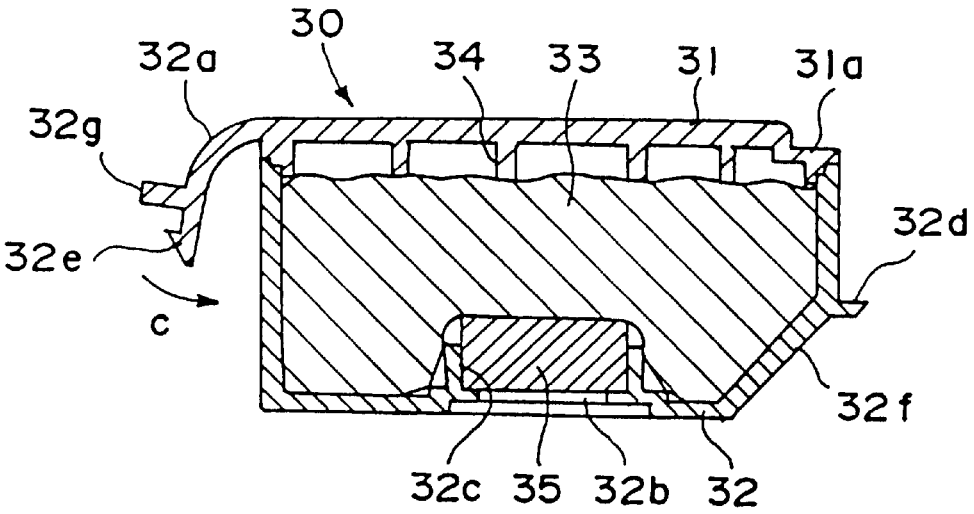
FIG. 61 is a sectional view of the ink container illustrated in FIG. 60, at a sectional line H-B.

FIG. 60 depicts an ink container, to which a differently structured latch lever is applied. FIG. 61 is a sectional view of the ink container illustrated in FIG. 60.

This ink container 30 is a modification of the ink container depicted in FIG. 14. It integrally comprises a latch lever 32*a*, the top end of which is elastically supported on a cover member 31, at the top end portion opposite to a disengagement prevention claw 32*d*. This latch lever 32*a* is slanted in the down and outward direction, and engages with the latch lever accommodating (guide) groove 60*h* of the mono-color holder 60. When the ink container 30 is in the mono-color holder 60, the latch lever 32*a* is under the pressure from the latch lever guide portion 60*m*, that is, the top end portion of the latch lever accommodating groove 60*h*, being bent in the direction indicated by an arrow mark C in FIG. 14, and a latch claw 32*e* formed at the bottom end portion of the latch lever 32*a* is engaged with the latch claw engagement hole 60*j* formed in the latch lever accommodating groove 60*h*. Further, the latch lever 32*a* integrally comprises a latch lever knob 32*g*, which is a projection to be used for manipulating the latch lever 32. In this embodiment, the latch lever 32*a* is integrally formed on the cover member 31.

On the top surface of the cover member 31, a stepped portion 31*a*, which is one step lower than the top surface of the cover member 31, is formed at the end portion on the disengagement prevention claw 32*d* side. When mounting the ink container 30 in the mono-color holder 60, the ink container 30 is inserted in such a manner as to place this stepped portion 31*a* under the overhang portions 60*f* of the mono-color holder 60 (FIGS. 11 and 12), so that the ink container position is fixed with substantial accuracy. Also, an ink container projection 32*b*, which engages with the ink container projection guide portion 60*g* of the mono-color holder 60, is formed on the ink container 30.

Figure 62:
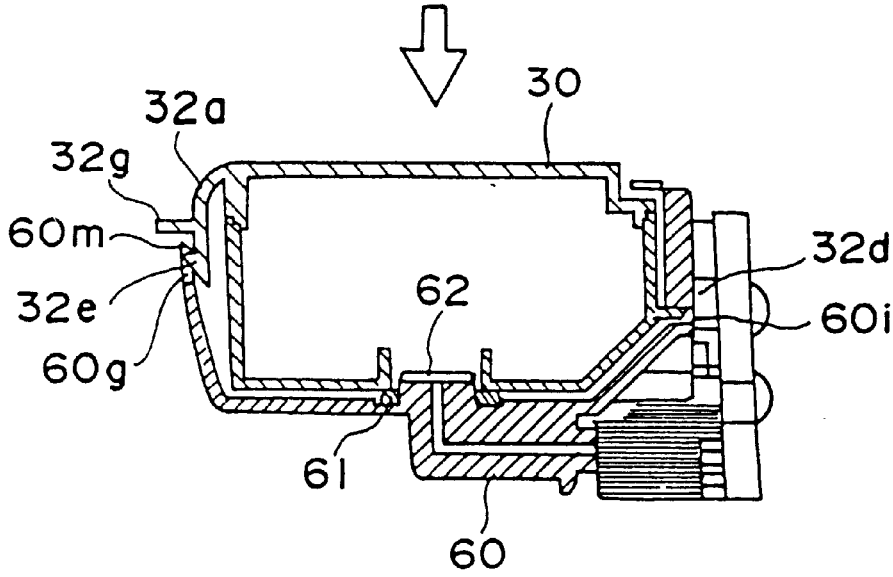
FIG. 62 is a sectional view of the ink container and mono-color holder, wherein the container is in the holder.

FIG. 62 is a sectional view of the mono-color holder 60, and the ink container 30 in the holder 60. In this drawing, the internal structure of the ink container 30 is omitted.

When the ink container 30 is in the holder 60, the disengagement prevention claw 32*d* and ink container disengagement prevention hole 60*i* are engaged, and also, the latch claw 32*e* and latch claw engagement hole 60*j* are engaged. Therefore, the ink container 30 is pressed down (in the direction of an arrow), compressing the seal ring 61 by the bottom surface. As a result, the filter 62 is pressed against the ink absorbing member 35, and the ink container 30 is airtightly connected to the mono-color holder 60, eliminating the concern for the air introduction through the joint. Therefore, a reliable recording performance can be assured. In addition, the ink leak and ink evaporation from the joint can also be prevented; therefore, it is possible to provide a highly reliable recording head cartridge.

Figure 63:
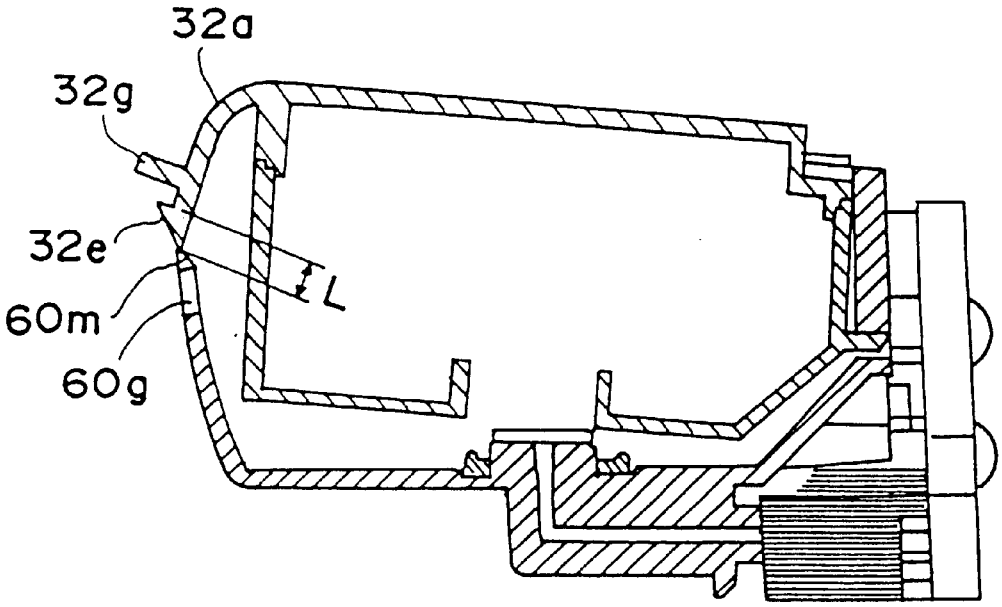
FIG. 63 is a sectional view of the ink container and mono-color holder, wherein the latch claw of the ink container is off the holder.

Next, referring to FIGS. 62 and 63, how the ink container 30 is removed from the mono-color holder 60 will be described.

When removing the ink container 30 from the mono-color holder 60, the latch lever 32*a* is pushed in by depressing the latch lever knob 32*g*, so that the engagement between the latch claw 32*e* and latch claw engagement hole 60*j* is broken. The latch lever 32*a* is elastically supported by the top end portion, and also is slanted in the down and outward direction of the ink container 30; therefore, as the latch claw 32*e* is disengaged from the latch claw engagement hole 60*j*, the latch claw 32*e* tries to restore itself to the state illustrated in FIG. 61. Consequently, the latch claw 32*e* slides up along the latch lever guide portion 60*m*, automatically raising the latch lever 32*a* side of the ink container 30, and thereby, tilting the ink container 30. In this state, the ink container 30 can be easily dismounted from the mono-color holder 60 just by grasping the raised portion.

In this case, the amount of the ink container 30 projection from the mono-color holder is determined by the configuration of the latch lever 33*e*. In this embodiment, after the latch claw 32*e* is disengaged from the latch claw engagement hole 60*j*, the tip of the latch lever 32*a* and the latch lever guide portion 60 are in contact with each other as shown in FIG. 63; therefore, the amount of the projection is substantially equivalent to the distance L between the latch claw 32*e* and the tip of the latch lever 32*a*. This distance L is 4 mm in this embodiment. However, according to the experiments by the inventors of the present invention, it was rather difficult to grasp the raised portion unless the distance L is no less than 3 mm. When the amount of the projection is large, the ink container 30 restores itself to the state illustrated in FIG. 63 if the engagement between the latch claw 32*e* and latch claw engagement hole 60*j* is incomplete when the ink container 30 is mounted in mono-color holder 60; therefore, it is possible to determine visually whether or not the ink container 30 is properly mounted, preventing a mounting error.

Figure 64:
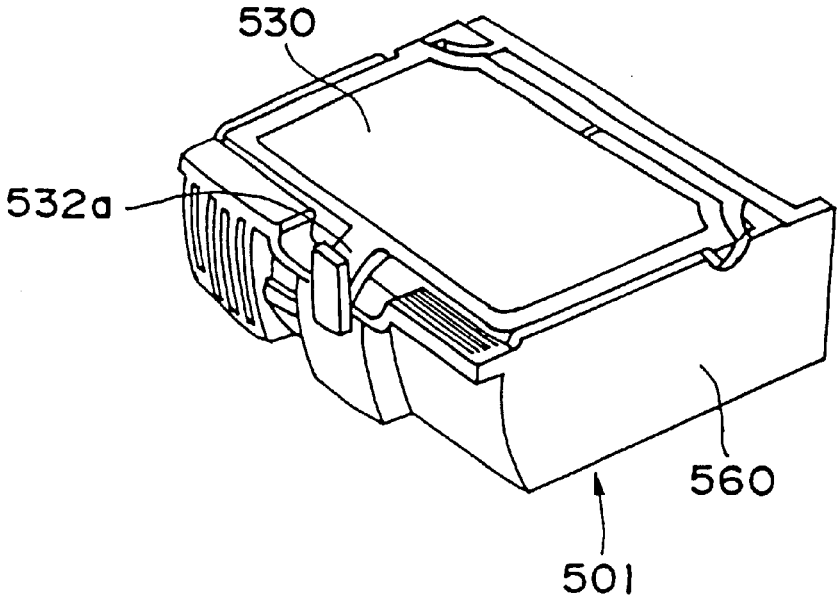
FIG. 64 is a perspective view of another embodiment of the ink container in accordance with the present invention.
Figure 65:
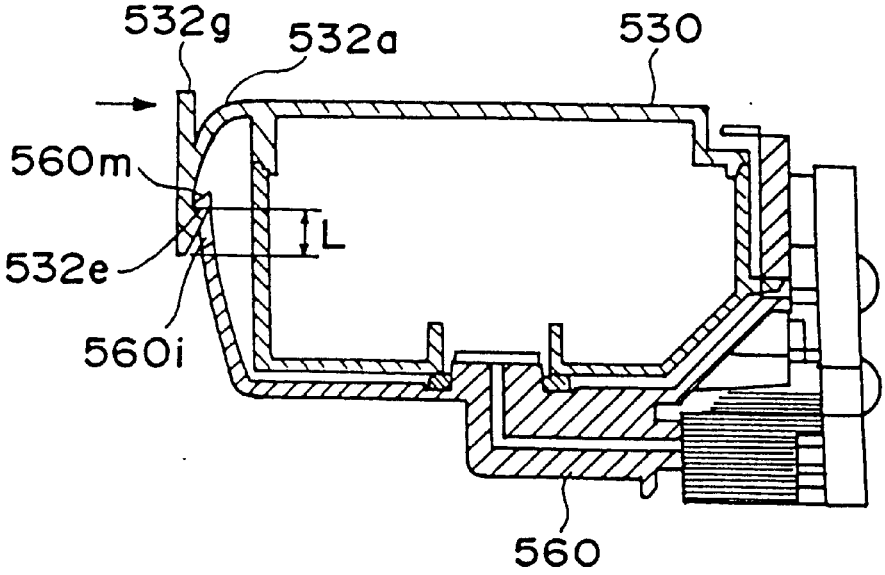
FIG. 65 is a sectional view of the ink container illustrated in FIG. 64.

FIGS. 64 and 65 show further embodiments of the recording head cartridge mountable on the carriage illustrated in FIG. 3. FIG. 64 is a perspective view thereof, and FIG. 65 is a sectional view thereof.

In this embodiment, the configurations of a latch lever 532*a* and latch lever guide portion 560*m* are different from those of the first embodiment. That is, the latch claw 532*e* of the latch lever 532*a* is formed to face inward, and engages with the latch claw engagement hole 560*j* in the inward direction. Further, the latch lever knob 532*g* extends upward. On the other hand, the tapered portion of the latch lever guide portion 560*m* is on the outward facing surface.

In this embodiment, the steps for mounting the ink container 530 into the mono-color holder 560 are the same as those of the first embodiment; therefore, only the steps for dismounting the ink container 530 from the mono-color holder 560 will be described.

In order to remove the ink container 530 from the mono-color holder 560, first, the top end portion of the latch lever knob 532*g* is pushed in (in the direction of an arrow mark in the drawing). With this action, the latch claw 532*e* is bent outward due to the principle of leverage, and disengaged from the latch claw engagement hole 560*j*. Then, the end portion of the latch claw 532*e* slides up along the tapered surface of the latch lever guide portion 560*m*, causing the ink container 530 to project from the mono-color holder 60. At this point, the ink container 530 can be easily dismounted from the mono-color holder 560 by grasping this projection portion as described in the first embodiment.

In this embodiment, after the latch claw 32*e* is disengaged from the latch claw engagement hole 560*j*, the tip of the latch lever 532*a* is in contact with the latch lever guide portion 560*m*, though not illustrated. Therefore, the amount of the ink container 530 projection is determined by the distance L between the latch claw 532*e* and the tip of the latch lever 532*a*.

Figure 66A:
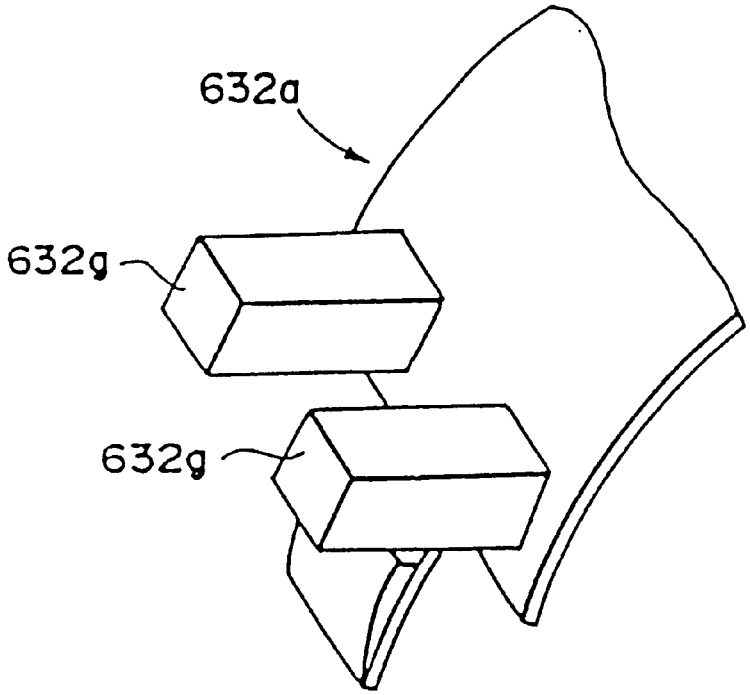
FIGS. 66*a* and 66*b* are enlarged perspective views of the latch lever knob in the third embodiment of the ink container in accordance with the present invention.
Figure 66B:
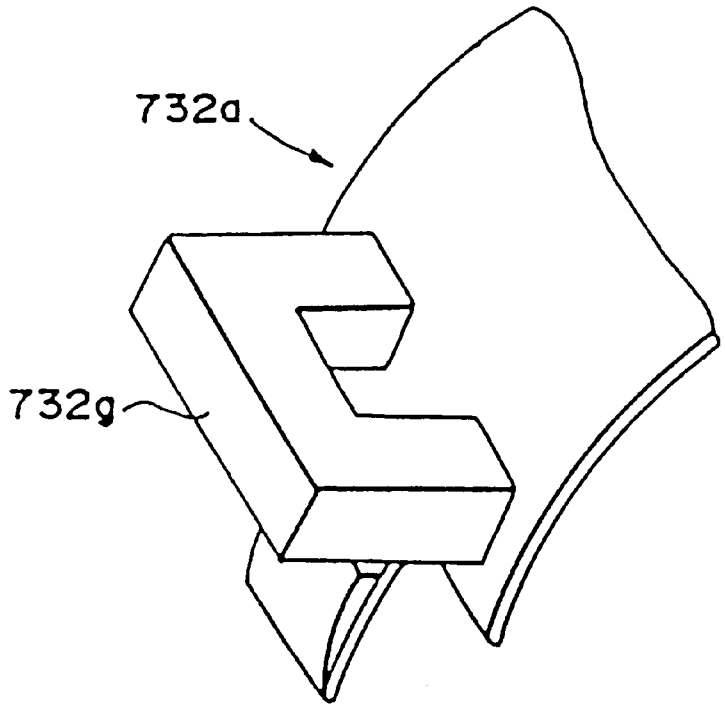

FIGS. 66*a–b* illustrate the modified configuration of the ink container latch lever. The latch lever knob portion 632*g* of the latch lever 632*a* depicted in FIG. 66*a* is constituted of two knobs, like a square pillar, disposed with a predetermined distance. In the case of the latch lever knob portion 732*g* of the latch lever 752*a* illustrated in FIG. 66*b*, a through hole is cut at the base portion, in the middle. When the latch lever knob portions 632*g* and 732*g* are given such a configuration that has a gap at the base, between their pillar-like portions, it is easy to simplify the structure of the mold to be used for forming the cover member integral with the latch levers 632*a* and 732*a*.

Since the present invention is structured as described above, it offers the following effects. When the ink container in accordance with the present invention is mounted, the slanted surface formed at the edge portion, where the bottom wall and one of the lateral walls join, is used to engage the claw-like projection, formed on the aforementioned lateral wall, into the disengagement prevention hole of the ink container holder, and also is used to engage the latch lever, supported elastically on another lateral wall opposite to the wall with the claw-like projection, with the engagement hole of the ink container holder; in other words, the ink container can be accurately positioned and held in the ink container holder, using the simple structure and through the simple operation. In addition, when mounting the ink container into the ink container holder or dismounting it, the ink container is rotated about the side with the projection; therefore, it can be mounted or dismounted using a smaller space.

A stepped portion to be placed under the overhang portion of the ink container holder is formed on the top surface of the ink container; therefore, the claw-like projection can be easily aligned with the engagement prevention hole.

The projection, which is to be engaged into the recessed portion of the ink container holder, is formed on the both lateral walls of the ink container, at the top end portion; therefore, the claw-like projection and disengagement prevention hole can be easily aligned, and also, the latch claw can be easily engaged with the engagement hole.

The latch lever is supported at the bottom portion of the ink container, and slanted or bent in the up and outward direction; therefore, when the ink container is dismounted from the ink container holder, the latch lever side of the ink container rises following the inclined or curved surface of the latch lever, projecting from the ink container holder, making it easier to remove the ink container from the ink container holder.

When the colors of the inks stored within the ink container are different from each other, the ink delivery ports correspondent to these inks are aligned in the direction from one ink container end to the other end; therefore, when the ink container is mounted in the ink container holder, the ink delivery ports and the correspondent ink tapping means of the ink container holder are sequentially joined as the ink container is rotated, reliably connecting the two components.

When the ink container in accordance with the present invention is mounted in the ink container holder in accordance with the present invention, the ink container is inserted in such a manner as to place the container under the overhang portion which partially covers the opening of the ink container holder, so that the claw-like projection of the ink container is engaged with the disengagement prevention hole formed in one of the lateral walls of the ink container holder, and the latch lever of the ink container is engaged with the engagement hole formed in the opposite lateral wall; therefore, the ink container can be accurately positioned and retained, using the simple structure, and through the simple operation. In addition, when the ink container is mounted or dismounted, the ink container is rotated about the ink container lateral wall with the claw-like projection; therefore, the ink container can be mounted or dismounted using a smaller space.

A recessed portion, with which the projection formed on the ink container engages, is formed on both lateral walls of the ink container holder, at the top ends; therefore, when the ink container is mounted, it is regulated where in the ink container holder the ink container is to be mounted, making it easier to align the claw-like projection with the disengagement prevention hole.

A latch lever guide groove, with which the latch lever engages, is formed, and an engagement hole is formed in this latch lever guide groove; therefore, when the ink container is mounted, the latch lever is pushed in along the latch lever guide groove, causing the latch claw to engage easily with the engagement hole. In addition, the latch lever is elastically supported at the bottom portion of the ink container, being slanted or bent in the up and outward direction; therefore when the ink container is removed, the latch lever side of the ink container rises along the slanted or curved surface of the latch lever, forcing the container to project from the ink container holder, and thereby, making it easier to remove the ink container.

Pressing means for pressing the latch lever side of the ink container bottom toward the opening of the ink container holder is provided on the bottom wall of the opening; therefore, when the latch claw is disengaged from the engagement hole, the ink container is projected more, allowing the ink container to be removed more easily.

When the ink container contains a plurality of inks of different colors, and the ink container and ink container holder comprise the corresponding number of ink delivery ports and ink tapping means, respectively, the ink tapping means are arranged in the direction from one of the lateral walls of the ink container holder to the other; therefore, the joints between the ink delivery ports and ink tapping means are stabilized.

Partitioning plates are placed in the ink container holder to divide the internal space of the ink container holder into a plurality of chambers; therefore, a plurality of the ink containers can be mounted, allowing the inks to be efficiently used. In this case, matching slanted surfaces are formed on the ink containers and corresponding ink container holders, respectively; therefore, the ink containers are prevented from being mounted in the wrong space.

The ink container holder is integrally formed with a recording head, realizing a recording head cartridge in which the ink container is removably mountable. When this recording head cartridge is rendered removably mountable on the carriage, it is applicable to ink jet recording apparatuses of the serial type.

Not only positioning means for determining the positional relationship between the ink container holder and carriage is provided on the outward facing surface of one of the ink container lateral walls, but also, a recessed engagement portion, which engages with a guide member elastically supported on the carriage, is formed on the outward facing surface of the opposite lateral wall; therefore, the ink container holder can be mounted on the carriage through the same steps as those used for mounting the ink container in the ink container holder. That is, the ink container holder can be mounted on the carriage by means of pushing the opposite lateral wall side onto the carriage in such a manner as to rotate the ink container holder about the positioning means side; therefore, the ink container holder can be accurately positioned and retained on the carriage, using a smaller space.

In this case, the reliable contact can be assured between the head terminal and carriage terminal by means of arranging the head terminal and the engagement portion in a straight line in parallel to the lateral wall of the ink container holder.

A holder manipulating tab is provided on the outward facing surface of the exposed lateral wall of the holder; therefore, the ink container holder can be easily removed. Further, the latch claw engagement hole and the tab are staggered; therefore, it is possible to prevent the mixup between the operation for removing the ink container from the ink container holder and the operation for removing the ink container holder from the carriage.

A manipulable tab for mounting the ink container holder on the carriage, or removing it, is formed on the ink container holder, in the recessed portion, that is, the recessed portion relative to the portion which is projected outward to form the latch lever accommodating portion; therefore, it is unnecessary to specially create a space, in which an operator places a finger when mounting the ink container holder onto the carriage, or removing it. Consequently, it is possible to simplify the structure of the portion to be manipulated when the holder is mounted on carriage or removed, as well as to reduce the ink container holder size. In particular, when this manipulable portion is formed at the top portion of the recessed portion, the mounting or removing operation can be more easily carried out.

Further, when this manipulable portion is formed on the surface provided with the fixing portion to be held by the carriage when the ink container holder is on the carriage, at the location farthest away from this fixing portion; therefore, the ink container holder can be securely held by the carriage, while allowing the ink container holder to be mounted on the carriage or removed, by a lesser force, making the mounting or removing operation easier.

The manipulable knob portion for mounting or removing the ink container, and the manipulable tab portion for mounting the ink container holder on the carriage or removing it, are disposed on the same side, relative to the moving direction of the carriage, concentrating the manipulable portions; therefore, the mounting or removing operation is easier whether the ink container is involved or the ink container holder. In addition, as long as a space usable for the operator to manipulate the ink container or ink container holder is available on the side of the manipulable portions, the mounting or removing operation can be carried out wherever the carriage is located. In this case, when the manipulable portion for the mounting or removing operation of the ink container is disposed above the manipulable portion for mounting the ink container holder on the carriage or removing it, the ink container, which is more frequently mounted or removed, can be more easily mounted or removed. In particular, a plurality of ink containers can be mounted on the ink container holder, the manipulable portions of the ink containers are arranged in the same straight line; therefore, a compact and logical design can be realized, and also, the size can be reduced.

The carriage in accordance with the present invention removably holds the ink container holder integral with a recording head, among the ink container holder in accordance with the present invention; therefore, the ink container holder can be simply mounted or removed, using a smaller space.

As for the ink container holder removably mountable on such a carriage, any ink container holder is acceptable as long as it comprises positioning means, an electrical terminal portion, and a guide member, and their positional relationship is in accordance with the present invention. For example, the color recording head and monochrome recording head can be optionally used. In particular, when the ink container holder with the manipulable tab portion is mounted on the carriage, the manipulable portion of the ink container, that is, the latch lever, and the manipulable tab portion of the ink container holder, are disposed on the same side relative to the moving direction of the carriage; therefore, the relationship between the mounting and dismounting operations becomes coherent, improving operational efficiency, and also, such an arrangement is superior in terms of design.

An overhang portion, which partially covers the top surface of the ink container holder when the ink container holder is on the carriage, is formed on the carriage, on the surface facing the outward facing surface of one of the lateral walls of the ink container holder, opposite to the manipulable portions; therefore, the ink container holder and carriage can be more easily aligned. In addition, with the presence of the overhang portion, it is difficult for the operator's finger or the like to contact the terminal portion or the like; in other words, the carriage terminal can be protected.

Further, the ink jet recording apparatus in accordance with the present invention comprises two bearing portions and two clasping portions, as the supporting means for supporting the carriage in the recording apparatus reciprocatively, wherein the gap between the two components constituting the clasping portion closer to the guide member is rendered larger than that of the other clasping portion; therefore, the carriage is prevented from being excessively deformed, when the ink container holder is mounted or dismounted, eliminating one of the operational problems.

Since the ink jet recording apparatus in accordance with the present invention comprises the carriage in accordance with the present invention, the space necessary for mounting the ink container holder on the carriage or removing it, or mounting the ink container into the ink container holder or removing it, can be smaller. Consequently, it is possible to realize a smaller ink jet recording apparatus. Further, the ink container is accurately positioned in the ink container holder, and the ink container holder is accurately positioned on the carriage; therefore, it is possible to provide a highly reliable ink jet recording apparatus capable of producing high quality images.

While the invention has been described with reference to the structures disclosed herein, it is not confined to the details set forth and this application is intended to cover such modifications or changes as may come within the purposes of the improvements or the scope of the following claims.

What is claimed is:

1. A liquid container system for an ink jet recording apparatus, said liquid container system for containing liquid to be used by an ink jet head in a holder having the ink jet head and first and second locking portions, said holder having an ink supply tube, said liquid container system comprising:

a liquid container including a main body for containing the liquid, an ink absorbing material in said main body, a supplying port for supplying the liquid to the ink jet head, said supplying port being disposed in a portion of said liquid container at a bottom thereof in a recording operation, an air vent portion for fluid communication between an inside of said main body and ambience, and a first engaging portion provided on a side of said main body for engaging with the first locking portion of the holder; and a fixing member separate from said liquid container, said fixing member for fixing said liquid container to the holder and for maintaining a pressure-contact state between the ink supply tube and said ink absorbing material through said supplying port, said fixing member having a second engaging portion provided on a side opposite from said side of said liquid container having said first engaging portion, said second engaging portion for engaging with the second locking portion of the holder, and said fixing member having a third engaging portion for engagement with a part of said liquid container.

2. A liquid container system according to a claim 1, wherein said main body accommodates a negative pressure producing material for retaining the liquid.

3. A liquid container system according to claim 1, wherein said main body accommodates a negative pressure producing material for retaining the liquid, and wherein said ink supplying port is provided with fibrous material.

4. A liquid container system according to claim 1, wherein said main body contains black ink.

5. A liquid container system according to claim 1, wherein the inside of said main body is divided into three portions, and separate supplying ports and air vents are provided for each of three portions, and wherein said three portions contain yellow ink, cyan ink and magenta ink, respectively.

6. A liquid container system according to claim 1, wherein said fixing member is provided with an operating portion for facilitating demounting of the holder.

7. A liquid container system according to claim 1, wherein when said liquid container is mounted to the holder, said second engaging portion takes a position above said first engaging portion.

8. A liquid container system according to claim 1, wherein said second engaging portion is comprised of a projection having a height of approximately 1 mm.

9. A liquid container system according to claim 1, wherein a normal line from a central portion of said supplying port to a line connecting a central portion of said first engaging portion and a central portion of said second engaging portion, is not more than 10 mm.

10. A liquid container system according to claim 1, wherein a line connecting a central portion of a contact portion of a supply tube of the ink let head and said supplying port, to a line connecting a central portion of said first engaging portion and a central portion of said second engaging portion, is not more than 10 mm.

11. A liquid container system according to claim 1, wherein said supplying port is on a line connecting a central portion of said first engaging portion and a central portion of said second engaging portion.

12. A liquid container system according to claim 1, wherein said holder is detachably mountable relative to a carriage of the ink jet recording apparatus, and is provided with a mounting engageable portion for mounting the carriage, and wherein when the holder is mounted to the ink jet recording apparatus, said second engaging portion takes a position above the mounting engageable portion.

13. A liquid container system according to claim 12, wherein a bottom portion in operation of the holder is provided with urging means for upwardly urging said liquid container.

14. A liquid container system according to claim 12, wherein an inside of said holder is divided into two zones, each of which is provided with said first and second locking portions, and further comprising first and second ones of said liquid containers, wherein said first liquid container contains one color ink and is mountable to one of said zones, and a said liquid container containing a plurality of inks in integrally formed chambers is mountable to the other zone.

15. A liquid container system according to claim 12, wherein the holder and the ink jet head are integral, and said ink supply tube is in fluid communication with the ink jet head.

16. A liquid container system according to claim 12, wherein a side of the holder is provided with an electric contact for receiving an electric signal to be supplied to the ink jet head.

17. A liquid container system according to claim 12, wherein the holder detachably retains the liquid container while the holder is mounted on the carriage.

18. A liquid container system according to claim 1, wherein said fixing member is elastic.

19. A liquid container system according to claim 1, wherein said third engaging portion of said fixing member is engaged with a part of a top side of said liquid container.

20. A liquid container system according to claim 19, wherein said part of the top side of said liquid container is located substantially at a center of the top side.

21. A liquid container system according to claim 19, wherein said part of the top side of said liquid container is located adjacent a lateral end of the top side.

22. A liquid container system for an ink jet recording apparatus, said liquid container system for containing liquid to be used by an ink jet head in a holder having the ink jet head and an ink supply tube, said liquid container system comprising:

a liquid container including a main body for containing the liquid, an ink absorbing material in said main body, a supplying port for supplying the liquid to the ink jet head, said supplying port being disposed in a portion of said liquid container at a bottom thereof in a recording operation, and an air vent portion for fluid communication between an inside of said main body and ambience; and a fixing member separate from said liquid container for maintaining a press-contact state between the ink supply tube and said ink absorbing material through said supplying port, said fixing member including a first engaging portion for engagement with a first part of said holder, a second engaging portion for engagement with a second part of said holder at a position opposite from said first part, and a third engaging portion for connecting said first and second engaging portions, said third engaging portion being usable for pushing a top part of said liquid container.

23. A liquid container system according to claim 22, wherein said main body accommodates a negative pressure producing material for retaining the liquid.

24. A liquid container system according to claim 22, wherein said main body accommodates a negative pressure producing material for retaining the liquid, and wherein said ink supplying port is provided with fibrous material.

25. A liquid container system according to claim 22, wherein said main body contains black ink.

26. A liquid container system according to claim 22, wherein the inside of said main body is divided into three portions, and separate supplying ports and air vents are provided for each of three portions, and wherein said three portions contain yellow ink, cyan ink and magenta ink, respectively.

27. A liquid container system according to claim 22, wherein said fixing member is provided with an operating portion for facilitating demounting of the holder.

28. A liquid container system according to claim 22, wherein when said third engaging portion is provided with an elastic spring member.

29. A liquid container system according to claim 22, wherein said second engaging portion is comprised of a projection having a height of approximately 1 mm.

30. A liquid container system according to claim 22, wherein a normal line from a central portion of said supplying port to a line connecting a central portion of said first engaging portion and a central portion of said second engaging portion, is not more than 10 mm.

31. A liquid container system according to claim 22, wherein a line connecting a central portion of a contact portion of a supply tube of the ink let head and said supplying port, to a line connecting a central portion of said first engaging portion and a central portion of said second engaging portion, is not more than 10 mm.

32. A liquid container system according to claim 22, wherein said supplying port is on a line connecting a central portion of said first engaging portion and a central portion of said second engaging portion.

33. A liquid container system according to claim 22, wherein said holder is detachably mountable relative to a carriage of the ink jet recording apparatus, and is provided with a mounting engageable portion for mounting to the carriage, and wherein when the holder is mounted to the ink jet recording apparatus, said second engaging portion takes a position above the mounting engageable portion.

34. A liquid container system according to claim 33, wherein a bottom portion in operation of the holder is provided with urging means for upwardly urging said liquid container.

35. A liquid container system according to claim 33, wherein an inside of said holder is divided into two zones, each of which is provided with separate first and second locking portions, and further comprising first and second ones of aid liquid container, wherein said first liquid container contains one color ink and is mountable to one of said zones, and said liquid container containing a plurality of inks in integrally formed chambers is mountable to the other zone.

36. A liquid container system according to claim 33, wherein the holder and the ink jet head are integrated, and said ink supply tube is in fluid communication with the ink jet head.

37. A liquid container system according to claim 33, wherein a side of the holder is provided with an electric contact for receiving an electric signal to be supplied to the ink jet head.

38. A liquid container system according to claim 33, wherein the holder detachably retains the liquid container while the holder is mounted on the carriage.

39. A liquid container system according to claim 22, wherein said fixing member is elastic.

40. A liquid container system according to claim 22, wherein said third engaging portion of said fixing member is engaged with a part of a top side of said liquid container.

41. A liquid container system according to claim 40, wherein said part of the top side of said liquid container is located substantially at a center of the top side.

42. A liquid container system according to claim 40, wherein said part of the top side of said liquid container is located adjacent a lateral end of the top side.

43. A liquid container system for an ink jet recording apparatus, said liquid container system for containing liquid to be used by an ink jet head in a holder having the ink jet head and an ink supply tube, said liquid container system comprising:

a liquid container including a main body for containing the liquid, an ink absorbing material in said main body, a supplying port for supplying the liquid to the ink jet head, said supplying port being disposed in a portion of said liquid container at a bottom thereof in a recording operation, and an air vent portion for fluid communication between an inside of said main body and ambience; and a fixing member separate from said liquid container for maintaining a press-contact state between the ink supply tube and said ink absorbing material through said supplying port, said fixing member comprising a cover member covering a part of a top side of said container, said fixing member including a first engaging portion for engagement with a first part of said holder, a second engaging portion for engagement with a second part of said holder at a position opposite from said first part, and a third engaging portion for connecting said first and second engaging portions, said third engaging portion being usable for pushing a top part of said liquid container.

44. A liquid container system according to a claim 43, wherein said main body accommodates a negative pressure producing material for retaining the liquid.

45. A liquid container system according to claim 43, wherein said main body accommodates a negative pressure producing material for retaining the liquid, and wherein said ink supplying port is provided with fibrous material.

46. A liquid container system according to claim 43, wherein said main body contains black ink.

47. A liquid container system according to claim 43, wherein the inside of said main body is divided into three portions, and separate supplying ports and air vents are provided for each of three portions, and wherein said three portions contain yellow ink, cyan ink and magenta ink, respectively.

48. A liquid container system according to claim 43, wherein said fixing member is provided with an operating portion for facilitating demounting of the holder.

49. A liquid container system according to claim 43, wherein when said liquid container is mounted to the holder, said second engaging portion takes a position above said first engaging portion.

50. A liquid container system according to claim 43, wherein said second engaging portion is comprised of a projection having a height of approximately 1 mm.

51. A liquid container system according to claim 43, wherein each of two sides connecting said one side and said opposite side is provided with a projection contactable to a part of the holder.

52. A liquid container system according to claim 43, wherein a normal line from a central portion of said supplying port to a line connecting a central portion of said first engaging portion and a central portion of said second engaging portion, is not more than 10 mm.

53. A liquid container system according to claim 43, wherein a line connecting a central portion of a contact portion of a supply tube of the ink jet head and said supplying port, to a line connecting a central portion of said first engaging portion and a central portion of said second engaging portion, is not more than 10 mm.

54. A liquid container system according to claim 43, wherein said supplying port is on a line connecting a central portion of said first engaging portion and a central portion of said second engaging portion.

55. A liquid container system according to claim 43, wherein said holder is detachably mountable relative to a carriage of the ink jet recording apparatus, and is provided with a mounting engageable portion for mounting the carriage, and wherein when the holder is mounted to the ink jet recording apparatus, said second engaging portion takes a position above the mounting engageable portion.

56. A liquid container system according to claim 55, wherein a bottom portion in operation of the holder is provided with urging means for upwardly urging said liquid container.

57. A liquid container system according to claim 55, wherein an inside of said holder is divided into two zones, each of which is provided with said first and second locking portions, and further comprising first and second ones of said liquid containers, wherein said first liquid container contains one color ink and is mountable to one of said zones, and a said liquid container containing a plurality of inks in integrally formed chambers is mountable to the other zone.

58. A liquid container system according to claim 55, wherein the holder and the ink jet head are integral, and said ink supply tube is in fluid communication with the ink jet head.

59. A liquid container system according to claim 55, wherein a side of the holder is provided with an electric contact for receiving an electric signal to be supplied to the ink jet head.

60. A liquid container system according to claim 55, wherein the holder detachably retains the liquid container while the holder is mounted on the carriage.

61. A liquid container system according to claim 43, wherein said fixing member is elastic.

62. A liquid container system according to claim 43, wherein said third engaging portion of said fixing member is engaged with a part of a top side of said liquid container.

63. A liquid container system according to claim 62, wherein said part of the top side of said liquid container is located substantially at a center of the top side.

64. A liquid container system according to claim 62, wherein said part of the top side of said liquid container is located adjacent a lateral end of the top side.

* * * * *

UNITED STATES PATENT AND TRADEMARK OFFICE

CERTIFICATE OF CORRECTION

PATENT NO. : 6,361,158 B1
DATED : March 26, 2002
INVENTOR(S) : Hiroyuki Inoue et al.

It is certified that error appears in the above-identified patent and that said Letters Patent is hereby corrected as shown below:

Title page,
Item [57], ABSTRACT,
Line 4, "a" (1st occurrence) should read -- an --; and
Item [56], References Cited, FOREIGN PATENT DOCUMENTS, "JP 53-18762" should read -- JP 5-318762 --.

Column 5,
Line 9, "toe" should read -- the --.

Column 13,
Line 23, "A s" should read -- As --; and
Line 65, "r" should be deleted.

Column 17,
Line 8, "b e" should read -- be --; and
Line 20, "t he" should read -- the --.

Column 28,
Line 15, "1.5C <=TR<=3C" should read -- 1.5C $\leq$ TR $\leq$ 3C --.

Column 29,
Line 53, "h<=H<=4h;" should read -- h $\leq$ H $\leq$ 4h; --.

Column 40,
Line 35, "when" should be deleted.

Column 41,
Line 3, "aid" should read -- said --.

Signed and Sealed this

Eighteenth Day of March, 2003

JAMES E. ROGAN
*Director of the United States Patent and Trademark Office*